US008361278B2

(12) United States Patent
Fike et al.

(10) Patent No.: US 8,361,278 B2
(45) Date of Patent: Jan. 29, 2013

(54) FOOD WRAP BASE SHEET WITH REGENERATED CELLULOSE MICROFIBER

(75) Inventors: Gregory M. Fike, Atlanta, GA (US); Joseph R. Pounder, Greenville, WI (US); Daniel W. Sumnicht, Hobart, WI (US)

(73) Assignee: Dixie Consumer Products LLC, Atlanta, GA (US)

( * ) Notice: Subject to any disclaimer, the term of this patent is extended or adjusted under 35 U.S.C. 154(b) by 305 days.

(21) Appl. No.: 12/560,548

(22) Filed: Sep. 16, 2009

(65) Prior Publication Data

US 2010/0065235 A1 Mar. 18, 2010

Related U.S. Application Data

(60) Provisional application No. 61/192,159, filed on Sep. 16, 2008.

(51) Int. Cl.
*D21H 13/08* (2006.01)
*D21H 27/10* (2006.01)
*D21H 15/00* (2006.01)

(52) U.S. Cl. ..... 162/146; 162/135; 162/157.7; 162/158; 162/164.1; 162/168.1; 162/169; 428/195.1; 428/359; 428/393

(58) Field of Classification Search ..... 162/109, 162/141, 146, 149–150, 157.1, 157.6, 157.7, 162/158, 164.1, 168.1, 179, 187, 135, 169; 428/359, 391, 393, 304.4, 311.11, 311.51, 428/311.71, 195.1; 206/432, 769–770; 426/410, 426/415

See application file for complete search history.

(56) References Cited

U.S. PATENT DOCUMENTS

| | | | | | |
|---|---|---|---|---|---|
| 1,682,346 | A | | 8/1928 | Lorenz | |
| 1,971,951 | A | | 8/1934 | Skirrow et al. | |
| 2,109,883 | A | | 3/1938 | Herrmann et al. | |
| 2,304,287 | A | * | 12/1942 | Schur | 428/341 |
| 2,428,046 | A | | 9/1947 | Sisson et al. | |
| 2,440,761 | A | | 5/1948 | Sisson et al. | |
| 2,516,384 | A | | 7/1950 | Hill et al. | |
| 2,792,765 | A | * | 5/1957 | Kerridge et al. | 162/28 |
| 2,868,685 | A | * | 1/1959 | Downs et al. | 156/90 |
| 2,926,116 | A | | 2/1960 | Keim | |
| 2,934,468 | A | * | 4/1960 | Strazdins | 162/180 |
| 2,944,931 | A | | 7/1960 | Yang | |
| 2,995,180 | A | | 8/1961 | Klenk et al. | |
| 2,995,459 | A | | 8/1961 | Soloway | |
| 2,999,786 | A | * | 9/1961 | Downs et al. | 162/129 |
| 3,009,822 | A | | 11/1961 | Drelich et al. | |
| 3,028,296 | A | * | 4/1962 | Adams et al. | 162/146 |
| 3,058,873 | A | | 10/1962 | Keim et al. | |
| 3,145,118 | A | * | 8/1964 | Mahoney | 427/363 |
| 3,151,017 | A | | 9/1964 | Brafford | |
| 3,175,339 | A | | 3/1965 | McDowell | |
| 3,288,632 | A | * | 11/1966 | Rush et al. | 427/211 |
| 3,301,746 | A | | 1/1967 | Sanford et al. | |
| 3,337,671 | A | | 8/1967 | Drisch et al. | |
| 3,382,140 | A | | 5/1968 | Henderson et al. | |
| 3,432,936 | A | | 3/1969 | Cole et al. | |
| 3,445,330 | A | * | 5/1969 | Kulick et al. | 162/164.2 |
| 3,476,644 | A | | 11/1969 | Krehnbrink | |
| 3,507,745 | A | | 4/1970 | Fuerst | |
| 3,508,945 | A | | 4/1970 | Haemer et al. | |
| 3,545,705 | A | | 12/1970 | Hodgson | |
| 3,546,716 | A | | 12/1970 | Laumann | |
| 3,549,742 | A | | 12/1970 | Benz | |
| 3,556,932 | A | | 1/1971 | Coscia et al. | |
| 3,556,933 | A | | 1/1971 | Williams et al. | |
| 3,607,348 | A | | 9/1971 | Wray et al. | |
| 3,612,054 | A | | 10/1971 | Matsuda et al. | |
| 3,620,911 | A | | 11/1971 | Eklund | |
| 3,640,841 | A | | 2/1972 | Winslow et al. | |
| 3,654,064 | A | | 4/1972 | Laumann | |
| 3,692,622 | A | | 9/1972 | Dunning | |
| 3,700,623 | A | | 10/1972 | Keim | |
| 3,716,449 | A | | 2/1973 | Gatward et al. | |
| 3,772,076 | A | | 11/1973 | Keim | |
| 3,785,918 | A | | 1/1974 | Kawai et al. | |
| 3,844,880 | A | | 10/1974 | Meisel, Jr. et al. | |
| 3,858,623 | A | | 1/1975 | Lefkowitz | |
| 3,871,952 | A | | 3/1975 | Robertson | |
| RE28,459 | E | | 7/1975 | Cole et al. | |
| 3,905,863 | A | | 9/1975 | Ayers | |
| 3,926,716 | A | | 12/1975 | Bates | |
| 3,974,025 | A | | 8/1976 | Ayers | |
| 3,994,771 | A | | 11/1976 | Morgan, Jr. et al. | |
| 4,016,030 | A | | 4/1977 | Sobota | |
| 4,036,679 | A | | 7/1977 | Back et al. | |
| 4,041,989 | A | | 8/1977 | Johansson et al. | |
| 4,064,213 | A | | 12/1977 | Lazorisak et al. | |
| 4,071,050 | A | | 1/1978 | Codorniu | |

(Continued)

FOREIGN PATENT DOCUMENTS

| | | | |
|---|---|---|---|
| CA | 841938 | A | 5/1970 |
| CA | 1002359 | A1 | 12/1976 |

(Continued)

OTHER PUBLICATIONS

JPO Machine Translation of JP 2006-161180 A, published on Jun. 22, 2006.*

International Search Report for PCT/US03/31418 Mailed Nov. 10, 2004.

Extended European Patent Report for EP 1879736 Mailed Jun. 4, 2010.

International Search Report and Written Opinion of the International Searching Authority for PCT/US2006/010132 mailed Mar. 20, 2008.

International Search Report and Written Opinion of the International Searching Authority for PCT/US2006/013973 mailed Aug. 31, 2007.

International Search Report and Written Opinion of the International Searching Authority for PCT/US2005/013272 mailed Sep. 23, 2005.

International Search Report and Written Opinion of the International Searching Authority for PCT/US05/23194 mailed Jun. 27, 2006.

International Search Report and Written Opinion of the International Searching Authority for PCT/US2005/021437 mailed Oct. 28, 2005.

(Continued)

*Primary Examiner* — Jose A Fortuna

(74) *Attorney, Agent, or Firm* — William W. Letson

(57) ABSTRACT

A base sheet for food wrap products. The base sheet can include a pulp-derived papermaking fiber and a fibrillated regenerated cellulose microfiber having a CSF value of less than about 175 mL.

15 Claims, 20 Drawing Sheets

U.S. PATENT DOCUMENTS

| | | | | |
|---|---|---|---|---|
| 4,094,718 | A | | 6/1978 | Czerwin |
| 4,100,324 | A | | 7/1978 | Anderson et al. |
| 4,102,737 | A | | 7/1978 | Morton |
| 4,112,982 | A | | 9/1978 | Bugge et al. |
| 4,117,199 | A | | 9/1978 | Gotoh et al. |
| 4,125,659 | A | | 11/1978 | Klowak et al. |
| 4,144,122 | A | | 3/1979 | Emanuelsson et al. |
| 4,145,532 | A | | 3/1979 | Franks et al. |
| 4,149,571 | A | | 4/1979 | Burroughs |
| 4,157,276 | A | | 6/1979 | Wandel et al. |
| 4,161,195 | A | | 7/1979 | Khan |
| 4,182,381 | A | | 1/1980 | Gisbourne |
| 4,184,519 | A | | 1/1980 | McDonald et al. |
| 4,191,609 | A | | 3/1980 | Trokhan |
| 4,196,282 | A | | 4/1980 | Franks et al. |
| 4,208,459 | A | | 6/1980 | Becker et al. |
| 4,225,382 | A | | 9/1980 | Kearney et al. |
| 4,239,065 | A | | 12/1980 | Trokhan |
| 4,246,221 | A | | 1/1981 | McCorsley, III |
| 4,267,047 | A | | 5/1981 | Henne et al. |
| 4,304,625 | A | | 12/1981 | Grube et al. |
| 4,307,143 | A | | 12/1981 | Meitner |
| 4,314,589 | A | | 2/1982 | Buchanan et al. |
| 4,349,610 | A | | 9/1982 | Parker |
| 4,355,021 | A | | 10/1982 | Mahl et al. |
| 4,356,059 | A | | 10/1982 | Hostetler |
| 4,359,069 | A | | 11/1982 | Hahn |
| 4,374,702 | A | | 2/1983 | Turbak et al. |
| 4,376,455 | A | | 3/1983 | Hahn |
| 4,379,735 | A | | 4/1983 | MacBean |
| 4,420,372 | A | | 12/1983 | Hostetler |
| 4,426,228 | A | | 1/1984 | Brandner et al. |
| 4,426,417 | A | | 1/1984 | Meitner et al. |
| 4,431,479 | A | | 2/1984 | Barbe et al. |
| 4,436,780 | A | | 3/1984 | Hotchkiss et al. |
| 4,440,597 | A | | 4/1984 | Wells et al. |
| 4,440,898 | A | | 4/1984 | Pomplun et al. |
| 4,441,962 | A | | 4/1984 | Osborn, III |
| 4,443,299 | A | | 4/1984 | Cheshire et al. |
| 4,445,638 | A | | 5/1984 | Connell et al. |
| 4,447,294 | A | | 5/1984 | Osborn, III |
| 4,448,638 | A | | 5/1984 | Klowak |
| 4,453,573 | A | | 6/1984 | Thompson |
| 4,462,868 | A | | 7/1984 | Oubridge et al. |
| 4,468,254 | A | | 8/1984 | Yokoyama et al. |
| 4,481,076 | A | * | 11/1984 | Herrick ..... 162/158 |
| 4,481,077 | A | * | 11/1984 | Herrick ..... 162/158 |
| 4,482,429 | A | | 11/1984 | Klowak |
| 4,483,743 | A | | 11/1984 | Turbak et al. |
| 4,490,925 | A | | 1/1985 | Smith |
| 4,501,640 | A | | 2/1985 | Soerens |
| 4,507,173 | A | | 3/1985 | Klowak et al. |
| 4,514,345 | A | | 4/1985 | Johnson et al. |
| 4,528,316 | A | | 7/1985 | Soerens |
| 4,528,339 | A | | 7/1985 | Coleman, III et al. |
| 4,529,480 | A | | 7/1985 | Trokhan |
| 4,533,437 | A | | 8/1985 | Curran et al. |
| 4,543,156 | A | | 9/1985 | Cheshire et al. |
| 4,551,199 | A | | 11/1985 | Weldon |
| 4,552,709 | A | | 11/1985 | Koger, II et al. |
| 4,556,450 | A | | 12/1985 | Chuang et al. |
| 4,564,052 | A | | 1/1986 | Borel |
| 4,592,395 | A | | 6/1986 | Borel |
| 4,601,938 | A | | 7/1986 | Deacon et al. |
| 4,603,176 | A | | 7/1986 | Bjorkquist et al. |
| 4,605,585 | A | | 8/1986 | Johansson |
| 4,605,702 | A | | 8/1986 | Guerro et al. |
| 4,610,743 | A | | 9/1986 | Salmeen et al. |
| 4,611,639 | A | | 9/1986 | Bugge |
| 4,614,679 | A | | 9/1986 | Farrington, Jr. et al. |
| 4,637,859 | A | | 1/1987 | Trokan |
| 4,640,741 | A | | 2/1987 | Tsuneo |
| 4,675,394 | A | | 6/1987 | Solarek et al. |
| 4,684,439 | A | | 8/1987 | Soerens |
| 4,689,119 | A | | 8/1987 | Weldon |
| 4,709,732 | A | | 12/1987 | Kinnunen |
| 4,720,383 | A | | 1/1988 | Drach et al. |
| 4,735,849 | A | | 4/1988 | Murakami et al. |
| 4,759,391 | A | | 7/1988 | Waldvogel et al. |
| 4,759,976 | A | | 7/1988 | Dutt |
| 4,764,253 | A | | 8/1988 | Cheshire et al. |
| 4,786,367 | A | | 11/1988 | Bogart et al. |
| 4,788,243 | A | | 11/1988 | Soerens |
| 4,789,564 | A | | 12/1988 | Kanner et al. |
| 4,795,530 | A | | 1/1989 | Soerens et al. |
| 4,802,942 | A | | 2/1989 | Takemura et al. |
| 4,803,032 | A | | 2/1989 | Schulz |
| 4,804,769 | A | | 2/1989 | Solarek et al. |
| 4,816,320 | A | | 3/1989 | St. Cyr |
| 4,834,838 | A | | 5/1989 | Klowak |
| 4,849,054 | A | | 7/1989 | Klowak |
| 4,866,151 | A | | 9/1989 | Tsai et al. |
| 4,883,564 | A | | 11/1989 | Chen et al. |
| 4,886,579 | A | | 12/1989 | Clark et al. |
| 4,906,513 | A | | 3/1990 | Kebbell et al. |
| 4,908,097 | A | | 3/1990 | Box |
| 4,931,201 | A | | 6/1990 | Julemont |
| 4,940,513 | A | | 7/1990 | Spendel |
| 4,942,077 | A | | 7/1990 | Wendt et al. |
| 4,950,545 | A | | 8/1990 | Walter et al. |
| 4,967,085 | A | | 10/1990 | Bryan et al. |
| 4,973,512 | A | | 11/1990 | Stanley et al. |
| 4,981,557 | A | | 1/1991 | Bjorkquist |
| 4,983,748 | A | | 1/1991 | Tsai et al. |
| 4,987,632 | A | | 1/1991 | Rowe et al. |
| 4,992,140 | A | | 2/1991 | Anderson et al. |
| 4,998,568 | A | | 3/1991 | Vohringer |
| 5,008,344 | A | | 4/1991 | Bjorkquist |
| 5,016,678 | A | | 5/1991 | Borel et al. |
| 5,023,132 | A | | 6/1991 | Stanley et al. |
| 5,025,046 | A | | 6/1991 | Soerens |
| 5,039,431 | A | | 8/1991 | Johnson et al. |
| 5,045,589 | A | | 9/1991 | Ueno |
| 5,054,525 | A | | 10/1991 | Vohringer |
| 5,066,532 | A | | 11/1991 | Gaisser |
| 5,085,736 | A | | 2/1992 | Bjorkquist |
| 5,087,324 | A | | 2/1992 | Awofeso et al. |
| 5,098,519 | A | | 3/1992 | Ramasubramanian et al. |
| 5,101,574 | A | | 4/1992 | Orlofiet et al. |
| 5,103,874 | A | | 4/1992 | Lee |
| 5,114,777 | A | | 5/1992 | Gaisser |
| 5,124,197 | A | | 6/1992 | Bernardin et al. |
| 5,129,988 | A | | 7/1992 | Farrington, Jr. et al. |
| 5,137,600 | A | | 8/1992 | Barnes et al. |
| 5,138,002 | A | | 8/1992 | Bjorkquist |
| 5,164,045 | A | | 11/1992 | Awofeso et al. |
| 5,167,261 | A | | 12/1992 | Lee |
| 5,182,164 | A | | 1/1993 | Eklund et al. |
| 5,199,467 | A | | 4/1993 | Lee |
| 5,200,035 | A | | 4/1993 | Bhat et al. |
| 5,211,815 | A | | 5/1993 | Ramasubramanian et al. |
| 5,215,617 | A | | 6/1993 | Grupe |
| 5,217,576 | A | | 6/1993 | Van Phan |
| 5,219,004 | A | | 6/1993 | Chiu |
| 5,223,092 | A | | 6/1993 | Grinnell et al. |
| 5,223,096 | A | | 6/1993 | Phan et al. |
| 5,225,269 | A | | 7/1993 | Bohlin |
| 5,227,242 | A | | 7/1993 | Walter et al. |
| 5,232,555 | A | | 8/1993 | Daunais et al. |
| 5,234,547 | A | | 8/1993 | Knight et al. |
| 5,240,562 | A | | 8/1993 | Phan et al. |
| 5,245,025 | A | | 9/1993 | Trokhan et al. |
| 5,246,544 | A | | 9/1993 | Hollenberg et al. |
| 5,252,754 | A | | 10/1993 | Bottorff |
| 5,260,171 | A | | 11/1993 | Smurkoski et al. |
| 5,262,007 | A | | 11/1993 | Phan et al. |
| 5,264,082 | A | | 11/1993 | Phan et al. |
| 5,269,470 | A | | 12/1993 | Ishikawa et al. |
| 5,275,799 | A | | 1/1994 | Keijsper et al. |
| 5,277,761 | A | | 1/1994 | Van Phan et al. |
| 5,279,767 | A | | 1/1994 | Phan et al. |
| 5,281,307 | A | | 1/1994 | Smigo et al. |
| 5,312,522 | A | | 5/1994 | Van Phan et al. |
| 5,314,584 | A | | 5/1994 | Grinnell et al. |
| 5,314,585 | A | | 5/1994 | Ward |
| 5,320,710 | A | | 6/1994 | Reeves et al. |
| 5,326,434 | A | | 7/1994 | Carevic et al. |

5,328,565 A 7/1994 Rasch et al.
5,334,289 A 8/1994 Trokhan et al.
5,336,373 A 8/1994 Scattolino et al.
5,338,807 A 8/1994 Espy et al.
5,348,620 A 9/1994 Hermans et al.
5,364,504 A 11/1994 Smurkoski et al.
5,366,785 A 11/1994 Sawdai
5,368,694 A 11/1994 Rohlfiet et al.
5,368,696 A 11/1994 Cunnane, III et al.
5,372,876 A 12/1994 Johnson et al.
5,373,087 A 12/1994 Weaver, Jr. et al.
5,374,334 A 12/1994 Sommese et al.
5,377,428 A 1/1995 Clark
5,379,808 A 1/1995 Chiu
5,382,323 A 1/1995 Furman et al.
5,384,012 A 1/1995 Hazard, Jr.
5,385,640 A 1/1995 Weibel et al.
5,397,435 A 3/1995 Ostendorf et al.
5,399,366 A 3/1995 Geddes et al.
5,411,636 A 5/1995 Hermans et al.
5,415,737 A 5/1995 Phan et al.
5,429,686 A 7/1995 Chiu et al.
5,431,840 A 7/1995 Soldanski et al.
5,437,766 A 8/1995 Van Phan et al.
5,449,026 A 9/1995 Lee
5,449,551 A 9/1995 Taniguchi
5,451,353 A 9/1995 Rezai et al.
5,456,293 A 10/1995 Ostermayer et al.
5,468,796 A 11/1995 Chen et al.
5,492,598 A 2/1996 Hermans et al.
5,494,554 A 2/1996 Edwards et al.
5,495,678 A 3/1996 Ilmarienen et al.
5,501,768 A 3/1996 Hermans et al.
5,503,715 A 4/1996 Trokhan et al.
5,505,768 A 4/1996 Altadonna
5,505,818 A 4/1996 Hermans et al.
5,508,818 A 4/1996 Hamma
5,510,001 A 4/1996 Hermans et al.
5,510,002 A 4/1996 Hermans et al.
5,512,139 A 4/1996 Worcester
5,549,790 A 8/1996 Van Phan
5,552,187 A 9/1996 Green et al.
5,556,509 A 9/1996 Trokhan et al.
5,560,945 A 10/1996 Geddes et al.
5,562,739 A 10/1996 Urben
5,573,637 A 11/1996 Ampulski et al.
5,585,129 A 12/1996 Geddes et al.
5,587,202 A 12/1996 Sandvick et al.
5,593,545 A 1/1997 Rugowski et al.
5,601,871 A 2/1997 Krzysik et al.
5,607,551 A 3/1997 Farrington, Jr. et al.
5,609,725 A 3/1997 Van Phan
5,609,901 A 3/1997 Geddes et al.
5,614,293 A 3/1997 Krzysik et al.
5,618,612 A 4/1997 Gstrein
5,650,218 A 7/1997 Krzysik et al.
H0001672 H 8/1997 Hermans et al.
5,656,132 A 8/1997 Farrington et al.
5,657,797 A 8/1997 Townley et al.
5,658,639 A 8/1997 Curro et al.
5,660,687 A 8/1997 Allen et al.
5,665,426 A 9/1997 Krzysik et al.
5,667,636 A 9/1997 Engel et al.
5,672,248 A 9/1997 Wendt et al.
5,674,590 A 10/1997 Anderson et al.
5,685,954 A 11/1997 Marinack et al.
5,688,468 A 11/1997 Lu
5,690,149 A 11/1997 Lee
5,690,788 A 11/1997 Marinack et al.
5,690,790 A 11/1997 Headlam et al.
5,695,487 A 12/1997 Cohen et al.
5,695,607 A 12/1997 Oriaran et al.
5,700,516 A 12/1997 Sandvick et al.
5,702,571 A 12/1997 Kamps et al.
5,709,775 A 1/1998 Trokhan et al.
5,714,041 A 2/1998 Ayers et al.
5,716,692 A 2/1998 Warner et al.
5,725,734 A 3/1998 Hermans et al.
5,725,821 A 3/1998 Gannon et al.
5,730,839 A 3/1998 Wendt et al.
5,738,760 A 4/1998 Svanqvist et al.
5,746,887 A 5/1998 Wendt et al.
5,753,079 A 5/1998 Jenny et al.
5,759,210 A 6/1998 Potter et al.
5,759,926 A 6/1998 Pike et al.
5,769,947 A 6/1998 Krappweis
5,772,845 A 6/1998 Farrington, Jr. et al.
5,785,813 A 7/1998 Smith et al.
5,792,404 A 8/1998 Cree et al.
5,810,972 A 9/1998 Reinheimer et al.
5,814,190 A 9/1998 Van Phan
5,830,321 A 11/1998 Lindsay et al.
5,833,806 A 11/1998 Allen et al.
5,840,403 A 11/1998 Trokhan et al.
5,840,404 A 11/1998 Graff
5,843,279 A 12/1998 Phan et al.
5,846,380 A 12/1998 Van Phan et al.
5,849,000 A 12/1998 Anjur et al.
5,851,352 A 12/1998 Vinson et al.
5,851,353 A 12/1998 Fiscus et al.
5,853,539 A 12/1998 Smith et al.
5,855,697 A 1/1999 Luo et al.
5,858,021 A 1/1999 Sun et al.
5,858,173 A 1/1999 Propst, Jr.
5,863,652 A 1/1999 Matsumura et al.
5,865,950 A 2/1999 Vinson et al.
5,865,955 A 2/1999 Ilvespaa et al.
5,871,763 A 2/1999 Luu et al.
5,882,573 A 3/1999 Kwok et al.
5,885,417 A 3/1999 Marinack et al.
5,885,418 A 3/1999 Anderson et al.
5,885,697 A 3/1999 Krzyzik et al.
5,888,347 A 3/1999 Engel et al.
5,891,309 A 4/1999 Page et al.
5,895,380 A 4/1999 Turi et al.
5,895,710 A 4/1999 Sasse et al.
5,902,540 A 5/1999 Kwok
5,904,298 A 5/1999 Kwok
5,908,533 A 6/1999 Marinack et al.
5,932,068 A 8/1999 Farrington, Jr. et al.
5,932,316 A 8/1999 Cree et al.
5,935,381 A 8/1999 Trokhan et al.
5,935,383 A 8/1999 Sun et al.
5,935,681 A 8/1999 Paulett
5,935,880 A 8/1999 Wang et al.
5,942,085 A 8/1999 Neal et al.
5,944,954 A 8/1999 Vinson et al.
5,961,782 A 10/1999 Luu et al.
5,964,983 A * 10/1999 Dinand et al. ..... 162/27
5,968,590 A 10/1999 Ahonen et al.
5,972,094 A 10/1999 Bates et al.
5,990,377 A 11/1999 Chen et al.
6,001,218 A 12/1999 Hsu et al.
6,001,421 A 12/1999 Ahonen et al.
6,015,935 A 1/2000 LaVon et al.
6,017,417 A 1/2000 Wendt et al.
6,025,049 A 2/2000 Ouellette et al.
6,027,611 A 2/2000 McFarland et al.
6,033,523 A 3/2000 Dwiggins et al.
6,033,736 A 3/2000 Perlman et al.
6,036,820 A 3/2000 Schiel et al.
6,042,769 A 3/2000 Gannon et al.
6,046,378 A 4/2000 Quincy, III et al.
6,051,335 A 4/2000 Dinh-Sybeldon et al.
6,054,020 A 4/2000 Goulet et al.
6,059,928 A 5/2000 Van Luu et al.
6,063,717 A 5/2000 Ishiyama et al.
6,066,234 A 5/2000 Parker et al.
6,066,379 A 5/2000 Ma et al.
6,074,525 A 6/2000 Richards
6,074,527 A 6/2000 Hsu et al.
6,080,279 A 6/2000 Hada et al.
6,083,346 A 7/2000 Hermans et al.
6,093,284 A 7/2000 Hada et al.
6,096,169 A 8/2000 Hermans et al.
6,107,539 A 8/2000 Palumbo et al.
6,117,525 A 9/2000 Trokhan et al.
6,117,545 A 9/2000 Cavaille et al.

6,119,362 A 9/2000 Sundqvist
6,133,405 A 10/2000 Allen
6,136,146 A 10/2000 Phan et al.
6,139,686 A 10/2000 Trokhan et al.
6,143,135 A 11/2000 Hada et al.
6,146,494 A 11/2000 Seger et al.
6,146,499 A 11/2000 Lin et al.
6,149,767 A 11/2000 Hermans et al.
6,149,769 A 11/2000 Mohammadi et al.
6,153,136 A 11/2000 Collier et al.
6,156,157 A 12/2000 Schroeder et al.
6,161,303 A 12/2000 Beck
6,162,327 A 12/2000 Batra et al.
6,171,442 B1 1/2001 Farrington, Jr. et al.
6,180,052 B1 1/2001 Ouellette et al.
6,183,596 B1 2/2001 Matsuda et al.
6,187,137 B1 2/2001 Druecke et al.
6,187,139 B1 2/2001 Edwards et al.
6,187,695 B1 2/2001 Krzysik et al.
6,190,506 B1 2/2001 Beck
6,197,154 B1 3/2001 Chen et al.
6,200,419 B1 3/2001 Phan
6,207,011 B1 3/2001 Luu et al.
6,210,528 B1 4/2001 Wolkowicz
6,214,163 B1 4/2001 Matsuda et al.
6,221,487 B1 4/2001 Luo et al.
6,228,220 B1 5/2001 Hada et al.
6,231,948 B1 5/2001 Ouellette et al.
6,232,521 B1 5/2001 Bewick-Sonntag et al.
6,235,392 B1 5/2001 Luo et al.
6,245,197 B1 6/2001 Oriaran et al.
6,248,203 B1 6/2001 Beck
6,248,210 B1 6/2001 Edwards et al.
6,258,210 B1 * 7/2001 Takeuchi et al. ..... 162/115
6,258,304 B1 7/2001 Bahia
6,261,580 B1 7/2001 Lehrter et al.
6,261,679 B1 7/2001 Chen et al.
6,267,842 B1 7/2001 Ona et al.
6,273,995 B1 8/2001 Ikeda et al.
6,273,996 B1 8/2001 Hollenberg et al.
6,274,042 B1 8/2001 Beck
6,277,242 B1 8/2001 Archer et al.
6,280,573 B1 8/2001 Lindsay et al.
6,287,419 B1 * 9/2001 Takeuchi et al. ..... 162/115
6,287,426 B1 9/2001 Edwards et al.
6,287,427 B1 9/2001 Beck
6,287,581 B1 9/2001 Krzysik et al.
6,306,257 B1 10/2001 Hada et al.
6,306,258 B1 10/2001 Lange et al.
6,315,864 B2 11/2001 Anderson et al.
6,318,727 B1 11/2001 Hada
6,321,963 B1 11/2001 Gracyalny et al.
6,331,230 B1 12/2001 Hermans et al.
6,332,952 B1 12/2001 Hsu et al.
6,336,995 B1 1/2002 Campbell
6,344,109 B1 2/2002 Gross
6,350,349 B1 2/2002 Hermans et al.
6,379,496 B2 4/2002 Edwards et al.
6,381,868 B1 5/2002 Grabscheid et al.
6,383,960 B1 5/2002 Everett et al.
6,403,858 B1 6/2002 Quincy, III et al.
6,412,678 B2 7/2002 Gracyalny et al.
6,416,628 B1 7/2002 Huang et al.
6,416,631 B1 7/2002 Beck
6,419,793 B1 7/2002 Beck
6,420,013 B1 7/2002 Vinson et al.
6,432,267 B1 8/2002 Watson
6,432,270 B1 8/2002 Liu et al.
6,436,234 B1 8/2002 Chen et al.
6,440,267 B1 8/2002 Rekoske et al.
6,447,640 B1 9/2002 Watson et al.
6,447,641 B1 9/2002 Wolkowicz et al.
6,454,904 B1 9/2002 Hermans et al.
6,461,474 B1 10/2002 Lindsay et al.
6,461,476 B1 10/2002 Goulet et al.
6,464,829 B1 10/2002 Chen et al.
6,468,392 B2 10/2002 Oriarian et al.
6,471,727 B2 10/2002 Luo et al.
6,478,927 B1 11/2002 Chen et al.
6,491,788 B2 12/2002 Sealey et al.
6,497,789 B1 12/2002 Hermans et al.
6,511,746 B1 1/2003 Collier et al.
6,517,672 B2 2/2003 Edwards et al.
6,533,898 B2 3/2003 Gross
6,534,151 B2 3/2003 Merker
6,540,879 B2 4/2003 Marinack et al.
6,544,912 B1 * 4/2003 Tanio et al. ..... 442/408
6,547,924 B2 4/2003 Klerelid et al.
6,550,115 B1 4/2003 Skoog et al.
6,551,461 B2 4/2003 Hermans et al.
6,558,511 B2 5/2003 Dwiggins et al.
6,562,198 B2 5/2003 Beck et al.
6,565,707 B2 5/2003 Behnke et al.
6,573,204 B1 6/2003 Philipp et al.
6,579,416 B1 6/2003 Vinson et al.
6,579,418 B2 6/2003 Lindsay et al.
6,582,560 B2 6/2003 Runge et al.
6,585,855 B2 7/2003 Drew et al.
6,589,394 B2 7/2003 Beck
6,592,067 B2 7/2003 Denen et al.
6,596,033 B1 7/2003 Luo et al.
6,602,386 B1 8/2003 Takeuchi et al.
6,602,387 B1 8/2003 Loughran et al.
6,607,638 B2 8/2003 Drew et al.
6,610,619 B2 8/2003 Friedbauer et al.
6,616,812 B2 9/2003 Beck
6,624,100 B1 9/2003 Pike
6,627,041 B2 9/2003 Lee
6,635,146 B2 10/2003 Lonsky et al.
6,645,420 B1 11/2003 Beck
6,645,618 B2 11/2003 Hobbs et al.
6,649,024 B2 11/2003 Gracyalny et al.
6,660,129 B1 12/2003 Cabell et al.
6,669,821 B2 12/2003 Edwards et al.
6,673,205 B2 1/2004 Kokko
6,673,210 B2 1/2004 Beck
6,692,008 B2 2/2004 Beck
6,692,827 B2 2/2004 Luo et al.
6,698,681 B1 3/2004 Guy et al.
6,701,637 B2 3/2004 Lindsay et al.
6,702,924 B2 3/2004 Beck
6,706,237 B2 3/2004 Luo et al.
6,706,876 B2 3/2004 Luo et al.
6,709,548 B2 3/2004 Marinack et al.
6,723,204 B2 4/2004 Van Handel
6,746,558 B2 6/2004 Hoeft et al.
6,749,718 B2 6/2004 Takai et al.
6,749,723 B2 6/2004 Linden
6,752,907 B2 6/2004 Edwards et al.
6,758,943 B2 7/2004 McConnell et al.
6,766,977 B2 7/2004 Denen et al.
6,767,634 B2 7/2004 Krishnaswamy
6,773,648 B2 8/2004 Luo et al.
6,777,064 B1 8/2004 Brown et al.
6,793,170 B2 9/2004 Denen et al.
6,797,115 B2 9/2004 Klerelid et al.
6,808,557 B2 10/2004 Holbrey et al.
6,808,790 B2 10/2004 Chen et al.
6,818,101 B2 11/2004 Vinson et al.
6,821,386 B2 11/2004 Wersman et al.
6,824,599 B2 11/2004 Swatloski et al.
6,824,648 B2 11/2004 Edwards et al.
6,827,819 B2 12/2004 Dwiggins et al.
6,833,187 B2 12/2004 Luo et al.
6,835,311 B2 12/2004 Koslow
6,838,887 B2 1/2005 Denen et al.
6,841,038 B2 1/2005 Horenziak et al.
6,849,329 B2 2/2005 Perez et al.
6,855,227 B2 2/2005 Beck
6,855,229 B2 2/2005 McKay et al.
6,860,967 B2 3/2005 Baumoller et al.
6,861,023 B2 3/2005 Sealey et al.
6,871,815 B2 3/2005 Moody et al.
6,872,311 B2 3/2005 Koslow
6,890,649 B2 5/2005 Hobbs et al.
6,893,693 B2 5/2005 Swoboda et al.
6,899,790 B2 5/2005 Lee
6,936,136 B2 8/2005 Shannon et al.

| | | | | |
|---|---|---|---|---|
| 6,964,117 | B2 | 11/2005 | Parent | |
| 6,969,443 | B1 | 11/2005 | Kokko | |
| 6,984,290 | B2 | 1/2006 | Runge et al. | |
| 6,986,932 | B2 | 1/2006 | Zinc et al. | |
| 6,991,707 | B2 | 1/2006 | Hill et al. | |
| 6,998,022 | B2 | 2/2006 | Hultcrantz | |
| 7,037,405 | B2 | 5/2006 | Nguyen et al. | |
| 7,037,406 | B2 | 5/2006 | Kershaw et al. | |
| 7,041,197 | B2 | 5/2006 | Kokko et al. | |
| 7,048,826 | B2 | 5/2006 | Archer et al. | |
| 7,056,386 | B2 | 6/2006 | Pahl | |
| 7,070,678 | B2 | 7/2006 | Allen et al. | |
| 7,083,704 | B2 | 8/2006 | Sealey, II et al. | |
| 7,094,317 | B2 | 8/2006 | Lundberg et al. | |
| 7,097,737 | B2 | 8/2006 | Luo et al. | |
| 7,122,235 | B2 | 10/2006 | Bourdelais et al. | |
| 7,160,418 | B2 | 1/2007 | Edwards et al. | |
| 7,189,308 | B2 * | 3/2007 | Feit et al. | 162/180 |
| 7,195,694 | B2 | 3/2007 | Von Drach et al. | |
| 7,222,335 | B2 | 5/2007 | Qureshi et al. | |
| 7,229,528 | B2 | 6/2007 | Vinson et al. | |
| 7,241,711 | B2 | 7/2007 | Takai et al. | |
| 7,250,382 | B2 | 7/2007 | Takai et al. | |
| 7,258,764 | B2 | 8/2007 | Mauler | |
| 7,276,166 | B2 | 10/2007 | Koslow | |
| 7,296,691 | B2 | 11/2007 | Koslow | |
| 7,300,543 | B2 | 11/2007 | Mullally et al. | |
| 7,300,547 | B2 | 11/2007 | Luu et al. | |
| 7,311,853 | B2 | 12/2007 | Vinson et al. | |
| 7,381,294 | B2 * | 6/2008 | Suzuki et al. | 162/9 |
| 7,399,378 | B2 | 7/2008 | Edwards et al. | |
| 7,404,875 | B2 | 7/2008 | Clungeon et al. | |
| 7,416,637 | B2 | 8/2008 | Murray et al. | |
| 7,435,312 | B2 | 10/2008 | Lindsay et al. | |
| 7,442,278 | B2 | 10/2008 | Murray et al. | |
| 7,494,563 | B2 | 2/2009 | Edwards et al. | |
| 7,503,998 | B2 | 3/2009 | Murray et al. | |
| 7,563,344 | B2 | 7/2009 | Beuther et al. | |
| 7,566,014 | B2 | 7/2009 | Koslow | |
| 7,585,388 | B2 | 9/2009 | Yeh et al. | |
| 7,585,389 | B2 | 9/2009 | Yeh et al. | |
| 7,585,392 | B2 | 9/2009 | Kokko et al. | |
| 7,588,660 | B2 | 9/2009 | Edwards et al. | |
| 7,588,661 | B2 | 9/2009 | Edwards et al. | |
| 7,588,831 | B2 * | 9/2009 | Akiyama et al. | 428/532 |
| 7,591,925 | B2 | 9/2009 | Scherb et al. | |
| 7,601,375 | B2 * | 10/2009 | Langton et al. | 426/124 |
| 7,605,096 | B2 | 10/2009 | Tomarchio et al. | |
| 7,608,164 | B2 | 10/2009 | Chou et al. | |
| 7,608,960 | B2 | 10/2009 | Yang et al. | |
| 7,622,020 | B2 | 11/2009 | Awofeso et al. | |
| 7,651,589 | B2 | 1/2010 | Murray et al. | |
| 7,655,112 | B2 | 2/2010 | Koslow | |
| 7,662,255 | B2 | 2/2010 | Murray et al. | |
| 7,662,257 | B2 | 2/2010 | Edwards et al. | |
| 7,670,457 | B2 | 3/2010 | Murray et al. | |
| 7,691,228 | B2 | 4/2010 | Edwards et al. | |
| 7,691,760 | B2 | 4/2010 | Bergsten et al. | |
| 7,700,764 | B2 | 4/2010 | Heijnesson-Hulten | |
| 7,704,349 | B2 | 4/2010 | Edwards et al. | |
| 7,718,035 | B2 | 5/2010 | Boettcher et al. | |
| 7,718,036 | B2 | 5/2010 | Sumnicht et al. | |
| 7,726,349 | B2 | 6/2010 | Mullally et al. | |
| 7,737,200 | B2 * | 6/2010 | Jabar et al. | 524/18 |
| 2,954,868 | A1 | 7/2010 | Swedish, Jr. et al. | |
| 8,080,271 | B2 * | 12/2011 | Langton et al. | 426/420 |
| 2002/0096294 | A1 | 7/2002 | Nicholass et al. | |
| 2002/0162635 | A1 | 11/2002 | Hsu et al. | |
| 2002/0168912 | A1 | 11/2002 | Bond et al. | |
| 2002/0187307 | A1 | 12/2002 | Tanaka et al. | |
| 2003/0040574 | A1 | 2/2003 | Schertz et al. | |
| 2003/0111195 | A1 | 6/2003 | Hu | |
| 2003/0135181 | A1 | 7/2003 | Chen et al. | |
| 2003/0153443 | A1 | 8/2003 | Beck | |
| 2003/0178166 | A1 * | 9/2003 | Takeuchi et al. | 162/146 |
| 2003/0200991 | A1 | 10/2003 | Keck et al. | |
| 2003/0203695 | A1 | 10/2003 | Polanco et al. | |
| 2003/0219613 | A1 | 11/2003 | Boylan | |
| 2004/0045687 | A1 | 3/2004 | Shannon et al. | |
| 2004/0060675 | A1 | 4/2004 | Archer et al. | |
| 2004/0089168 | A1 | 5/2004 | Beck | |
| 2004/0091585 | A1 * | 5/2004 | Theisen et al. | 426/124 |
| 2004/0203306 | A1 | 10/2004 | Grafe et al. | |
| 2004/0207110 | A1 | 10/2004 | Luo et al. | |
| 2004/0211534 | A1 | 10/2004 | Clungeon et al. | |
| 2005/0006040 | A1 | 1/2005 | Boettcher et al. | |
| 2005/0074542 | A1 | 4/2005 | Lundberg et al. | |
| 2005/0103455 | A1 | 5/2005 | Edwards et al. | |
| 2005/0148264 | A1 | 7/2005 | Varona et al. | |
| 2005/0176326 | A1 | 8/2005 | Bond et al. | |
| 2005/0217814 | A1 | 10/2005 | Super et al. | |
| 2005/0274469 | A1 | 12/2005 | Lundberg et al. | |
| 2005/0288484 | A1 | 12/2005 | Holbrey et al. | |
| 2006/0019571 | A1 | 1/2006 | Lange et al. | |
| 2006/0090271 | A1 | 5/2006 | Price et al. | |
| 2006/0118993 | A1 | 6/2006 | Awofeso et al. | |
| 2006/0207722 | A1 | 9/2006 | Amano et al. | |
| 2006/0240727 | A1 | 10/2006 | Price et al. | |
| 2006/0240728 | A1 | 10/2006 | Price et al. | |
| 2006/0241287 | A1 | 10/2006 | Hecht et al. | |
| 2006/0263495 | A1 * | 11/2006 | Langton et al. | 426/132 |
| 2007/0062656 | A1 | 3/2007 | Murray et al. | |
| 2007/0131366 | A1 | 6/2007 | Underhill et al. | |
| 2007/0137807 | A1 | 6/2007 | Schulz et al. | |
| 2007/0137808 | A1 | 6/2007 | Lostocco et al. | |
| 2007/0160716 | A1 * | 7/2007 | Theisen et al. | 426/106 |
| 2007/0204966 | A1 | 9/2007 | Edwards et al. | |
| 2007/0224419 | A1 * | 9/2007 | Sumnicht et al. | 428/364 |
| 2007/0232180 | A1 | 10/2007 | Polat et al. | |
| 2007/0251656 | A1 | 11/2007 | Vinson et al. | |
| 2008/0008865 | A1 | 1/2008 | Luu et al. | |
| 2008/0044644 | A1 | 2/2008 | Luu et al. | |
| 2008/0057307 | A1 | 3/2008 | Koslow et al. | |
| 2008/0105394 | A1 | 5/2008 | Kokko | |
| 2008/0135193 | A1 | 6/2008 | Kokko | |
| 2008/0156450 | A1 | 7/2008 | Klerelid et al. | |
| 2008/0173418 | A1 | 7/2008 | Sumnicht | |
| 2008/0173419 | A1 | 7/2008 | Sumnicht | |
| 2009/0020139 | A1 | 1/2009 | Sumnicht et al. | |
| 2009/0020248 | A1 | 1/2009 | Sumnicht et al. | |
| 2009/0120598 | A1 | 5/2009 | Edwards et al. | |
| 2009/0126884 | A1 | 5/2009 | Murray et al. | |
| 2009/0159223 | A1 | 6/2009 | Edwards et al. | |
| 2009/0159224 | A1 | 6/2009 | Chou et al. | |
| 2009/0294079 | A1 | 12/2009 | Edwards et al. | |
| 2009/0301675 | A1 | 12/2009 | Edwards et al. | |
| 2009/0308551 | A1 | 12/2009 | Kokko et al. | |
| 2010/0006249 | A1 | 1/2010 | Kokko et al. | |
| 2010/0015301 | A1 * | 1/2010 | Langton et al. | 426/132 |
| 2010/0021751 | A1 * | 1/2010 | Harrison et al. | 428/486 |
| 2010/0059191 | A1 * | 3/2010 | Garcia Melgarejo et al. | 162/141 |
| 2010/0065235 | A1 * | 3/2010 | Fike et al. | 162/146 |
| 2010/0126682 | A1 | 5/2010 | Murray et al. | |
| 2010/0151174 | A1 * | 6/2010 | Graff et al. | 428/43 |
| 2010/0170647 | A1 | 7/2010 | Edwards et al. | |
| 2010/0212850 | A1 * | 8/2010 | Sumnicht et al. | 162/111 |
| 2010/0272938 | A1 * | 10/2010 | Mitchell et al. | 428/36.1 |
| 2010/0288456 | A1 * | 11/2010 | Westland et al. | 162/57 |
| 2011/0265965 | A1 * | 11/2011 | Sumnicht et al. | 162/111 |

FOREIGN PATENT DOCUMENTS

| | | | |
|---|---|---|---|
| CA | 2197485 | A1 | 9/1997 |
| CA | 2053505 | C | 4/1999 |
| CA | 2241820 | C | 7/2006 |
| CN | 1071470 | A1 | 4/1993 |
| DE | 4216264 | A1 | 11/1993 |
| EP | 0098683 | A2 | 1/1984 |
| EP | 279465 | A2 | 8/1988 |
| EP | 399522 | A2 | 11/1990 |
| EP | 0479554 | A2 | 4/1992 |
| EP | 484101 | A2 | 5/1992 |
| EP | 485360 | A2 | 5/1992 |
| EP | 525271 | A1 | 2/1993 |
| EP | 541232 | A2 | 5/1993 |
| EP | 0743172 | A1 | 11/1996 |
| EP | 1013825 | A1 | 6/2000 |
| EP | 1029977 | A1 | 8/2000 |
| EP | 1094155 | A2 | 4/2001 |

| | | | | |
|---|---|---|---|---|
| EP | 1103522 | A1 | | 5/2001 |
| EP | 1353010 | A1 | | 10/2003 |
| EP | 1398413 | A2 | | 3/2004 |
| EP | 1703019 | A1 | | 9/2006 |
| EP | 2004904 | A2 | | 12/2008 |
| EP | 2074259 | A2 | | 7/2009 |
| GB | 519618 | A | | 4/1940 |
| GB | 978953 | A1 | | 1/1965 |
| GB | 2319537 | A | | 5/1985 |
| GB | 2303647 | A | | 2/1997 |
| GB | 2412083 | A1 | | 9/2005 |
| JP | 08003890 | A1 | | 1/1996 |
| JP | 08209590 | A | * | 8/1996 |
| JP | 09040516 | A | * | 2/1997 |
| JP | 2004/270050 | A | | 9/2004 |
| JP | 2005/336640 | A | | 12/2005 |
| JP | 2006/028650 | A | | 2/2006 |
| JP | 2006161180 | A | * | 6/2006 |
| JP | 2007/138318 | A | | 6/2007 |
| RU | 2126327 | C1 | | 2/1999 |
| RU | 2141546 | C1 | | 11/1999 |
| RU | 2143508 | C | | 12/1999 |
| RU | 2153036 | C2 | | 7/2000 |
| RU | 2159304 | C2 | | 11/2000 |
| RU | 2182198 | C2 | | 5/2002 |
| RU | 2222656 | C1 | | 1/2004 |
| RU | 2226231 | C1 | | 3/2004 |
| SU | 1601274 | A1 | | 10/1990 |
| SU | 1708641 | A1 | | 1/1992 |
| SU | 1771983 | A1 | | 10/1992 |
| WO | 96/05372 | A1 | | 2/1996 |
| WO | 96/06223 | A1 | | 2/1996 |
| WO | 96/09435 | A1 | | 3/1996 |
| WO | 97/04171 | A1 | | 2/1997 |
| WO | 97/43484 | A1 | | 11/1997 |
| WO | 98/07914 | A1 | | 2/1998 |
| WO | 98/54063 | A1 | | 12/1998 |
| WO | 99/23298 | A1 | | 5/1999 |
| WO | 99/23305 | A1 | | 5/1999 |
| WO | 99/32720 | A1 | | 7/1999 |
| WO | 00/00698 | A1 | | 1/2000 |
| WO | 00/14330 | A1 | | 3/2000 |
| WO | 00/36212 | A2 | | 6/2000 |
| WO | 00/40405 | A1 | | 7/2000 |
| WO | 01/85109 | A1 | | 11/2001 |
| WO | 02/02869 | A2 | | 1/2002 |
| WO | 03/037394 | A2 | | 5/2003 |
| WO | 2004/033793 | A2 | | 4/2004 |
| WO | 2005/103375 | A1 | | 11/2005 |
| WO | 2005/106117 | A2 | | 11/2005 |
| WO | 2006/113025 | A2 | | 10/2006 |
| WO | 2006/115817 | A2 | | 11/2006 |
| WO | 2007/001837 | A2 | | 1/2007 |
| WO | 2007/109259 | A2 | | 9/2007 |
| WO | 2007/139726 | A1 | | 12/2007 |
| WO | 2008/002420 | A2 | | 1/2008 |
| WO | 2008/045770 | A2 | | 4/2008 |
| WO | 2009/038735 | A1 | | 3/2009 |
| WO | 2009038730 | A1 | | 3/2009 |
| WO | WO 2010033536 | A2 | * | 3/2010 |
| WO | WO 2010065367 | A1 | * | 6/2010 |

OTHER PUBLICATIONS

International Search Report and Written Opinion of the International Searching Authority for PCT/US2005/012320 mailed Aug. 10, 2005.
International Search Report and Written Opinion of the International Searching Authority for PCT/US06/23037 mailed Oct. 29, 2007.
International Search Report and Written Opinion of the International Searching Authority for PCT/US07/06892 mailed Jun. 4, 2008.
International Search Report and Written Opinion of the International Searching Authority for PCT/US08/10840 mailed Dec. 1, 2008.
International Search Report and Written Opinion of the International Searching Authority for PCT/US08/10833 mailed Dec. 12, 2008.
International Search Report and Written Opinion of the International Searching Authority for PCT/US07/62836 mailed Oct. 21, 2007.
International Search Report and Written Opinion of the International Searching Authority for PCT/US07/11967 Date of Completion of Report Oct. 22, 2008.
International Search Report and Written Opinion of the International Searching Authority for PCT/US2008/054350 mailed Jun. 23, 2008.
European Search Report for EP 03252318.5 mailed Aug. 27, 2003.
European Search Report for EP 08001506.8 mailed Oct. 3, 2008.
European Search Report for EP 00305891-4 mailed Jun. 22, 2005.
International Search Report and Written Opinion of the International Searching Authority for PCT/US2009/057078 mailed Jul. 2, 2010.
Sweet, John S., A Basic Study of Water Removal at the Press, Pulp and Paper Magazine of Canada, Jul. 1961, pp. T367-T371.
Heller, H. H., et al., Back to the Basics in Wet Pressing, Paper Technology and Industry, Jun. 1975, pp. 154-163.
Casey, James, Pulp and Paper: Chemistry and Chemical Technology, Jan. 1980, Third Edition, vol. II, pp. 1011-1012, John Wiley & Sons, New York.
Flavor Characterization to Fuel Cells, Encyclopedia of Chemical Technology, 4th Edition, vol. 11, p. 190, John Wiley & Sons, New York.
Fluid and Particles Dynamics, Perry's Chemical Engineers' Handbook, 7th Edition, pp. 6-38 and 6-39, McGraw-Hill, New York.
Anderson, David W., Ph.D., Absorption of Ionizing Radiation, 1984, p. 69, University Park Press, Baltimore, Maryland.
Goglia, M. J.; Air Permeability of Parachute Cloths, Textile Research Journal, Apr. 1955, pp. 296-313.
Espy, Herbert H.; Alkaline-Curing Polymeric Amine-Epichlorohydri Resins, Wet Strengths and Their Application, Chapter 2, 1994, pp. 13-44, L. Chan.
Evans, W. P.; Cationic Fabric Softeners, Chemistry and Industry, Jul. 5, 1969, pp. 893-903.
Egan, R. R.; Cationic Surface Active Agents as Fabric Softeners, Journal of the American Oil Chemists Society, Jan. 1979, vol. 55, pp. 118-121.
Chemistry of Paper Wet Strength. I. A Survey of Mechanisms of Wet-Strength Development, Cellulose Chemistry and Technology, 1979, vol. 13, pp. 813-825.
Das, D.; Convective Heat Transfer Under Turbulent Impinging Slot Jet a Large Temperature Differences, Drying '85, Proceedings of the International Drying Symposium, 1985, pp. 354-359. Hemisphere Publishing Company.
Parker, R. A.; Economic Considerations in Through Air Drying, Pap. News, 1990, vol. 6, No. 1, pp. 15-16, Valmet.
Green, L., et al; Fluid Flow Through Porous Metals, Journal of Applied Mechanics, Mar. 1951, pp. 39-45.
Stannett, V. T., Fundamentals of Barrier Properties, Department of Chemical Engineering, Undated, pp. 412-425. North Carolina State University, Raleigh, North Carolina.
Gooding, R. W.; Fractionation in a Bauer-McNett Classifier, Journal of Pulp and Paper Science, Dec. 2001, vol. 27, No. 12, pp. 423-428.
Kawka, W,; Intensification of Paper Web Dewatering and Drying; Przeglad Papier. Nov. 1979, vol. 45, No. 11, pp. 402-404.
Imperato, Giovanni, et al; Low-Melting Sugar-Urea-Salt Mixtures as Solvents for Diels-Alder Reactions, Chem, Commun., 2005, pp. 1170-1172.
Miller, Bernard, et al; Liquid Porosimetry: New Methodology and Application, Journal of Colloid and Interface Science, 1994, vol. 162 pp. 163-170, Academic Press.
Waterhouse, J. F.; On-Line Formation Measurements and Paper Quality, 1996 TAPPI Papermakers Conference, Mar. 24-27, 1996, Mar. 24-27, 1996, IPST Technical Paper Series No. 604, Institute of Paper Science and Technology.
Finch, C. A., Polyvinyl Alcohol-Developments, 1992, pp. 84-93, John Wiley & Sons, New York.
Trivedi, B. C., Quaternization of Imidazoline: Unequivocal Structure Proof, Journal of the American Chemists's Society, Jun. 1981, pp. 754-756.
Dymrose-Peterson, Smart Materials for Liquid Control, Nonwovens World, Oct.-Nov. 1999, pp. 95-99.
Softener, Debonder and Antistats for Tissues and Towels, 1994, pp. 1-4, Witco Corporation.
Kawka, W.; Some Problems of Blow-Through Drying of Porous Papers, Przeglad Papier, Aug. 1977, vol. 33, No. 8, pp. 299-305.
Browning, McKim; Through-Dryer Adds New Life to Old Yankee Machine at Cascade Paper, Pulp and Paper, Sep. 1978, pp. 78-79.

Glifberg, B. K. G.; et al.; Total Machine Concept and Considerations for Thru-Air-Dried Tissue Paper; EUCEPA 24th Conf. Proc., 1980, Stockholm, Sweden.
Definition of Oligomer, printed from http://en.wikipedia.org/wiki/Oligomer, Jan. 6, 2010.
Oliver, John G., Dry-Creping of Tissue Paper-A Review of Basic Factors, Tappi, vol. 63, No. 12, Dec. 1980.

* cited by examiner

FOOD WRAP BASE SHEET WITH REGENERATED CELLULOSE MICROFIBER

CROSS-REFERENCE TO RELATED APPLICATIONS

This application claims priority to U.S. Provisional Patent Application having Ser. No. 61/192,159, and filed on Sep. 16, 2008, the entirety of which is incorporated herein by reference.

BACKGROUND OF THE INVENTION

1. Field of the Invention

Embodiments of the present disclosure generally relate to paper-containing products and, in particular, to paper suitable for use as a base sheet. More particularly, embodiments of the present disclosure relate to base sheets adapted for use in the production of food wrap products.

2. Description of the Related Art

Paper for producing food-wrap products is well known in the art. Generally speaking, such products are manufactured similarly to tissue type products, except that they are not creped from a Yankee dryer. Instead, they are pulled from the dryer under tension, or may be can-dried on a flat paper machine. Such products include so-called dry-waxing sheets, wet waxing sheets, and sheets adapted for making oil and grease resistant ("OGR") papers. The base sheet is impregnated or coated with a water-resistant agent such as wax, polyethylene or fluorocarbons to provide water and grease resistance.

While materials for improving water and oil resistance have been improved over the years, numerous desirable attributes in the food-wrap base sheet are currently addressed by additives. Wet strength, for instance, is usually provided by conventional wet strength resins, while opacity is provided by conventional opacifiers such as titanium dioxide and the like. These additives are expensive and can aggravate processing difficulties when the paper is impregnated with a water-resistant agent and/or printed as is common, especially with wet-waxing papers. What is needed, therefore, is a food-wrap base sheet that reduces the required amount of additives, while maintaining the desired physical properties.

SUMMARY

Embodiments of the disclosure may provide an exemplary base sheet for food wrap products including a pulp-derived papermaking fiber and a fibrillated regenerated cellulose microfiber having a CSF value of less than about 175 mL. Embodiments of the disclosure may also provide an exemplary method for making a food wrap paper product. The exemplary method includes forming a base sheet including a pulp-derived papermaking fiber and a regenerated cellulose microfiber, and treating the base sheet with a water or grease resistant agent.

Such products can include so-called dry-waxing sheet, wet waxing sheet and sheet, particularly adapted for making oil and grease resistant ("OGR") papers.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
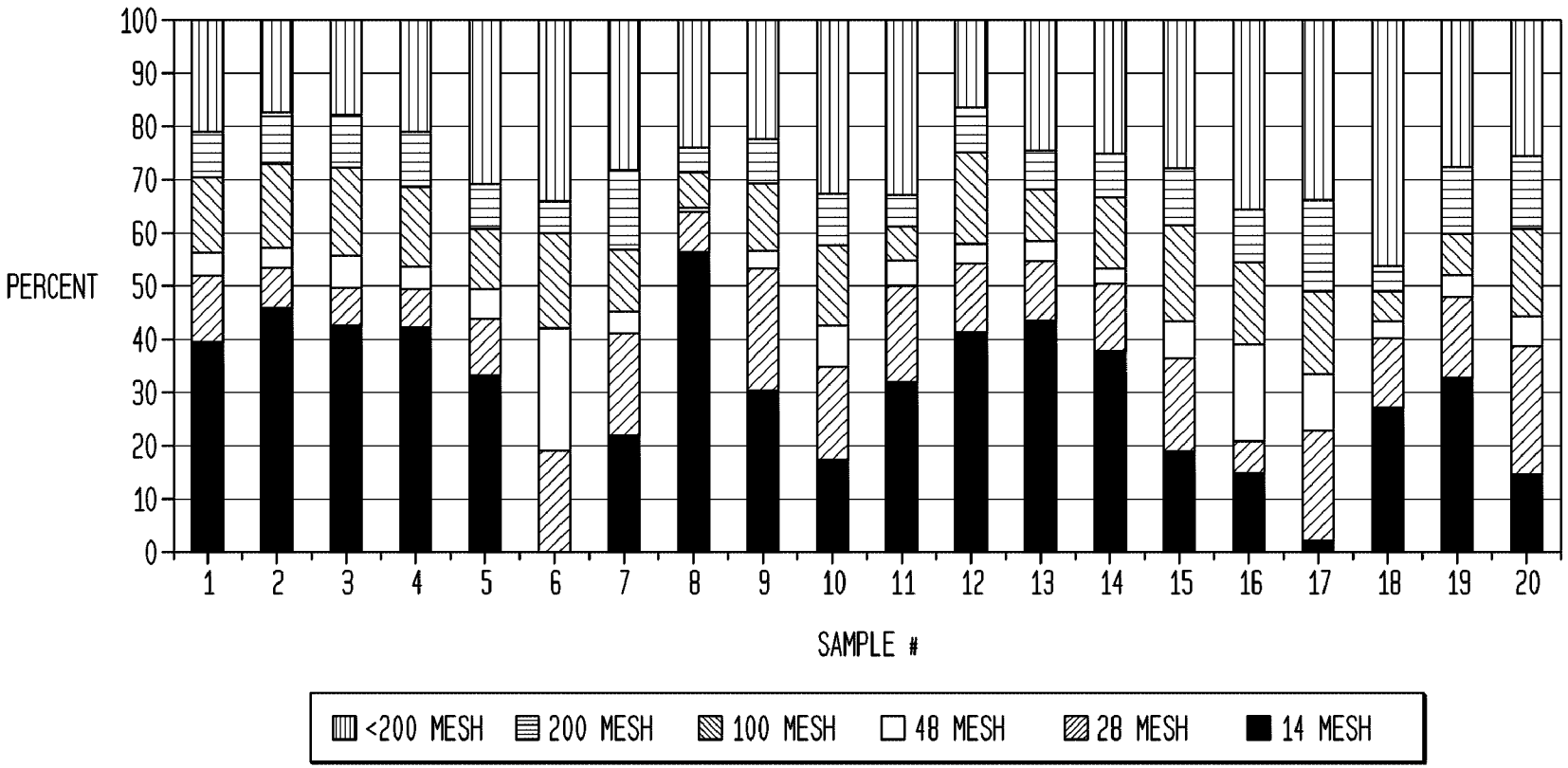
FIG. 1 illustrates a histogram showing fiber size or "fineness" of exemplary fibrillated lyocell fibers, according to one or more embodiments described.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this disclosure is combined with available information and technology.

Terminology used herein is given its ordinary meaning consistent with the exemplary definitions set forth immediately below; mils refers to thousandths of an inch; mg refers to milligrams and $m^2$ refers to square meters, percent means weight percent (dry basis), "ton" means short ton (2,000 pounds), and so forth. Unless otherwise specified, the version of a test method applied is that in effect as of Jan. 1, 2008, and test specimens are prepared under standard TAPPI conditions; that is, conditioned in an atmosphere of 23° C.±1.0° C. (73.4° F.±1.8° F.) at 50% relative humidity for at least about 2 hours.

Unless otherwise specified, "basis weight," "BWT," "bwt," and so forth, are used interchangeably and refer to the weight of a 3,000 square foot ($ft^2$) ream of product. Consistency refers to percent solids of a nascent web, for example, calculated on a bone dry basis. "Air dry" means including residual moisture, by convention up to about 10 percent moisture for pulp and up to about 6% for paper. A nascent web having 50% water and 50% bone-dry pulp has a consistency of 50%.

The terms "cellulosic," "cellulosic sheet," and the like, are meant to include any product incorporating papermaking fiber having cellulose as a major constituent. "Papermaking fibers" include virgin pulps, recycle (secondary) cellulosic fibers, or fiber mixes including cellulosic fibers. Fibers suitable for making the webs can include: nonwood fibers, such as cotton fibers or cotton derivatives, abaca, kenaf, sabai grass, flax, esparto grass, straw, jute hemp, bagasse, milkweed floss fibers, and pineapple leaf fibers; and wood fibers such as those obtained from deciduous and coniferous trees, including softwood fibers, such as northern and southern softwood Kraft fibers; hardwood fibers, such as eucalyptus, maple, birch, aspen, or the like.

Papermaking fibers can be naturally occurring pulp-derived fibers, as opposed to reconstituted fibers such as lyocell or rayon that are liberated from their source material by any one of a number of pulping processes familiar to one experienced in the art including sulfate, sulfite, polysulfide, soda pulping, etc. The pulp can be chemically bleached if desired. Suitable bleaching agents or chemical include, but are not limited to, chlorine, chlorine dioxide, oxygen, alkaline peroxide, and the like.

Naturally occurring pulp-derived fibers are referred to herein simply as "pulp-derived" papermaking fibers. "Furnishes" and like terminology refers to aqueous compositions including papermaking fibers, optionally wet strength resins, debonders, and the like, for making paper products. For purposes of calculating relative percentages of papermaking fibers, the fibrillated cellulose, e.g. lyocell, content is excluded as noted below.

Kraft softwood fiber is low yield fiber made by the well known Kraft (sulfate) pulping process from coniferous material and includes northern and southern softwood Kraft fiber, Douglas fir Kraft fiber and so forth. Kraft softwood fibers generally have a lignin content of less than about 5 percent by weight, a length weighted average fiber length of greater than about 2 mm, as well as an arithmetic average fiber length of greater than about 0.6 mm.

Kraft hardwood fiber is made by the Kraft process from hardwood sources, i.e., eucalyptus, and also generally has a lignin content of less than about 5 wt %. Kraft hardwood fibers are shorter than softwood fibers, typically having a length weighted average fiber length of less than about 1 mm and an arithmetic average length of less than about 0.5 mm or less than about 0.4 mm.

Recycle fiber may be added to the furnish in any amount. Any suitable recycle fiber may be used, including recycle fiber with relatively low levels of groundwood, for example, recycle fiber with less than about 15 wt % lignin content, or less than about 10 wt % lignin content may be used depending on the furnish mixture employed and the application.

Calipers and/or bulk reported herein may be referred to herein as 1, 8, or 16 sheet calipers, as specified. Hand sheet caliper and bulk is based on 5 sheets. The sheets are stacked and the caliper measurement taken about the central portion of the stack. Preferably, the test samples are conditioned in an atmosphere of 23° C.±1.0° C. (73.4° F.±1.8° F.) at 50% relative humidity for at least about 2 hours and then measured with a Thwing-Albert Model 89-II-JR or Progage Electronic Thickness Tester with 2-in (50.8 mm) diameter anvils, 539±10 grams dead weight load, and 0.231 in/sec descent rate. For finished product testing, each sheet of product to be tested should have the same number of plies as the product when sold. For testing in general, eight sheets are selected and stacked together. For napkin testing, napkins are unfolded prior to stacking. For base sheet testing off of winders, each sheet to be tested must have the same number of plies as produced off the winder. For base sheet testing off of the paper machine reel, single plies must be used. Sheets are stacked together aligned in the MD. On custom embossed or printed product, try to avoid taking measurements in these areas if at all possible. Bulk may also be expressed in units of volume/weight by dividing caliper by basis weight (specific bulk).

A creping adhesive may be used to secure the base sheet web to the Yankee drying cylinder. The creping adhesive can be a hygroscopic, re-wettable, substantially non-crosslinking adhesive. Examples of creping adhesives can include poly (vinyl alcohol) of the general class described in U.S. Pat. No. 4,528,316, the entirety of which is incorporated herein by reference to the extent not inconsistent with this disclosure. Other examples of suitable adhesives are disclosed in U.S. patent application Ser. No. 10/409,042, the entirety of which is incorporated herein by reference to the extent not inconsistent with this disclosure. Suitable adhesives can be provided with modifiers and so forth; however, crosslinkers and/or modifiers may be used sparingly, or not at all, in the adhesive.

"Freeness" or "Canadian Standard Freeness" (CSF) can be determined in accordance with TAPPI Standard T 227 M-94 (Canadian Standard Method). Any suitable method for preparing the regenerated cellulose microfiber for freeness testing may be employed, so long as the fiber is well-dispersed. For example, if the fiber is pulped at about 5% consistency for a few minutes or more, e.g., 5-20 minutes before testing, the fiber can be well dispersed for testing. Likewise, partially dried, fibrillated, regenerated cellulose microfiber can be treated for about 5 minutes in a British disintegrator at about 1.2% consistency to ensure proper dispersion of the fibers. All preparation and testing can be done at room temperature and either distilled or deionized water can be used throughout.

The fibers can be solvent spun cellulose fibers, which can be produced by extruding a solution of cellulose into a coagulating bath. Lyocell fiber, for example, is distinct from cellulose fiber made by other known processes, which rely on the formation of a soluble chemical derivative of cellulose and its subsequent decomposition to regenerate the cellulose, for example, the viscose process. Lyocell is generally defined herein to mean fibers spun directly from a solution of cellulose in an amine-containing medium. In one or more embodiments, the amine-containing medium can be a tertiary amine N-oxide. Examples of solvent-spinning processes for the production of lyocell fibers are described in U.S. Pat. Nos. 6,235,392; 6,042,769; and 5,725,821, the entirety of each being incorporated herein by reference to the extent not inconsistent with this disclosure.

Dry tensile strengths (MD and CD), stretch, ratios thereof, modulus, break modulus, stress, and strain can be measured with a standard INSTRON test device or other suitable elongation tensile tester. "MD" means machine direction and "CD" means cross-machine direction. Opacity is measured according to TAPPI test procedure T425-OM-91, or equivalent. The tensile tester may be configured in various ways, including using about 1 inch, about 3 inch, or about 15 mm wide strips of a specimen conditioned in an atmosphere of 23° C.±1° C. (73.4° F.±1° F.) at about 50% relative humidity for about 2 hours. The tensile test can be run at a crosshead speed of about 2 in/min. Tensile strength can also be referred to herein simply as "tensile," and may be described in terms of breaking length (km), g/3" or g/in.

GM Break Modulus is expressed in grams/3 inches/% strain, or grams/inch/% strain unless other units are indicated. Percent strain is dimensionless. Tensile values generally refer to break values unless otherwise indicated. Tensile strengths are reported in g/3" or g/inch at break. GM Break Modulus is calculated as [(MD tensile/MD Stretch at break)×(CD tensile/CD Stretch at break)]½. Break Modulus for handsheets may also be measured on a 15 mm specimen and expressed in $kg/mm^2$, if so desired. Tensile ratios can simply be ratios of the values determined by way of the foregoing methods. Unless otherwise specified, a tensile property is a dry sheet property.

Total Energy Absorbed (TEA) is a measure of toughness and is reported CD TEA, MD TEA, or GM TEA. TEA is calculated as the area under the stress-strain curve using a tensile tester as has been previously described above. The area is based on the strain value reached when the sheet is strained to rupture and the load placed on the sheet has dropped to 65 percent of the peak tensile load. Since the thickness of a paper sheet is generally unknown and varies during the test, it is common practice to ignore the cross-sectional area of the sheet and report the "stress" on the sheet as a load per unit length or typically in the units of grams per 3 inches of width. For the TEA calculation, the stress is converted to grams per millimeter and the area calculated by integration. The units of strain are millimeters per millimeter so that the final TEA units become $g\text{-}mm/mm^2$.

Wet tensile is measured using a one or three-inch wide strip of material that is folded into a loop, clamped in a special fixture termed a Finch Cup, then immersed in water. The Finch Cup, which is commercially available from the Thwing-Albert Instrument Company of Philadelphia, Pa., is mounted onto a tensile tester equipped with a 2.0 pound load cell with the flange of the Finch Cup clamped by the tester's lower jaw and the ends of tissue loop clamped into the upper jaw of the tensile tester. The sample is immersed in water that has been adjusted to a pH of about 7.0±about 0.1 and the tensile is tested after about a 5 second immersion time. Values are divided by two, as appropriate, to account for the loop.

Wet/dry tensile ratios are expressed in percent by multiplying the ratio by 100. For towel products, the wet/dry CD tensile ratio is of heightened relevancy. Throughout this specification and claims which follow "wet/dry ratio" or like terminology refers to the wet/dry CD tensile ratio unless clearly specified otherwise. For handsheets, MD and CD values are approximately equivalent.

The pulp may be mixed with strength adjusting agents such as permanent wet strength agents (WSR), optionally dry strength agents, and the like, before the sheet is formed. Suitable permanent WSRs are known. Such WSRs can include urea-formaldehyde resins, melamine formaldehyde resins, glyoxylated polyacrylamide resins, polyamidoamine-epihalohydrin resins, and the like. Such WSRs can be produced by reacting acrylamide with diallyl dimethyl ammonium chloride (DADMAC) to produce a cationic polyacrylamide copolymer which is ultimately reacted with glyoxal to produce a cationic cross-linking wet strength resin, glyoxylated polyacrylamide. Examples of these materials are generally described in U.S. Pat. Nos. 3,556,932 and 3,556,933. Resins of this type are commercially available under the trade name PAREZ®. Different mole ratios of acrylamide/DADMAC/-glyoxal can be used to produce cross-linking resins, which are useful as wet strength agents. Furthermore, other dialdehydes can be substituted for glyoxal to produce thermosetting wet strength characteristics. Polyamidamine-epichlorohydrin permanent wet strength resins, can also be used, an example of which is sold under the trade names KYMENE® 557LX and 557H by Hercules, Inc. of Delaware and AMRES® by Georgia-Pacific Resins, Inc. These resins and the process for making the resins are described in U.S. Pat. Nos. 3,700,623 and 3,772,076. An extensive, non-limiting description of polymeric-epihalohydrin resins is given in Chapter 2: "Alkaline-Curing Polymeric Amine-Epichlorohydrin," by Espy in Wet Strength Resins and Their Application (L. Chan, Editor, 1994). A non-limiting list of wet strength resins is described by Westfelt in Cellulose Chemistry and Technology Volume 13, p. 813, 1979.

Suitable dry strength agents may include starch, guar gum, polyacrylamides, carboxymethyl cellulose (CMC) and the like. Of particular utility is carboxymethyl cellulose, an example of which is sold under the trade name HERCULES® CMC, by Hercules, Inc. of Delaware.

Regenerated cellulose fiber can be prepared from a cellulosic dope comprising cellulose dissolved in a solvent comprising tertiary amine N-oxides or ionic liquids. The solvent composition for dissolving cellulose and preparing underivatized cellulose dopes can include tertiary amine oxides such as N-methylmorpholine-N-oxide (NMMO) and similar compounds enumerated in U.S. Pat. No. 4,246,221. Cellulose dopes may also contain non-solvents for cellulose such as water, alkanols, or other solvents, as described in greater detail below.

Suitable cellulosic dopes are enumerated in Table 1, below; however, it will be appreciated that all numerical ranges shown are approximate.

TABLE 1

EXAMPLES OF TERTIARY AMINE N-OXIDE SOLVENTS

| Tertiary Amine N-oxide | % water | % cellulose |
|---|---|---|
| N-methylmorpholine N-oxide | up to 22 | up to 38 |
| N,N-dimethyl-ethanol-amine N-oxide | up to 12.5 | up to 31 |
| N,N-dimethylcyclohexylamine N-oxide | up to 21 | up to 44 |
| N-methylhomopiperidine N-oxide | 5.5-20 | 1-22 |
| N,N,N-triethylamine N-oxide | 7-29 | 5-15 |
| 2(2-hydroxypropoxy)-N-ethyl-N,N,-dimethyl-amide N-oxide | 5-10 | 2-7.5 |
| N-methylpiperidine N-oxide | up to 17.5 | 5-17.5 |
| N,N-dimethylbenzylamine N-oxide | 5.5-17 | 1-20 |

Details with respect to preparation of cellulosic dopes including cellulose dissolved in suitable ionic liquids and cellulose regeneration therefrom can be found in U.S. Pat. No. 6,824,599. Here again, suitable levels of non-solvents for cellulose may be included.

There is described in this disclosure a process for dissolving cellulose in an ionic liquid without derivatization and regenerating the cellulose in a range of structural forms. It is reported that the cellulose solubility and the solution properties can be controlled by the selection of ionic liquid constituents with small cations and halide or pseudohalide anions favoring solution. Suitable ionic liquids for dissolving cellulose can include those with cyclic cations, such as: imidazolium; pyridinium; pyridazinium; pyrimidinium; pyrazinium; pyrazolium; oxazolium; 1,2,3-triazolium; 1,2,4-triazolium; thiazolium; piperidinium; pyrrolidinium; quinolinium; and isoquinolinium.

Exemplary processing techniques for ionic liquids/cellulose dopes, and the like, are also described in U.S. Pat. Nos. 6,808,557 and 6,808,557 and U.S. patent application Ser. Nos. 11/087,496; 11/406,620; 11/472,724; 11/472,729; 11/263,391; and 11/375,963. Some ionic liquids and quasi-ionic liquids which may be suitable are disclosed by Konig et al., Chem. Commun. 2005, 1170-1172.

"Ionic liquid" generally refers to a molten composition including an ionic compound that is preferably a stable liquid at temperatures of less than about 100° C. at ambient pressure. Such liquids can have low vapor pressure at 100° C.; specifically, the vapor pressure may be less than 75 mBar, less than 50 mBar, less than 25 mBar, less than about 10 mBar, or less than about 1 mBar. Moreover, suitable liquids can have a vapor pressure that is so low that it is negligible and is not easily measurable. Exemplary commercially available ionic liquids are BASIONIC™ ionic liquid products available from BASF and are listed in Table 2 below.

TABLE 2

Exemplary Ionic Liquids

| IL Abbreviation | Basionic ™ Grade | Product name | CAS Number |
|---|---|---|---|
| EMIM Cl | ST 80 | 1-Ethyl-3-methylimidazolium chloride | 65039-09-0 |
| EMIM $CH_3SO_3$ | ST 35 | 1-Ethyl-3-methylimidazolium methanesulfonate | 145022-45-3 |
| BMIM Cl | ST 70 | 1-Butyl-3-methylimidazolium chloride | 79917-90-1 |
| BMIM $CH_3SO_3$ | ST 78 | 1-Butyl-3-methylimidazolium methanesulfonate | 342789-81-5 |
| MTBS | ST 62 | Methyl-tri-n-butylammonium methylsulfate | 13106-24-6 |
| MMMPZ $MeOSO_3$ | ST 33 | 1,2,4-Trimethylpyrazolium methylsulfate | |
| EMMIM $EtOSO_3$ | ST 67 | 1-Ethyl-2,3-di-methylimidazolium ethylsulfate | 516474-08-01 |
| MMMIM $MeOSO_3$ | ST 99 | 1,2,3-Trimethyl-imidazolium methylsulfate | 65086-12-6 |
| | | ACIDIC | |
| HMIM Cl | AC 75 | Methylimidazolium chloride | 35487-17-3 |
| HMIM $HSO_4$ | AC 39 | Methylimidazolium hydrogensulfate | 681281-87-8 |
| EMIM $HSO_4$ | AC 25 | 1-Ethyl-3-methylimidazolium hydrogensulfate | 412009-61-1 |
| EMIM $AlCl_4$ | AC 09 | 1-Ethyl-3-methylimidazolium tetrachloroaluminate | 80432-05-9 |
| BMIM $HSO_{4<}$/ | AC 28 | 1-Butyl-3-methylimidazolium hydrogensulfate | 262297-13-2 |
| BMIM $AlCl_4$ | AC 01 | 1-Butyl-3-methylimidazolium tetrachloroaluminate | 80432-09-3 |
| | | BASIC | |
| EMIM Acetat | BC 01 | 1-Ethyl-3-methylimidazolium acetate | 143314-17-4 |
| BMIM Acetat | BC 02 | 1-Butyl-3-methylimidazolium acetate | 284049-75-8 |
| | | LIQUID AT RT | |
| EMIM $EtOSO_3$ | LQ 01 | 1-Ethyl-3-methylimidazolium ethylsulfate | 342573-75-5 |

TABLE 2-continued

| Exemplary Ionic Liquids | | | |
|---|---|---|---|
| IL Abbreviation | Basionic ™ Grade | Product name | CAS Number |
| BMIM $MeOSO_3$ | LQ 02 | 1-Butyl-3-methylimidazolium methylsulfate LOW VISCOSITY | 401788-98-5 |
| EMIM SCN | VS 01 | 1-Ethyl-3-methylimidazolium thiocyanate | 331717-63-6 |
| BMIM SCN | VS 02 | 1-Butyl-3-methylimidazolium thiocyanate FUNCTIONALIZED | 344790-87-0 |
| COL Acetate | FS 85 | Choline acetate | 14586-35-7 |
| COL Salicylate | FS 65 | Choline salicylate | 2016-36-6 |
| MTEOA $MeOSO_3$ | FS 01 | Tris-(2-hydroxyethyl)-methylammonium methylsulfate | 29463-06-7 |

Exemplary cellulose dopes including ionic liquids having dissolved therein about 5 wt % underivatized cellulose are commercially available from Aldrich. These compositions utilize alkyl-methylimidazolium acetate as the solvent. It has been found that choline-based ionic liquids are not particularly suitable for dissolving cellulose.

After the cellulosic dope is prepared, it can be spun into fiber, fibrillated and incorporated into absorbent sheet as hereinafter described. A synthetic cellulose such as lyocell can be split into micro- and nano-fibers and added to conventional wood pulp. The fiber may be fibrillated, for example, in an unloaded disk refiner, or any other suitable technique including using a PFI mil. Relatively short fiber can be used and the consistency kept low during fibrillation. The beneficial features of fibrillated fibers include: biodegradability, hydrogen bonding, dispersibility, repulpability, and smaller microfibers than obtainable with meltspun fibers, for example.

Fibrillated cellulose, e.g. lyocell or its equivalents can have advantages over splittable meltspun fibers. Synthetic microdenier fibers come in a variety of forms. For example, a 3 denier nylon/PET fiber in a "pie wedge" configuration can be split into 16 or 32 segments, typically in a hydroentangling process. Each segment of a 16-segment fiber can have a coarseness of about 2 mg/100 m, versus eucalyptus pulp at about 7 mg/100 m. Unfortunately, a number of deficiencies have been identified with this approach for conventional wet laid applications. First, dispersibility can be less than optimal. Also, meltspun fibers often must be split before sheet formation, and an efficient method is lacking. Further, most available polymers for these fibers are not biodegradable. The coarseness is lower than wood pulp, but still high enough that they must be used in substantial amounts, and, therefore, can form a costly part of the furnish. Additionally, the lack of hydrogen bonding can require other methods of retaining the fibers in the sheet.

Fibrillated fibrils can be about 0.10 microns (μm) to about 0.25 microns in diameter, translating to a coarseness of about 0.0013 mg/100 m to about 0.0079 mg/100 m. Diameters can also range from a low of about 0.1 microns, 0.15 microns, or 0.20 to a high of about 0.25 microns, 0.3 microns, or 0.35 microns. In one or more embodiments, the fibrillated regenerated cellulose microfiber can have a coarseness value of from about 0.001 mg/100 m to about 0.6 mg/100 m. The fibrillated regenerated cellulose microfiber can also have a coarseness value of from about 0.01 mg/100 m to about 0.6 mg/100 m The fibrillated regenerated cellulose microfiber can also have a coarseness value that ranges from a low of about 0.001 mg/100 m, 0.01 mg/100 m, or 0.10 mg/100 m to a high of about 0.2 mg/100 m, 0.4 mg/100 m, or about 0.6 mg/100 m In one or more embodiments, the weight average of the diameter can be about 0.1 to about 2 microns, less than about 2 microns, less than about 1 micron, less than about 0.5 microns, or less than about 0.25 microns. In one or more embodiments, the weight average of the diameter can be 0.1 microns to about 1.5 microns; 0.2 microns to about 1.2; or about 0.3 microns to about 0.9 microns. In one or more embodiments, the weight average of the length can be less than about 500 microns, less than about 400 microns, less than about 300 microns, or less than about 200 microns. In one or more embodiments, the weight average of the length can range from a low of about 50 microns, 75 microns, or 100 microns to a high of about 250 microns, 375 microns, or 500 microns. Assuming these fibrils are available as individual strands (i.e., separate from the parent fiber) the furnish fiber population can be increased at a low addition rate. Further, fibrils not separated from the parent fiber may also provide benefit. Dispersibility, repulpability, hydrogen bonding, and biodegradability remain product attributes since the fibrils are cellulose.

Fibrils from lyocell fiber have important distinctions from wood pulp fibrils, including the length of the lyocell fibrils. Wood pulp fibrils can be mere microns long, and therefore, can act in the immediate area of a fiber-fiber bond. Wood pulp fibrillation from refining can lead to stronger, denser sheets. Lyocell fibrils, however, may be as long as the parent fibers. These fibrils can act as independent fibers and can thereby improve the bulk while maintaining or improving strength. Southern pine and mixed southern hardwood (MSHW) are two examples of fibers that are disadvantaged relative to premium pulps with respect to softness. The term "premium pulps" as it is used herein generally refers to northern softwoods and eucalyptus pulps commonly used in the tissue industry for producing the softest bath, facial, and towel grades. Southern pine is coarser than northern softwood Kraft, and mixed southern hardwood is both coarser and higher in fines than market eucalyptus. The lower coarseness and lower fines content of premium market pulp leads to a higher fiber population, expressed as fibers per gram (N or Ni>0.2) in Table 3. Illustrative coarseness and length values, shown in Table 3, can be obtained with a commercially-available OpTest Fiber Quality Analyzer. Definitions are as follows:

$$L_n = \frac{\sum_{all\ fibers} n_i L_i}{\sum_{all\ fibers} n_i}$$

$$L_{n,i>0.2} = \frac{\sum_{i>0.2} n_i L_i}{\sum_{i>0.2} n_i}$$

$$C = 10^5 \times \frac{sampleweight}{\sum_{all\ fibers} n_i L_i}$$

$$N = \frac{100}{CL}[=]\ millionfibers/\text{gram}$$

Northern bleached softwood Kraft (NBSK) and eucalyptus have more fibers per gram than southern pine and hardwood. Lower coarseness leads to higher fiber populations and smoother sheets.

TABLE 3

| Fiber Properties | | | | | | | |
|---|---|---|---|---|---|---|---|
| Sample | Type | C, mg/100 m | Fines, % | $L_{n,mm}$ | N, MM/g | $L_{n,i>0.2,mm}$ | $N_{i>0.2}$, MM/g |
| Southern HW | Pulp | 10.1 | 21 | 0.28 | 35 | 0.91 | 11 |
| Southern HW - low fines | Pulp | 10.1 | 7 | 0.54 | 18 | 0.94 | 11 |
| Aracruz *Eucalyptus* | Pulp | 6.9 | 5 | 0.50 | 29 | 0.72 | 20 |
| Southern SW | Pulp | 18.7 | 9 | 0.60 | 9 | 1.57 | 3 |
| Northern SW | Pulp | 14.2 | 3 | 1.24 | 6 | 1.74 | 4 |
| Southern (30 SW/70 HW) | Base sheet | 11.0 | 18 | 0.31 | 29 | 0.93 | 10 |
| 30 Southern SW/70 *Eucalyptus* | Base sheet | 8.3 | 7 | 0.47 | 26 | 0.77 | 16 |

For comparison, the "parent" or "stock" fibers of lyocell can have a coarseness of about 16.6 mg/100 m before fibrillation and a diameter of about 11 μm to about 12 μm. The fibrils (i.e., fibers post-fibrillation) have a coarseness of from about 0.001 mg/100 m to about 0.2 mg/100 m. Thus, the fiber population can be increased at relatively low addition rates. Fiber length of the parent fiber can be selectable, and fiber length of the fibrils can depend on the starting length and the degree of cutting during the fibrillation process.

The dimensions of the fibers passing the 200 mesh screen are generally from about 0.2 μm in diameter by about 100 μm long. Using these dimensions, the fiber population can be calculated as about 200 billion fibers per gram. For perspective, southern pine can be three million fibers per gram and eucalyptus can be 20 million fibers per gram (see Table 3). Different fiber shapes with lyocell can result in approximately 0.2 μm diameter fibers that can be, for example, about 1,000 μm or more long. In one or more embodiments, the approximately 0.2 μm diameter fibers can have a length of less than about 500 μm, less than about 400 μm, less than about 300 μm, or less than about 200 μm. As noted above, fibrillated fibers of regenerated cellulose can be made by producing stock fibers having a diameter of about 10 μm to about 12 μm by fibrillating the parent fibers. Alternatively, fibrillated lyocell microfibers, for example, commercially available from Engineered Fibers Technology having suitable properties can be used.

FIG. 1 illustrates a series of Bauer-McNett classifier analyses of fibrillated lyocell samples showing various degrees of "fineness." Materials having more than about 40% fiber finer than 14 mesh can exhibit a low coarseness (i.e., a low freeness). As reference, exemplary, non-limiting mesh sizes appear in Table 4, below.

TABLE 4

| Mesh Size | | |
|---|---|---|
| Sieve Mesh # | Inches | Microns |
| 14 | 0.0555 | 1400 |
| 28 | 0.028 | 700 |
| 60 | 0.0098 | 250 |
| 100 | 0.0059 | 150 |
| 200 | 0.0029 | 74 |

In one or more embodiments, the freeness CSF value can be below about 150 mL, about 100 mL, about 50 mL, or about 25 mL. In one or more embodiments, the freeness CSF value can range from a low of about 4 mL, about 10 mL, or about 25 mL to a high of about 85 mL, about 115 mL, or about 150 mL. In one or more embodiments, at least about 50 wt %, about 60 wt %, about 70 wt %, or about 80 wt % of the fibrillated cellulose can be finer than 14 mesh. In one or more embodiments, of from about 50 wt %, 55 wt % or 60 wt % to a high of about 65 wt %, 75 wt %, or 80 wt % of the fibrillated cellulose can be finer than 14 mesh. Details as to fractionation using the Bauer-McNett Classifier appear in Gooding et al., "Fractionation in a Bauer-McNett Classifier", Journal of Pulp and Paper Science; Vol. 27, No. 12, December 2001.

Figure 2:
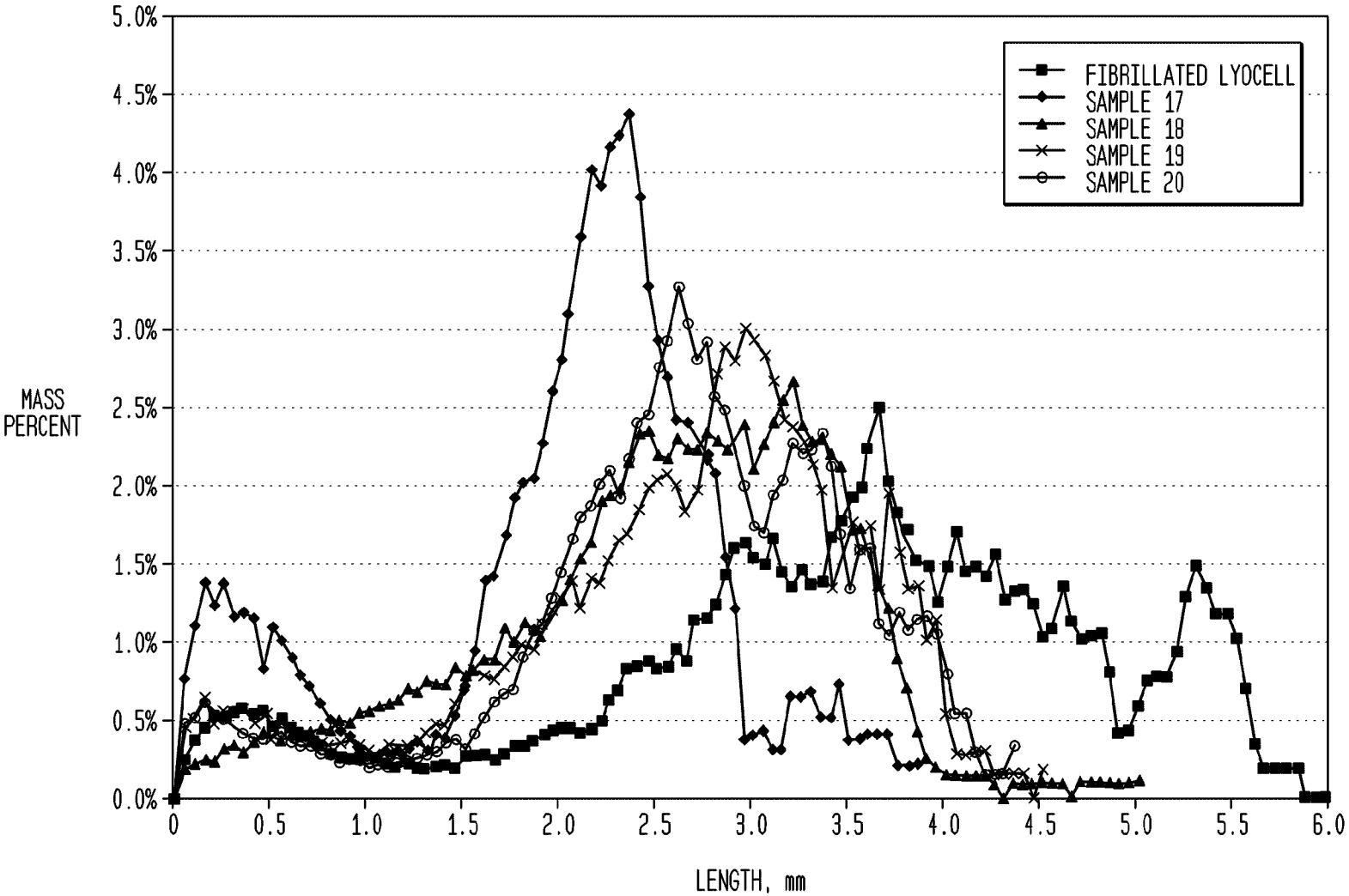
FIG. 2 illustrates a plot of FQA measured fiber length for various exemplary fibrillated lyocell fiber samples, according to one or more embodiments described.

FIG. 2 illustrates a plot showing fiber length as measured by an FQA analyzer for various samples including samples 17-20 shown on FIG. 1. From this data it is appreciated that much of the fine fiber is excluded by the FQA analyzed and length prior to fibrillation has an effect on fineness. For fibrillating cellulose, preferably lyocell, typical conditions can be low consistency (about 0.5% to about 1%), low intensity (as defined by conventional refining technology), and high energy (about 20 HPD/T). High energy is desirable when fibrillating the regenerated cellulose, since it can take a long time at low energy. Up to about 6% consistency or more can be used and high energy input, about 20 HPD/T or more, may be employed.

The fibrillated cellulose microfiber can be present in the base sheet in any suitable amount. In one or more embodiments, up to about 75 wt % regenerated cellulose microfiber can be used although one may, for example, employ up to 90 wt % or 95 wt % regenerated cellulose microfiber in some cases. In one or more embodiments, the amount of regenerated cellulose microfiber can range from a low of about 1 wt %, 5 wt %, or 15 wt % to a high of about 75 wt %, 85 wt %, or 95 wt %. The amount of regenerated cellulose microfiber can have a suitable maximum, i.e., 1+X(%) where X is any positive number up to about 50 or about 98. The following are some exemplary compositions, it being appreciated that all numbers presented are approximate:

TABLE 5

| Exemplary Cellulose and Pulp-Derived Papermaking Fiber Content | |
|---|---|
| % Regenerated Cellulose Microfiber | % Pulp-Derived Papermaking Fiber |
| >1 up to 95 | 5 to less than 99 |
| >5 up to 95 | 5 to less than 95 |
| >1 up to 35 | 65 to less than 99 |
| >1 up to 25 | 75 to less than 99 |

Furthermore, lyocell fibrils are distinct from wood pulp fibrils. A wood pulp fiber is a complex structure of several layers (P, S1, S2, S3), as known in the art, each with cellulose strands arranged in spirals around the axis of the fiber. When subjected to mechanical refining, portions of the P and S1 layers peel away in the form of fines and fibrils. These fibrils are generally short, for example, less than about 20 microns. The fibrils can act in the immediate vicinity of the fiber at the intersections with other fibers. Thus, wood pulp fibrils can increase bond strength, sheet strength, sheet density, and sheet stiffness. The multilayered fiber wall structure with spiraled fibrils can make it difficult to split the wood fiber along its axis using commercial processes. By contrast, Lyocellfiber has a much simpler structure that allows the fiber to be split along its axis. The resulting fibrils can be about 0.1 microns to about 0.25 microns in diameter, as described above, and potentially as long as the original fiber. Fibril length is likely to be less than the "parent" fiber, and disintegration of many fibers can be incomplete. Nevertheless, a sufficient numbers of fibrils can act as individual fibers, thereby substantially raising the paper properties at a relatively low addition rate.

Considering the relative fiber coarsenesses of wood pulp furnishes, northern softwood (NBSK) has a coarseness of about 14 mg/100 m, and southern pine has a coarseness of about 20 mg/100 m. Mixed southern hardwood (MSHW) has a coarseness of 10 mg/100 m, and eucalyptus has a coarseness of about 6.5 mg/100 m. Lyocell fibrils with diameters between about 0.1 microns and 0.25 microns can have coarseness values between about 0.0013 mg/100 m and about 0.0079 mg/100 m, as described above. One way to express the difference between a premium furnish and southern furnish is fiber population, expressed as the number fibers per gram of furnish (N). N is inversely proportional to coarseness, so premium furnish has a larger fiber population than southern furnish. The fiber population of southern furnish can be increased to equal or exceed that of premium furnish by the addition of fibrillated lyocell.

Figure 14:
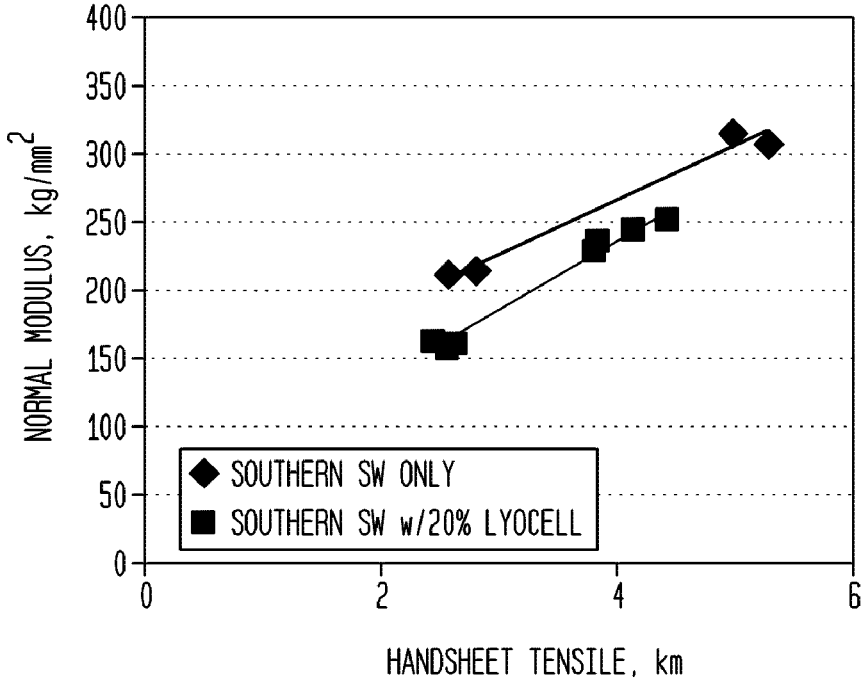
FIG. 14 illustrates a plot of modulus versus tensile of handsheets including regenerated cellulose microfiber, according to one or more embodiments described.

Lyocell microfibers can have many attractive features including biodegradability, dispersibility, repulpability, low coarseness, and extremely low coarseness to length (C/L). The low C/L means that sheet strength can be obtained at a lower level of bonding, which makes the sheet more drapable (lower modulus as shown in FIG. 14 and described below with reference thereto).

Integrated southern softwood and hardwood can have a lower cost than premium pulp, yet the ability of southern furnish to produce soft tissue can be less than desired for some applications. Mills producing premium products may be required to purchase premium fibers like northern softwood and eucalyptus for the highest softness grades, which can increase cost and negatively impact the mill fiber balance. Accordingly, refined lyocell fibers can be added to improve furnish quality.

At high levels of refining, the fibrils can be separated from the parent fiber and act as independent micro- or perhaps even nano-fibers. A high level of refining may produce a substantial impact at the lowest addition rate. More refining can produce a higher population of very low coarseness fibers, but may also reduce average fiber length. It is generally preferred to maximize production of low coarseness fibrils while minimizing the cutting of fibers. As discussed earlier, the 1.6 mm as measured by the FQA is not considered an accurate average value, but is included herein to show the directional decrease in length with refining. The fibrillated lyocell obtained for later examples began as 6 mm fibers with a coarseness of 16.7 mg/100 m before refining. The ideal fibrils are substantially less coarse than eucalyptus while maintaining adequate length. Refining can reduce the fibril length, but the fibrils can remain long enough to reinforce the fiber network.

A relatively modest amount of lyocell microfiber makes it possible to increase the fibers/gram of a furnish. Consider the calculations in Table 6, wherein fibrillated lyocell achieves fiber counts of greater than a billion fibers per gram. For comparison, eucalyptus fiber, which has a relatively large number of fibers, has only up to about 20 million fibers per gram.

TABLE 6

| Fibrillated lyocell Fiber Count | | | |
|---|---|---|---|
| D, microns | C mg/100 m | Length, mm | N, million/g |
| 0.1 | 0.0013 | 0.1 | 795,775 |
| 0.25 | 0.0079 | 0.2 | 63,662 |
| 0.5 | 0.031 | 0.3 | 10,610 |
| 1 | 0.126 | 0.4 | 1,989 |
| 2 | 0.50 | 0.5 | 398 |
| 11.5 | 16.6 | 6 | 1 |

As can be appreciated from Table 6, in one or more embodiments, the fibrillated regenerated cellulose microfiber can have a fiber count greater than about 50 million fibers/gram, about 400 million fibers/gram, about 2 billion fibers/gram, about 10 billion fibers/gram, about 50 billion fibers/gram, or about 200 billion fibers/gram, or more. In one or more embodiments, the fibrillated regenerated cellulose microfiber can have a fiber count ranging from a low of about 50 million fibers/gram, 75 million fibers/gram, or 100 million fibers/gram to a high of about 500 million fibers/gram, 1 billion fibers/gram, 100 billion fibers/gram, or 200 billion fibers/gram. In one or more embodiments, the fibrillated regenerated cellulose microfiber can have a fiber count ranging from a low of about 500 million fibers/gram, 800 million fibers/gram, or 1 billion fibers/gram to a high of about 10 billion fibers/gram, 80 billion fibers/gram, or 100 billion fibers/gram.

Another property, pore volume distribution (PVD) can be measured using liquid porosimetry techniques. For example, within a porous solid matrix. Each pore can be sized according to its effective radius, and the contribution of each size to the total free volume is the principal objective of the analysis. The data reveals useful information about the structure of a porous network, including absorption and retention characteristics of a material.

Liquid porosimetry generally requires quantitative monitoring of the movement of liquid either into or out of a porous structure. The effective radius R of a pore is operationally defined by the Laplace equation:

$$R = \frac{2\gamma\cos\theta}{\Delta P},$$

where γ is liquid surface tension, θ is advancing or receding contact angle of the liquid, and ΔP is pressure difference across the liquid/air meniscus. For liquid to enter or drain from a pore, an external pressure must be applied that is just enough to overcome the Laplace ΔP. Cos θ is negative when liquid must be forced in; cos θ is positive when it must be forced out. If the external pressure on a matrix having a range of pore sizes is changed, either continuously or in steps, filling or emptying will start with the largest pore and proceed in turn down to the smallest size that corresponds to the maximum applied pressure difference. Porosimetry involves recording the increment of liquid that enters or leaves with each pressure change and can be carried out in the extrusion mode; that is, liquid is forced out of the porous network rather than into it. The receding contact angle is the appropriate term in the Laplace relationship, and any stable liquid that has a known cos θr>0 can be used. If necessary, initial saturation with liquid can be accomplished by preevacuation of the dry material.

Figure 19:
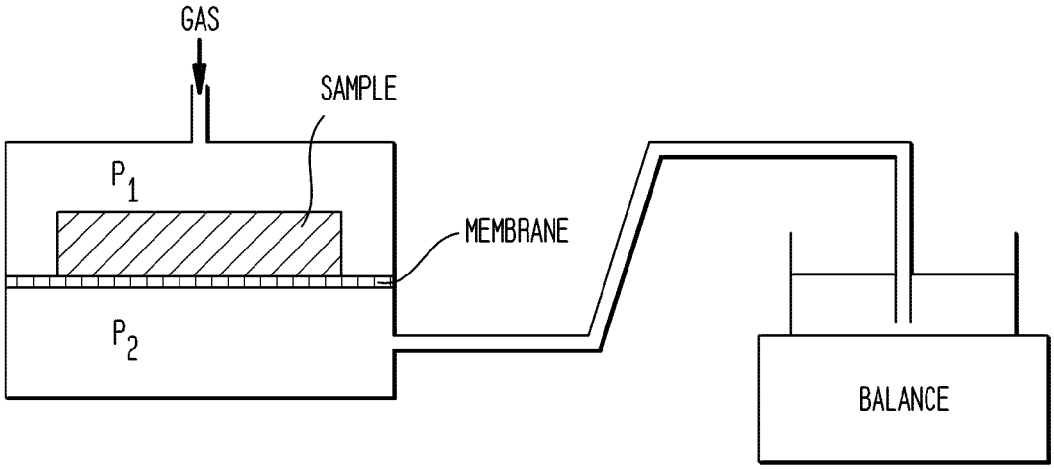
FIG. 19 illustrates a schematic diagram of an extrusion or liquid porosimetry apparatus, according to one or more embodiments described.

FIG. 19 illustrates an exemplary basic arrangement used for extrusion porosimetry measurements. The presaturated specimen is placed on a microporous membrane which is itself supported by a rigid porous plate. The gas pressure within the chamber can be increased stepwise, thereby causing liquid to flow out of some of the pores, largest ones first. The amount of liquid removed can be monitored by the top-loading recording balance. In this way, each level of applied pressure, which determines the largest effective pore size that remains filled, can be related to an increment of liquid mass. The chamber can be pressurized by means of a computer-controlled, reversible, motor-driven piston/cylinder arrangement that can produce the required changes in pressure to cover a pore radius range from about 1 μm to about 1000 μm. Further details concerning the apparatus employed can be found in Miller et al., "Liquid Porosimetry: New Methodology and Applications," *J. of Colloid and Interface Sci.,* 162, 163-170 (1994) (TRI/Princeton). It will be appreciated that an effective Laplace radius R, can be determined by any suitable technique, including by using an automated apparatus to record pressure and weight changes.

The addition of regenerated cellulose microfiber to a papermaking furnish of conventional papermaking fibers surprisingly provides increased smoothness to the surface of a sheet, which can be a highly desirable feature in a wiper, since this property promotes good surface to surface contact between the wiper and a substrate to be cleaned.

Another property that can be measured is Bendtsen Roughness, which is one method by which to characterize the surface of a sheet. Generally, Bendtsen Roughness is measured by clamping a test piece between a flat glass plate and a circular metal land and measuring the rate of airflow between the paper and land, wherein the air is supplied at a nominal pressure of 1.47 kPa. The measuring land has an internal diameter of about 31.5 mm±about 0.2 mm. and a width of about 150 μm±about 2 μm. The pressure exerted on the test piece by the land can be 1 kg pressure or 5 kg pressure.

The base sheet can have a MD tensile of greater than about 5 lbs/inch, such as greater than 10 lbs/inch, or greater than 20 lbs/inch, or greater than 30 lbs/inch, or greater than 50 lbs/inch, or greater than 100 lbs/inch. The base sheet can also have a MD tensile ranging from a low of about 5 lbs/inch, 25 lbs/inch, or 50 lbs/inch to a high of about 75 lbs/inch, 100 lbs/inch, or 200 lbs/inch.

The base sheet can further have a 1-sheet caliper of from about 1 mil to about 3 mils. Preferably, the base sheet can have a 1-sheet caliper of from about 1.2 mil to about 2.8 mils, about 1.2 mil to about 2.5 mils, about 1.5 mil to about 2.5 mils, or about 2.0 mil to about 3.0 mils. The base sheet can also have a 1-sheet caliper ranging from a low of about 1.0 mil, 1.4 mil, or 1.8 mil to a high of about 2.0 mil, 2.4 mil, or 3.0 mil.

Bendtsen Smoothness relative to a sheet without microfiber is calculated by dividing the Bendtsen Roughness of a sheet without microfiber by the Bendtsen Roughness of a like sheet with microfiber. Either like sides or both sides of the sheets may be used to calculate relative smoothness, depending upon the nature of the sheet. If both sides are used, it is referred to as an average value.

An illustrative base sheet for food wrap products can have the characteristics indicated in Tables 7 through 10, below. Such products made with regenerated cellulose microfiber generally contain less opacifier and less wet strength resin and optionally have lower roughness values.

TABLE 7

17 lb Dry Waxing Sheet

| PROPERTY | TAPPI TEST METHOD | CATEGORY C = CRITICAL M = MAJOR R = REFERENCE | TEST UNITS | SPEC |
|---|---|---|---|---|
| BASIS WEIGHT | T-410 | C | LBS/REAM | 17 |
| CALIPER | T-411 | C | MILS/1 SHEET | 1.65 |
| MOISTURE | T-412 | M | % | 4.0 |
| TEAR, MD | T-414 | M | G | 20 |
| TEAR, CD | T-414 | M | G | 23 |
| TENSILE, MD | T-494 | M | LBS/1 IN | 13.0 |
| TENSILE, CD | T-494 | M | LBS/1 IN | 6.0 |
| WET TENSILE, MD | T-494 | C | LBS/1 IN | 1.8 |
| WET TENSILE, CD | T-494 | C | LBS/1 IN | 0.9 |
| SHEFFIELD ROUGHNESS, WS | T-538 | R | UNITS | 150 |
| SHEFFIELD ROUGHNESS, FS* | T-538 | R | UNITS | 200 |
| AIR RESISTANCE | T-460 | R | SEC | 20 |
| MULLEN BURST | T-403 | M | PSI | 10 |
| OPACITY | T-425 | M | OPACITY UNIT | 53 |

TABLE 7-continued

| 17 lb Dry Waxing Sheet | | | | |
|---|---|---|---|---|
| PROPERTY | TAPPI TEST METHOD | CATEGORY C = CRITICAL M = MAJOR R = REFERENCE | TEST UNITS | SPEC |
| BRIGHTNESS, DIRECTIONAL AT 457 NM GE | T-452 | C | % | 85 |

TABLE 8

| 14 lb Wet Waxing Sheet | | | | |
|---|---|---|---|---|
| PROPERTY | TAPPI TEST METHOD | CATEGORY C = CRITICAL M = MAJOR R = REFERENCE | TEST UNITS | SPEC |
| BASIS WEIGHT | T-410 | C | LBS/REAM | 14 |
| CALIPER | T-411 | C | MILS/1 SHEET | 1.35 |
| MOISTURE | T-412 | M | % | 4.5 |
| TEAR, MD | T-414 | C | G | 9.0 |
| TEAR, CD | T-414 | C | G | 13.0 |
| TENSILE, MD | T-494 | C | LBS/1 IN | 6.5 |
| TENSILE, CD | T-494 | M | LBS/1 IN | 5.0 |
| WET TENSILE, MD | T-494 | M | LBS/1 IN | 0.5 |
| WET TENSILE, CD | T-494 | M | LBS/1 IN | 0.3 |
| SHEFFIELD ROUGHNESS, WS | T-538 | M | UNITS | 80 |
| SHEFFIELD ROUGHNESS, FS* | T-538 | R | UNITS | 250 |
| AIR RESISTANCE | T-460 | C | SEC | 80 |
| OPACITY | T-425 | C | OPACITY UNIT | 64 |
| BRIGHTNESS, DIRECTIONAL AT 457 NM GE | T-452 | M | % | 85 |

TABLE 9

| 22 lb Wet Waxing Sheet | | | | |
|---|---|---|---|---|
| PROPERTY | TAPPI TEST METHOD | CATEGORY C = CRITICAL M = MAJOR R = REFERENCE | TEST UNITS | SPEC |
| BASIS WEIGHT | T-410 | C | LBS/REAM | 22.0 |
| CALIPER | T-411 | C | MILS/1 SHEET | 1.70 |
| MOISTURE | T-412 | C | % | 5.0 |
| TEAR, MD | T-414 | C | G | |
| TEAR, CD | T-414 | C | G | |
| TENSILE, MD | T-494 | M | LBS/1 IN | 12.0 |
| TENSILE, CD | T-494 | M | LBS/1 IN | 7.0 |
| WET TENSILE, MD | T-494 | M | LBS/1 IN | 1.9 |
| WET TENSILE, CD | T-494 | M | LBS/1 IN | 1.1 |
| SHEFFIELD ROUGHNESS, WS | T-538 | R | UNITS | |
| SHEFFIELD ROUGHNESS, FS* | T-538 | R | UNITS | |
| AIR RESISTANCE | T-460 | C | SEC | 50 |
| MULLEN BURST | T-403 | M | PSI | 22 |
| OPACITY | T-425 | C | OPACITY UNIT | 70 |
| WAXED OPACITY | | C | | 50 |
| BRIGHTNESS, DIRECTIONAL AT 457 NM GE | T-452 | C | % | 88 |

TABLE 10

| 19 lb Grease Resistant Paper Sheet | | | | |
|---|---|---|---|---|
| PROPERTY | TAPPI TEST METHOD | CATEGORY C = CRITICAL M = MAJOR R = REFERENCE | TEST UNITS | SPEC |
| BASIS WEIGHT | T-410 | C | LBS/REAM | 19.0 |
| CALIPER | T-411 | C | MILS/1 SHEET | 1.90 |
| MOISTURE | T-412 | M | % | 4.5 |
| TEAR, MD | T-414 | M | G | 20 |
| TEAR, CD | T-414 | M | G | 25 |
| TENSILE, MD | T-494 | M | LBS/1 IN | 15 |
| TENSILE, CD | T-494 | M | LBS/1 IN | 7 |
| WET TENSILE, MD | T-494 | C | LBS/1 IN | 2.8 |
| WET TENSILE, CD | T-494 | C | LBS/1 IN | 1.5 |
| SHEFFIELD ROUGHNESS, WS | T-538 | R | UNITS | 150 |
| SHEFFIELD ROUGHNESS, FS* | T-538 | R | UNITS | 200 |
| 2 MINUTE COBB WATER ABS | T-441 | C | G/M^2 | 16 |
| POROSITY | T-460 | R | SEC/100 ML | 30 |
| BRIGHTNESS, DIRECTIONAL AT 457 NM GE | T-452 | M | % | 82 |

As will be appreciated form Tables 7 through 10, a base sheet for food wrap products generally have basis weights of from about 5 lbs to about 25 lbs per 3000 $ft^2$ and 1-sheet calipers of from about 1.25 mils to 2.5 mils. The base sheet can also have a basis weight of from about 5 lbs to about 25 lbs per 3,000 $ft^2$. More preferably, the base sheet can have a basis weight of from about 10 lbs to about 20 lbs per 3,000 $ft^2$. In one or more embodiments, the base sheet can have a basis weight ranging from a low of about 8 lbs, 14 lbs, or 17 lbs to a high of about 19 lbs, 22 lbs, or 25 lbs per 3,000 $ft^2$.

Absorbencies are much lower than for absorbent products and tensiles much higher, distinguishing these products from tissue and towel base sheet. For example, absorbent products generally have SAT values of greater than 2 g/g, while these products have lower SAT values and higher tensiles.

In one or more embodiments, properties of a base sheet can be achieved through the addition of regenerated cellulose microfiber, which provides wet strength, opacity and smoothness. Basis weights and calipers may be reduced from the values shown in Tables 7 through 10, while maintaining tensile and opacity requirements. Still further advantages stem from the reduced pore size of the base sheet with the microfiber. The small pores help to hold a water and/or grease resistant coating on the surface where it is most effective and allow lower coatweights to be used, as further discussed below in connection with water and grease resistant agents which are applied to the base sheet.

In one or more embodiments, the base sheet can include one or more water and/or grease resistant agents. Such agents can include one or more polymers, waxes, and other sizes, which usually provide water and/or grease resistance. It will be appreciated that a combination of materials may be needed to achieve the desired level of both resistance to water and grease. These materials can be printed onto the base sheet or extruded onto the base sheet as appropriate and are preferably film-forming.

Aqueous barrier and/or grease resistance coatings can include one or more synthetic latexes with acrylic, styrenic, olefinic polymers, derivatives thereof, or mixtures thereof. Wax emulsions and the like can also be applied to the base sheet in coatweights of from about 0.3 lbs solids to about 3 lbs solids per 3,000 square foot ream; however, more barrier coatings may be used in the case of wax, as also noted below. Instead of a latex, the liquid coating may be a solution of polymer (e.g., aqueous polyvinyl alcohol), and may be applied in like amounts by like methods.

The coatings may be applied by press coating methods, i.e., gravure, coil coating, flexographic methods and so forth as opposed to extrusion methods which are used for thermoplastic resins and waxes usually at higher coatweights than aqueous coatings. The coating(s) can also be applied to the base sheet in water-borne form.

Suitable synthetic aqueous latexes can have the following physical properties. It being appreciated that all numbers presented are approximate:

| | |
|---|---|
| VISCOSITY: | 40-80 cps @ 70° F. |
| SOLIDS: | 36% + 2% |
| pH: | 9.0-9.4 |
| VOC: | 0.11 lbs./gal. |
| APPEARANCE: | Milky |
| FDA COMPLIANCE: | 176.170, 176.180 |
| DILUENTS: | IPA, $H_2O$ |
| LBS/GAL.: | 8.6-8.7 |
| FLASH POINT: | None |

Suitable polymers can include, but are not limited to, polyacrylates, polymethacrylates, polyamides, polystyrene/butadienes, polyolefins such as polypropylene or polyethylene, polyesters, polylactides, polyalkanoates, and the like, such as those described in U.S. Pat. No. 6,893,693. Suitable polymers listed in the '693 patent can include: poly(benzyl acrylate), poly(butyl acrylate)(s), poly(2-cyanobutyl acrylate), poly(2-ethoxyethyl acrylate), poly(ethyl acrylate), poly(2-ethylhexyl acrylate), poly(fluoromethyl acrylate), poly(5,5,6,6,7,7,7-heptafluoro-3-oxoheptyl acrylate), poly(heptafluoro-2-propyl acrylate), poly(heptyl acrylate), poly(hexyl acrylate), poly(isobornyl acrylate), poly(isopropyl acrylate), poly(3-methoxybutyl acrylate), poly(methyl acrylate), poly(nonyl acrylate), poly(octyl acrylate), poly(propyl acrylate), polyptolyl acrylate), poly(acrylic acid) and derivatives and salts thereof; polyacrylamides such as poly(acrylamide), poly(N-butylacrylamide), poly(N,N-dibutylacrylamide), poly(N-dodecylacrylamide), and poly(morpholylacrylamide); polymethacrylic acids and poly(methacrylic acid esters) such as poly(benzyl methacrylate), poly(octyl methacrylate), poly (butyl methacrylate), poly(2-chloroethyl methacrylate), poly (2-cyanoethyl methacrylate), poly(dodecyl methacrylate), poly(2-ethylhexyl methacrylate), poly(ethyl methacrylate), poly(1,1,1-trifluoro-2-propyl methacrylate), poly(hexyl methacrylate), poly(2-hydroxyethyl methacrylate), poly(2-hydroxypropyl methacrylate), poly(isopropyl methacrylate), poly(methacrylic acid), poly(methyl methacrylate) in various forms such as, atactic, isotactic, syndiotactic, and heterotactic; and poly(propyl methacrylate); polymethacrylamides such as poly(4-carboxyphenylmethacrylamide); other alpha- and beta-substituted poly(acrylics) and poly(methacrylics) such as poly(butyl chloroacrylate), poly(ethyl ethoxycarbonylmethacrylate), poly(methyl fluoroacrylate), and poly(methyl phenylacrylate). The latex applied to the base sheet can be any FDA-approved material, for example, a coating such as Plate Kote 982 Kosher available from Michelman.

Other suitable polymers can include polyethylene terephthalate (PET), or biopolymers such as polylactide (PLA) or polyhydroxyalkanoate (PHA). PLA and PHA are particularly preferred when a biodegradable product is desired. The polymers relating to latex coatings may be extrusion coated as well; however, many acrylics and styrene/butadiene polymers are more amenable to latex application.

The term "wax," as used herein, refers to relatively low melting organic mixtures or compounds of relatively high molecular weight, solid at room temperature, and generally similar in composition to fats and oils, except that the waxes contain little or no glycerides. Some waxes can be hydrocarbons. Others can be esters of fatty acids and alcohols. Suitable waxes can be thermoplastic, but since they are not high polymers, are not considered in the family of plastics. Common properties include smooth texture, low toxicity, and freedom from objectionable odor and color. Waxes are typically combustible and have good dielectric properties. They are soluble in most organic solvents and insoluble in water. Typical classes of waxes are enumerated briefly below.

Natural waxes can include carnauba waxes, paraffin waxes, montan waxes, and microcrystalline waxes. Carnauba is a natural vegetable wax derived from fronds of Brazilian palm trees (*Copernica cerifera*). Carnauba is a relatively hard, brittle wax whose main attributes are lubricity, anti-blocking, and FDA compliance. Paraffins are low molecular weight waxes with melting points ranging from about 48 to about 74° C. They are relatively highly refined, have a low oil content, and are straight-chain hydrocarbons. Paraffins provide anti-blocking, slip, water resistance, and moisture vapor transmission resistance. Montan waxes are mineral waxes which, in crude form, are extracted from lignite formed decomposition of vegetable substances. Microcrystalline waxes come from the distillation of crude oil. Microcrystalline waxes have a molecular weight of from about 500 to 675 grams/mole and melting points of about 73 to about 94° C. These waxes are highly branched and have small crystals.

Synthetic waxes can include Fischer-Tropsch waxes, polyethylene waxes, and wax dispersions of various macromers. Fischer-Tropsch waxes are produced almost exclusively in South Africa by coal gasification. They include methylene groups which can have either even or odd numbers of carbons. These waxes have molecular weights of between about 300 and about 1400 gms/mole, and are used in various applications. Polyethylene waxes are made from ethylene produced from natural gas or by cracking petroleum naphtha. Ethylene is then polymerized to provide waxes with various melting points, hardnesses, and densities. Polyethylene wax molecular weights range from about 500 to about 3000 gms/mole. Oxidized polyethylenes are readily emulsifiable, whereas non-oxidized polyethylenes largely are not. However, some non-oxidized polyethylenes have been successfully emulsified. High density polyethylenes (HDPE) have a great deal of crystallinity and their molecules are tightly packed.

Wax dispersions are known and, for example, disclosed in U.S. Pat. Nos. 6,033,736; 5,431,840; and 4,468,254. In general, a wax dispersion includes from about 90 to about 50 percent water, from about 10 to about 50 percent wax solids, and minor amounts of an emulsifier. "Aqueous wax dispersion," and like terminology, as it is used herein, generally refers to a stable mixture of wax, emulsifier, and water without a substantial solvent component. Wax may be applied to the base sheet in the form of a dispersion, but a melt application without water or other solvent may be required.

Wax coatings can be fortified with low density polyethylene (LDPE) for wet wax applications. These wax coatings may be applied generally by the same methods as aqueous coatings noted above, or may be extrusion coated onto the base sheet substrate. Wax coatweight typically ranges from 1 lb solids to 5 lbs solid per 3000 square foot ream for wet waxing and for dry waxing applications. Extrusion coating coatweights of wax or high polymer suitably range from about 2 lbs to about 10 lbs solid per 3000 square foot ream depending on the product.

In one or more embodiments, the aqueous barrier and/or grease resistance coatings can include a fluorochemical sizing agent or a chrome complex sizing agent, or both. An illustrative agent is QUILON® chrome complex surface treatment chemicals, commercially-available from Dupont Chemical. Such materials can be applied by the methods specified above, or similar methods, and in like amounts, whether in polymeric or lower molecular weight form.

EXAMPLES

The present disclosure can be more fully described according to the following non-limiting examples.

Hand Sheet Study #1

Figure 3:
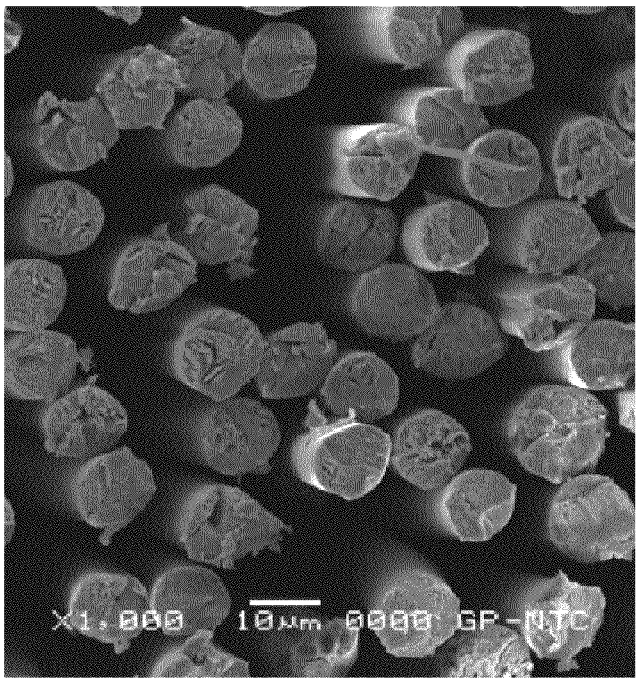
FIG. 3 depicts a photomicrograph of 1.5 denier unrefined, regenerated cellulose fiber, in accordance with the disclosure.
Figure 4:
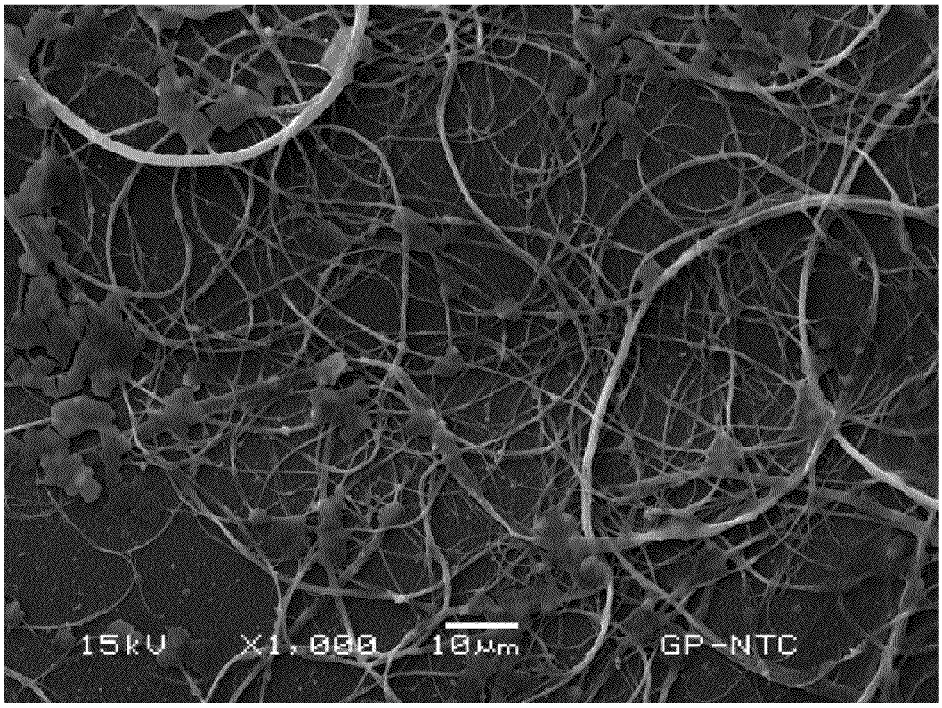
FIG. 4 is a photomicrograph of 14 mesh of refined, regenerated cellulose fiber, according to one or more embodiments described.
Figure 5:
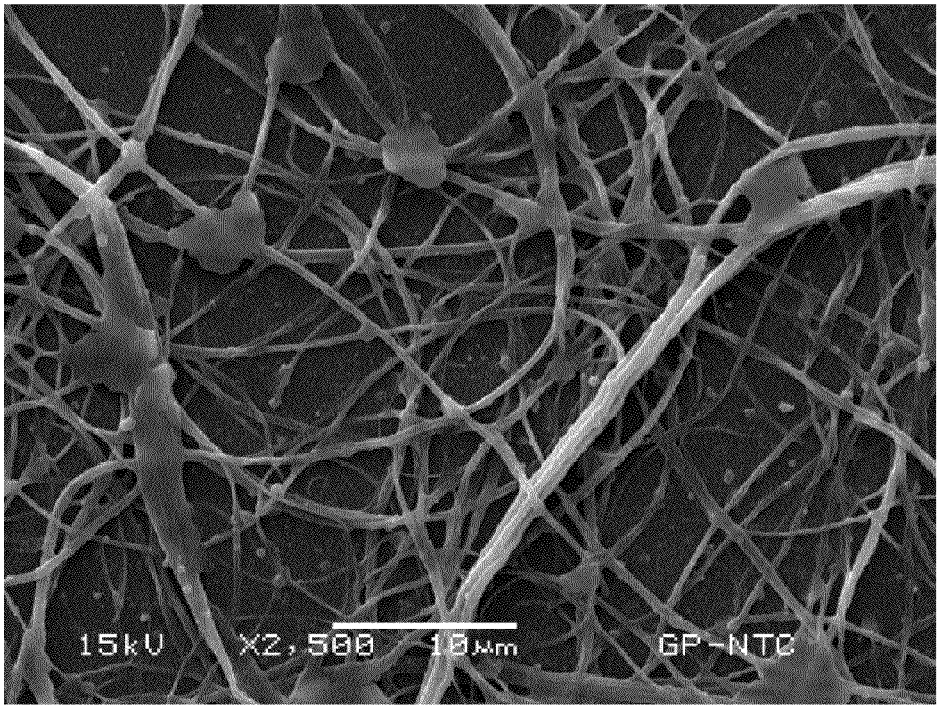
FIG. 5 depicts a photomicrograph of 200 mesh refined, regenerated cellulose fiber, according to one or more embodiments described.
Figure 6:
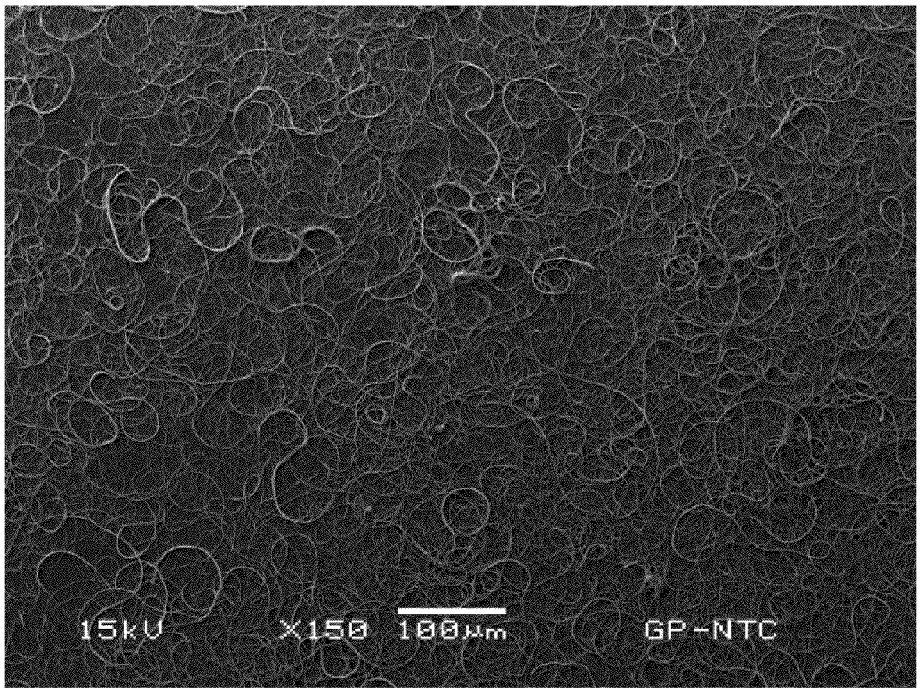
FIGS. 6-10 are photomicrographs at increasing magnification of fibrillated, regenerated cellulose microfiber passed through a 200 mesh screen of a Bauer-McNett classifier, according to one or more embodiments described.
Figure 7:
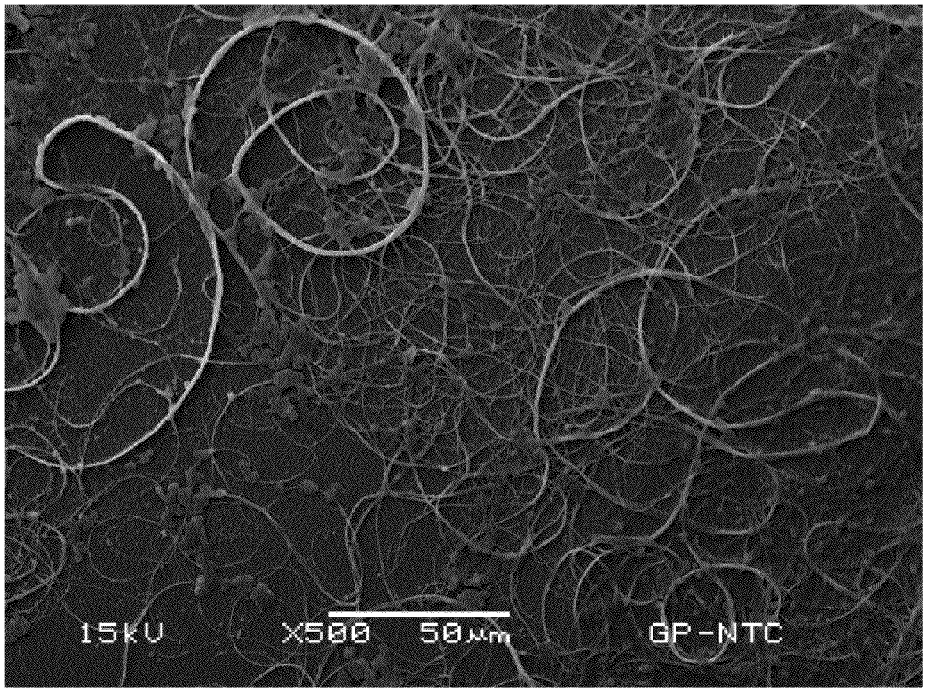
Figure 8:
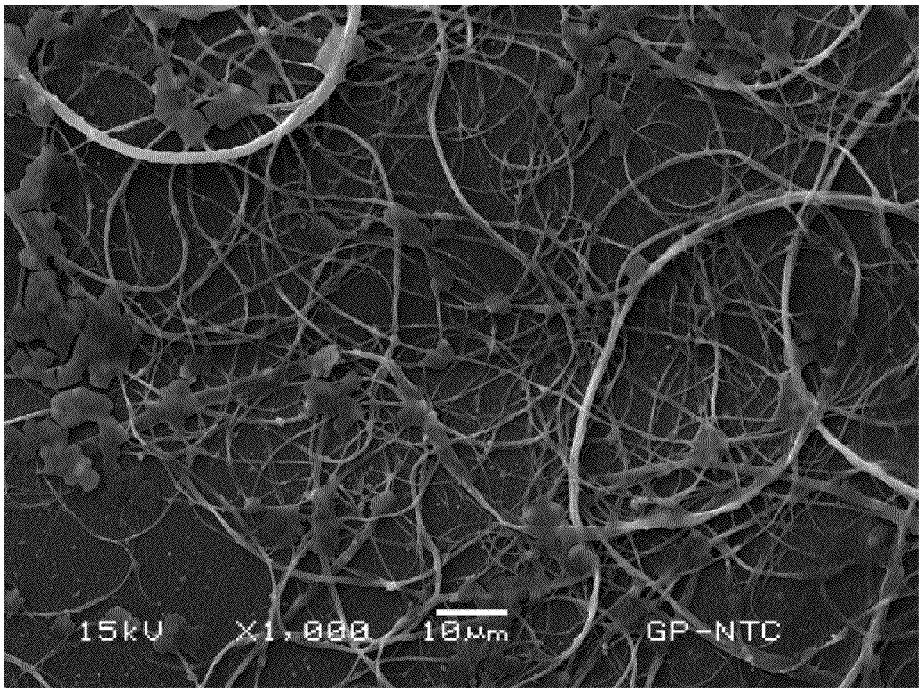
Figure 9:
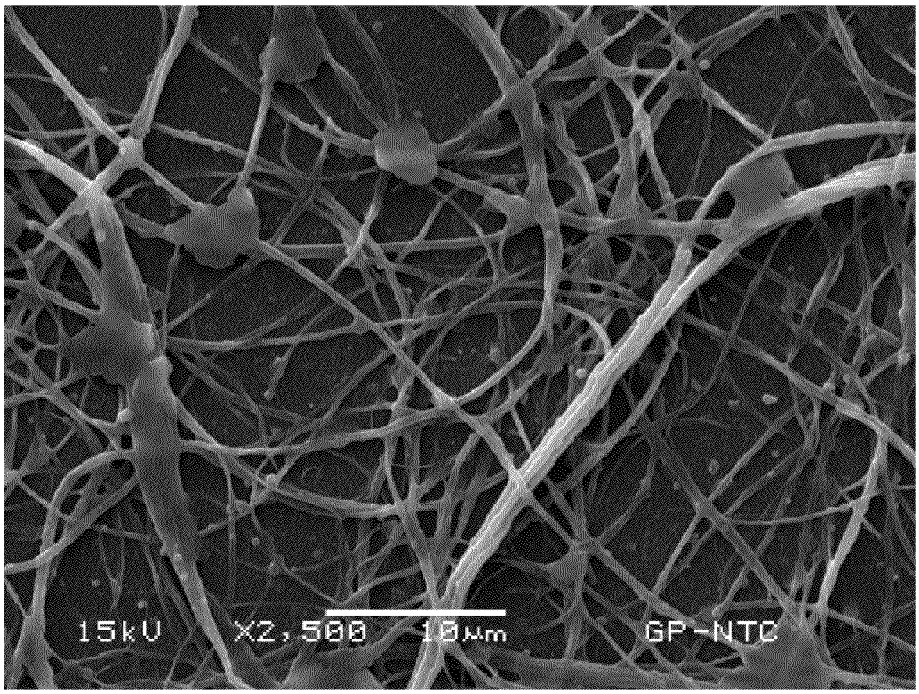
Figure 10:
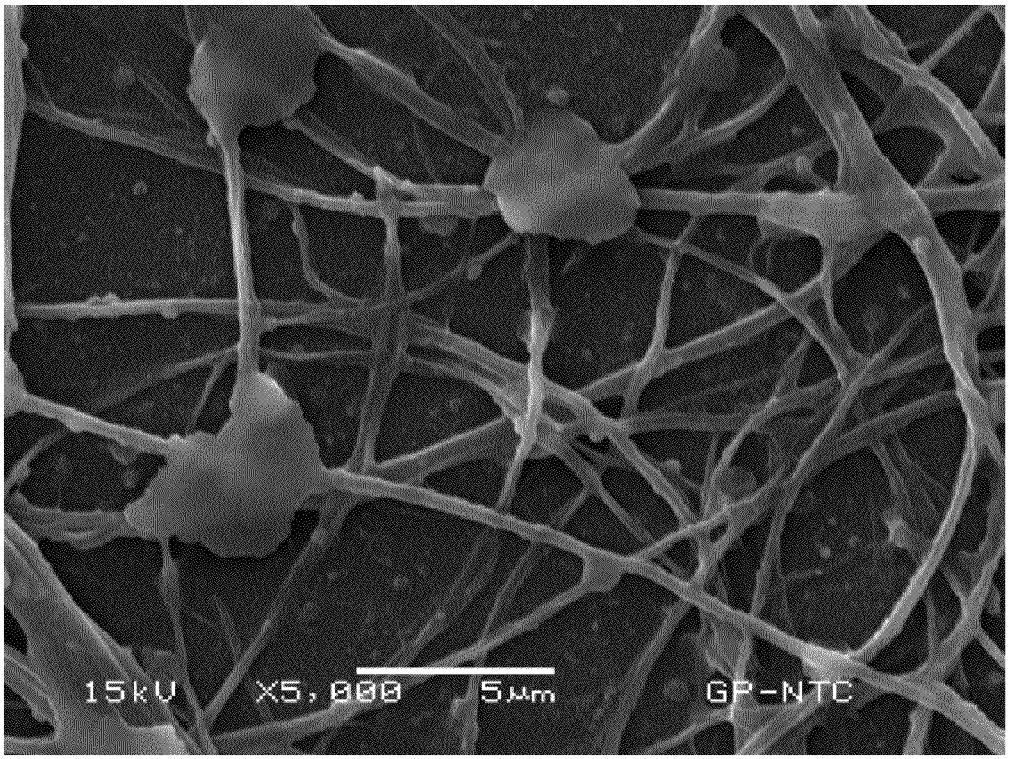
Figure 11:
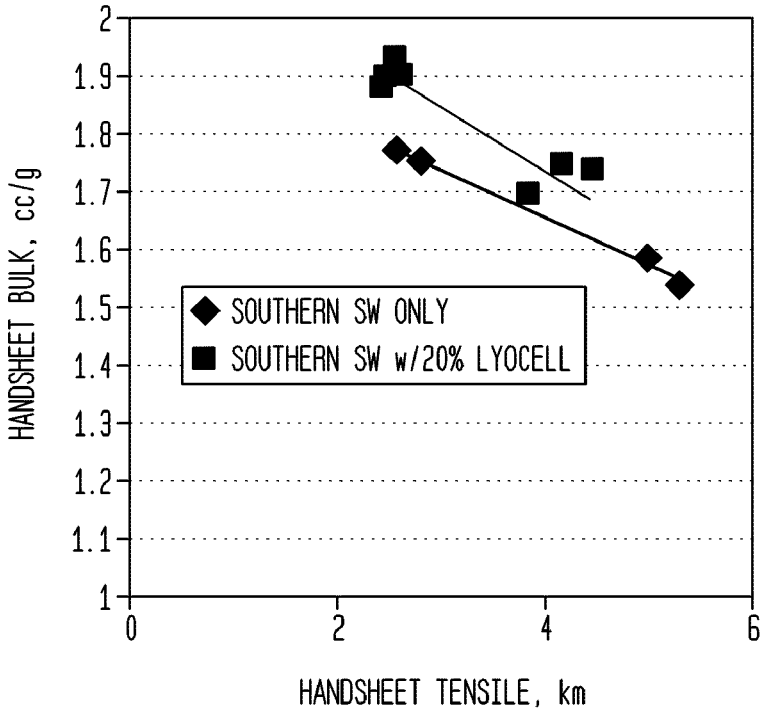
FIG. 11 illustrates a graph of hand sheet bulk versus tensile (i.e., breaking length) of handsheets including regenerated cellulose microfiber, according to one or more embodiments described.

A hand sheet study was conducted with southern softwood and fibrillated lyocell fiber. FIG. 3 is a photomicrograph of stock lyocell fiber of 1.5 denier (e.g., 16.6 mg/100 m) by 4 mm in length, which was fibrillated until the freeness was less than about 50 CSF. FIG. 4 shows a photomicrograph of 14 mesh refined regenerated cellulose, and FIG. 5 shows a photomicrograph of 200 mesh refined regenerated cellulose fiber. It will be appreciated from FIGS. 4 and 5, that the fibrillated fiber has a much lower coarseness than the stock fiber.

FIGS. 6-10 show photomicrographs of fibrillated lyocell material at increasing magnification, wherein the fibrillated lyocell material has been passed through the 200 mesh screen of a Bauer-McNett classifier. This material can be referred to as "fines." In wood pulp, fines are mostly particulate rather than fibrous. The fibrous nature of this material may allow it to bridge across multiple fibers and therefore contribute to network strength. This material can make up a substantial amount (for example, about 16 to about 29%) of the 40 csf fibrillated lyocell.

The dimensions of the fibers passing the 200 mesh screen can be between about 0.2 micron diameter by about 100 micron long, as described above. Using these dimensions, the fiber population can be calculated at about 200 billion fibers per gram, as described above. For perspective, southern pine can commonly be three million fibers per gram and eucalyptus can commonly be 20 million fibers per gram (as shown and described above in Table 1). Comparing the fine fraction with the 14 mesh pictures, the fibers may be the fibrils that are broken away from the original unrefined fibers. Different fiber shapes with lyocell can result in 0.2 micron diameter fibers that are perhaps 1000 microns or more long instead of 100, as described above.

FIGS. 11-16 show the impact of fibrillated lyocell on hand sheet properties. Bulk, opacity, smoothness, modulus, and tear improve at a given tensile level. Results are compared as a function of tensile since strength is always an important variable in paper products. Also, Kraft wood pulp tends to fall on similar curves for a given variable, so it is desirable to shift to a new curve to impact finished product properties. Fibrillated lyocell shifts the bulk/strength curve favorably. Some of the microfibers may nest in the voids between the much larger softwood fibers, but the overall result is the lyocell interspersed between softwood fibers with a net increase in bulk.

Figure 12:
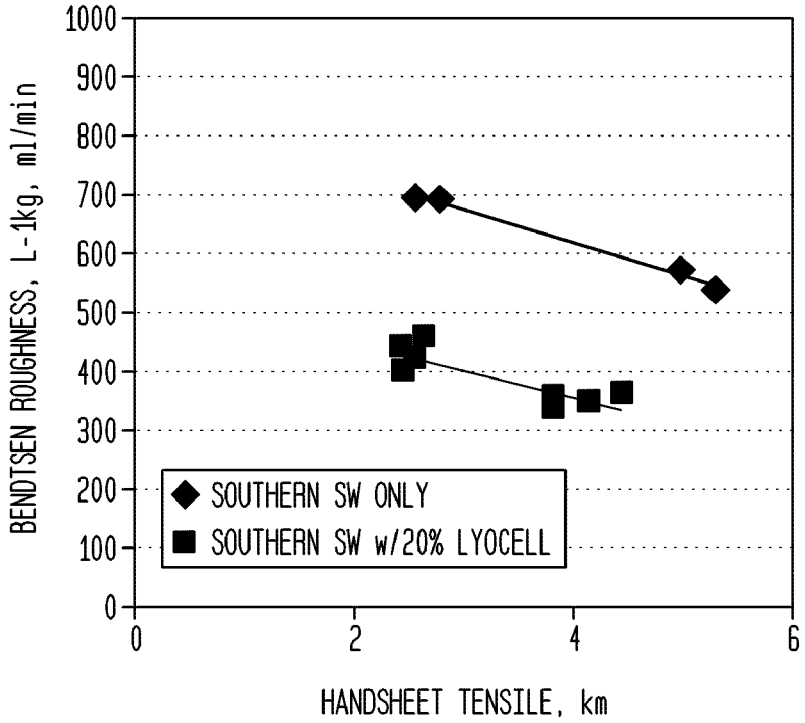
FIG. 12 illustrates a plot of roughness versus tensile of handsheets including regenerated cellulose microfiber, according to one or more embodiments described.

FIG. 12 illustrates fibrillated lyocell increasing smoothness as measured by Bendtsen roughness. Bendtsen roughness is obtained by measuring the air flow between a weighted platten and a paper sample. Smoother sheets permit less air flow. The small fibers can fill in some of the surface voids that would otherwise be present on a 100% softwood sheet. The smoothness impact on an uncreped hand sheet should persist even after the creping process.

Table 11, below, summarizes some of the significant effects derived from Hand Sheet Test #1, and shows the benefits of fibrillated lyocell. These benefits are also shown in FIGS. 11-16, and include higher bulk, better smoothness, higher tear, better opacity, and lower modulus. The purpose for the different treatments was to measure the relative impacts on strength. Southern softwood can be less efficient in developing network strength than northern softwood, so one item of interest is to see if lyocell can enhance southern softwood. The furnish with 20% lyocell and 80% Southern softwood is significantly better than 100% Southern softwood. Bulk, opacity, and tear are higher at a given tensile while roughness and modulus are lower. These trends are directionally favorable for tissue properties. The hand sheets for Table 5 were prepared according to TAPPI Method T-205. Bulk caliper in centimeters cubed per gram is obtained by dividing caliper by basis weight. Bendtsen roughness is obtained by measuring the air flow between a weighted platten and a paper sample. "L" designates the labeled side of the hand sheet that is against the metal plate during drying while "U" refers to the unlabelled side. ZDT refers to the out-of-plane tensile of the hand sheet.

TABLE 11

Effects on hand sheet properties

| Test | Average Value | SW Refining Effect | Fib. lyocell Effect | Refining-lyocell Interaction |
|---|---|---|---|---|
| Caliper 5 Sheet ($cm^3/g$) | 1.76 | −0.19 | 0.15 | |
| Bendtsen Rough L-1 kg (mL/min) | 466 | −235 | −101 | 28 (95%) |
| Bendtsen Rough U-1 kg (mL/min) | 1482 | 137 (95%) | | |
| ZDT Fiber Bond (psi) | 49 | 36 | −11 | −13 |
| Tear HS, g | 120 | | 20 (95%) | |
| Opacity TAPPI | 77 | −4 | 13 | |
| Breaking Length, km | 3.5 | 1.8 | −0.6 (95%) | |
| Stretch Hand Sheet, % | 2.4 | 0.9 | | −0.4 (95%) |
| Tensile Energy Hand Sheet, kg-mm | 6.7 | 5.3 | | −1.9 (95%) |
| Tensile Modulus Hand Sheet, $kg/mm^2$ | 98 | 28 | −18 | |

Figure 13:
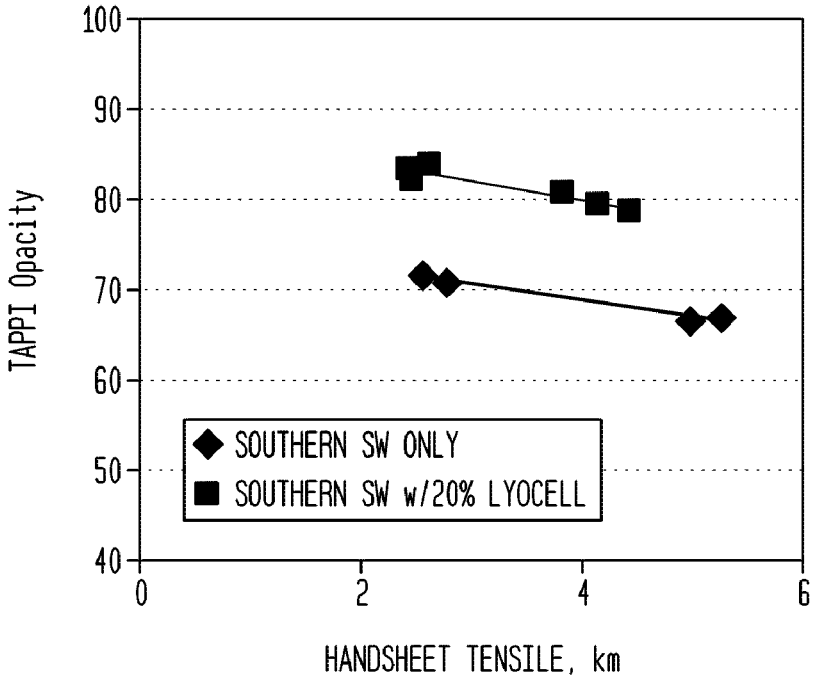
FIG. 13 illustrates a plot of opacity versus tensile of handsheets including regenerated cellulose microfiber, according to one or more embodiments described.

FIG. 13 illustrates opacity, wherein the opacity of the material is improved by the lyocell. The large quantity of microfibers creates an increased surface area for light scattering, which can yield opacity in the 80s. It will be appreciated that low 80s for opacity can be equivalent to 100% eucalyptus sheets.

FIG. 14 illustrates hand sheet modulus, which is lower at a given tensile with the lyocell. It will be appreciated that, with lower hand sheet modulus, "drapability" improves. The large number of fibers fills in the network better and allows more even distribution of stress. One of the deficiencies of southern softwood is its tendency to obtain lower stretch in creped tissue than northern softwood. Lyocell can help address this deficiency.

Figure 15:
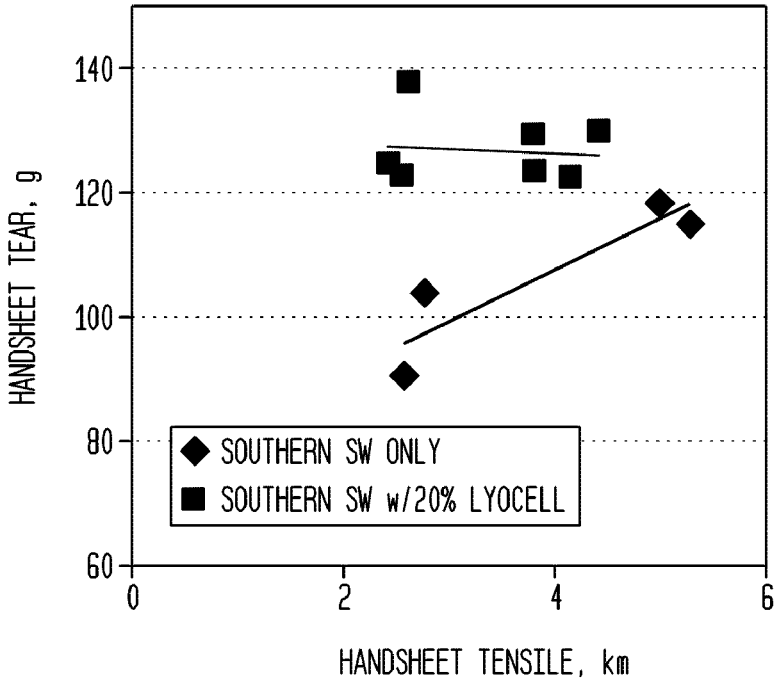
FIG. 15 illustrates a plot of hand sheet tear versus tensile of handsheets including regenerated cellulose microfiber, according to one or more embodiments described.
Figure 16:
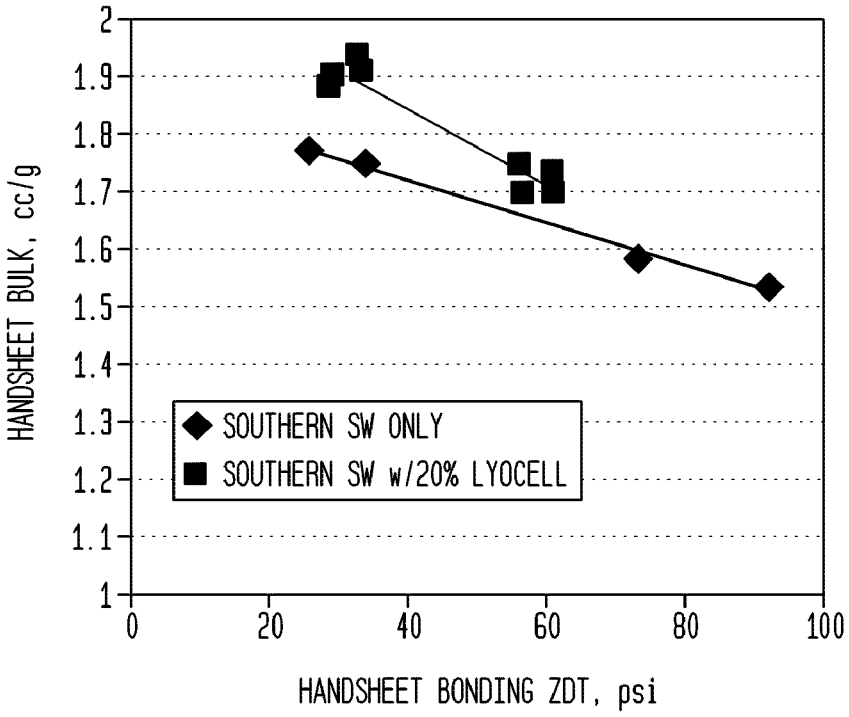
FIG. 16 illustrates a plot of hand sheet bulk versus ZDT bonding of handsheets including regenerated cellulose microfiber, according to one or more embodiments described.

FIG. 15 illustrates that fibrillated lyocell improves hand sheet tear in southern softwood. Southern softwood is often noted for its tear strength relative to other Kraft pulps, so it is notable that the fibrillated lyocell increases tear in softwood hand sheets. Softwood fibers can provide network strength while hardwood fibers provide smoothness and opacity. The fibrillated lyocell can be sufficiently long to improve the network properties while its low coarseness provides the benefits of hardwood.

Table 12, below, compares the morphology of lyocell and softwood fibers as measured by the OpTest optical Fiber Quality Analyzer. The stock lyocell fibers (as shown in FIG. 3 and described above with reference thereto) have a coarseness of 16.7 mg/100 m, similar to southern softwood coarseness (20 mg/100 m). After fibrillation, the FQA measured coarseness drops to 11.9, similar to northern softwood. It is likely that resolution of the FQA instrument is unable to accurately measure the length, width, or coarseness of the very fine fibrils. Commonly, the smallest fine particle the FQA records is 41 microns, and the narrowest width the FQA records is 7 microns. Thus, it will be appreciated that the coarseness value of 11.9 mg/100 m is not representative of the fibrillated lyocell, and the average coarseness of the lyocell is less than 11.9 mg/100 m measured by the FQA.

Figure 17:
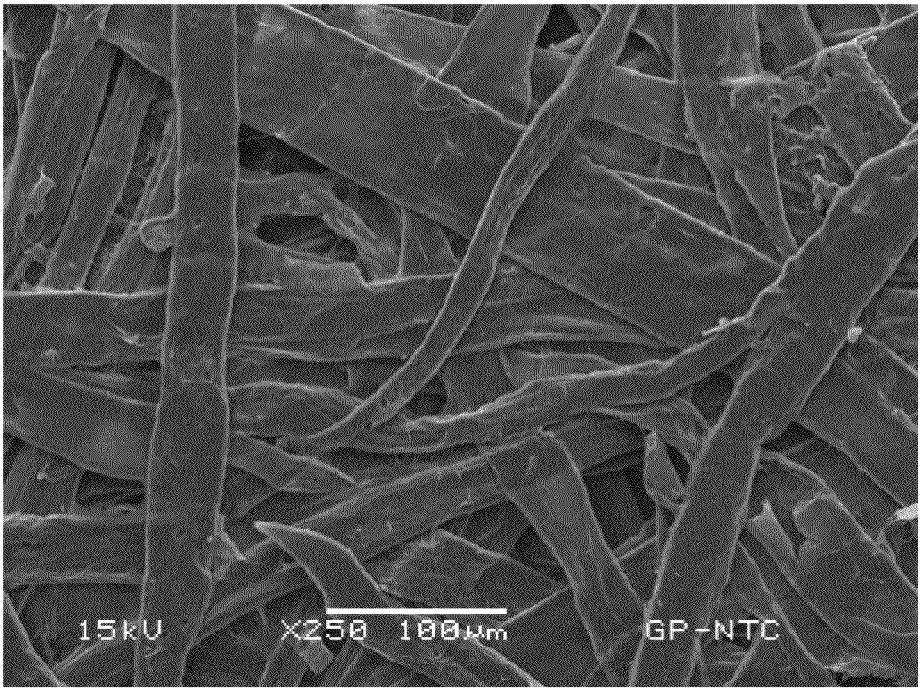
FIG. 17 depicts a photomicrograph at 250 magnification of a softwood handsheet without fibrillated regenerated cellulose fiber, according to one or more embodiments described.
Figure 18:
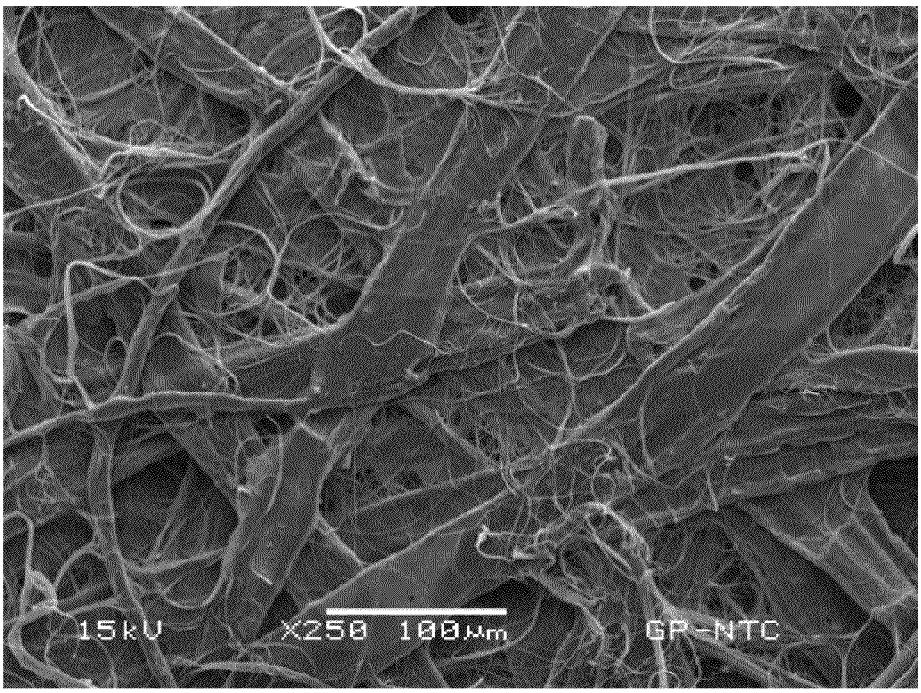
FIG. 18 depicts a photomicrograph at 250 magnification of a softwood handsheet incorporating fibrillated regenerated cellulose microfiber, according to one or more embodiments described.

Differences in fiber size are better appreciated by comparing FIGS. 17 and 18. FIG. 17 is a photomicrograph made with only southern softwood Kraft refined 1000 revolutions in a PFI mill, while FIG. 18 is a photomicrograph of a hand sheet made with 80% of the same southern softwood and 20% refined lyocell fiber. The low coarseness of the fibrillated lyocell relative to conventional wood pulp can be appreciated from a comparison of the photomicrographs.

TABLE 12

| Morphology of fibrillated lyocell versus whole lyocell and softwood | | | |
|---|---|---|---|
| OpTest FQA | Fib. lyocell | lyocell, 1.5 denier | Southern Softwood |
| Ln, mm | 0.38 | 2.87 | 0.68 |
| Lw, mm | 1.64 | 3.09 | 2.40 |
| Lz, mm | 2.58 | 3.18 | 3.26 |
| Fines(n), % | 67.4 | 2.9 | 64.0 |
| Fines(w), % | 16.3 | 0.1 | 8.5 |
| Curl Index (w) | 0.36 | 0.03 | 0.19 |
| Width, μm | 16.5 | 20.1 | 29.9 |
| Coarseness, mg/100 m | 11.9 | 16.7 | 20.5 |
| CSF, mL | 22 | | 746 |

The degree of fibrillation is measured by Canadian Standard Freeness (csf). Unrefined lyocell has a freeness of about 800 mL, and trial quantities were obtained at about 400, 200, and 40 mL. As shown, 4 mm lyocell was refined to a freeness of only 22 mL with an average fiber length (Lw) of 1.6 mm.

combined to form a second fraction hereafter referred to as "Shorts". Southern softwood was prepared by refining it 1000 revolutions in a PFI mill. Hand sheets were prepared at 15 lb/ream basis weight, pressed at 15 psi for five minutes, and dried on a steam-heated drum. Table 13 compares hand sheets made with different combinations of softwood and fibrillated lyocell. Softwood alone (Sample 1) has low opacity, low stretch, and low tensile. Twenty percent longs (Sample 2) improves opacity and stretch modestly, but not tensile. Twenty percent Shorts (Sample 3) greatly increases opacity, stretch, and tensile, more so than the whole lyocell (Sample 4). Sample 5 used recombined Longs and Shorts to approximate the original fibrillated lyocell. It can be appreciated from this example that the shorts are the dominant contributor to the present invention. Microfiber decreases the average pore size and increases smoothness of cellulosic sheet including foodwrap base sheet. Such are highly desirable attributes, especially for coated and printed end-products as is seen in the following porosity and roughness data.

TABLE 13

| 15 lb/ream hand sheets with different components of fibrillated lyocell | | | | | | |
|---|---|---|---|---|---|---|
| Sample | Description | Opacity TAPPI Opacity Units | Stretch Handsht % | Breaking Length km | Bulk $cm^3/g$ | Basis Weight lb/ream |
| 1 | 100% southern softwood | 46 | 0.7 | 0.75 | 2.92 | 14.3 |
| 2 | 80% southern softwood/20% fib. lyocell Longs | 52 | 0.9 | 0.73 | 3.09 | 15.4 |
| 3 | 80% southern softwood/20% fib. lyocell Shorts | 65 | 1.4 | 0.98 | 2.98 | 15.0 |
| 4 | 80% southern softwood/20% fib. lyocell Whole | 61 | 1.3 | 0.95 | 2.81 | 15.7 |
| 5 | 80% southern softwood/10% fib. lyocell Longs/ 10% fib. lyocell Shorts | 59 | 1.3 | 0.92 | 2.97 | 14.9 |

Longs = 14 mesh + 28 mesh fractions
Shorts = 48 mesh + 100 mesh + 200 mesh + material passing through 200 mesh Hand Sheet Study #2

This hand sheet study demonstrates that the benefit of fibrillated lyocell is obtained predominantly from short, low coarseness fibrils rather than partially refined parent fibers unintentionally persisting after the refining process. Six mm by 1.5 denier lyocell was refined to 40 freeness and fractionated in a Bauer McNett classifier using screens with meshes of 14, 28, 48, 100, and 200. Fiber length is a primary factor in determining the passage of fibers through each screen. The 14 and 28 mesh fractions were combined to form one fraction hereafter referred to as "Longs". The 48, 100, 200 mesh fractions and the portion passing through the 200 mesh were The apparatus shown in FIG. 19, and described above with reference thereto, can be used for measurement by extrusion porosimetry in an uncompressed mode. Using water with 0.1% TX-100 wetting agent, having a surface tension of 30 dyne/cm, as the absorbed/extruded liquid, the PVD of a variety of samples were measured by extrusion porosimetry in an uncompressed mode. Alternatively, the test can be conducted in an intrusion mode if so desired.

Sample A was a CWP base sheet prepared from 100% northern bleached softwood Kraft (NBSK) fiber. Sample B was a like CWP sheet made with 25% regenerated cellulose microfiber and sample C was also a like CWP sheet made with 50% regenerated cellulose microfiber and 50% NBSK fiber. Details and results appear in Table 13 below, and in FIGS. 20-22 for these samples. The pore radius intervals are indicated in Cols. 1 and 4 only for brevity.

TABLE 14

| CWP Porosity Distribution | | | | | | | | | | | | |
|---|---|---|---|---|---|---|---|---|---|---|---|---|
| Pore Radius, micron | Capillary Pressure, mmH2O | Cumul. Pore Volume Sample A, $mm^3/mg$ | Cumul. Pore Volume Sample A, % | Pore Radius, micron | Pore Volume Sample A, $mm^3/(um * g)$ | Cumul. Pore Volume Sample B, $mm^3/mg$ | Cumul. Pore Volume Sample B, % | Pore Volume Sample B, $mm^3/(um * g)$ | Cumul. Pore Volume Sample C, $mm^3/mg$ | Cumul. Pore Volume Sample C, % | Pore Volume Sample C, $mm^3/(um * g)$ | Capillary Pressure, $mmH_2O$ |
| 500 | 12 | 7.84 | 100 | 400 | 5.518 | 5.843 | 100 | 3.943 | 5.5 | 100 | 2.806 | 12.3 |
| 300 | 20 | 6.74 | 85.93 | 250 | 10.177 | 5.054 | 86.5 | 8.25 | 4.938 | 89.79 | 3.979 | 20.4 |

TABLE 14-continued

CWP Porosity Distribution

| Pore Radius, micron | Capillary Pressure, mmH2O | Cumul. Pore Volume Sample A, $mm^3/mg$ | Cumul. Pore Volume Sample A, % | Pore Radius, micron | Pore Volume Sample A, $mm^3/(um * g)$ | Cumul. Pore Volume Sample B, $mm^3/mg$ | Cumul. Pore Volume Sample B, % | Pore Volume Sample B, $mm^3/(um * g)$ | Cumul. Pore Volume Sample C, $mm^3/mg$ | Cumul. Pore Volume Sample C, % | Pore Volume Sample C, $mm^3/(um * g)$ | Capillary Pressure, $mmH_2O$ |
|---|---|---|---|---|---|---|---|---|---|---|---|---|
| 200 | 31 | 5.72 | 72.95 | 187.5 | 13.902 | 4.229 | 72.38 | 9.482 | 4.54 | 82.56 | 4.336 | 30.6 |
| 175 | 35 | 5.38 | 68.52 | 162.5 | 12.933 | 3.992 | 68.33 | 8.642 | 4.432 | 80.59 | 4.425 | 35 |
| 150 | 41 | 5.05 | 64.4 | 137.5 | 13.693 | 3.776 | 64.63 | 7.569 | 4.321 | 78.58 | 4.9 | 40.8 |
| 125 | 49 | 4.71 | 60.04 | 117.5 | 15.391 | 3.587 | 61.39 | 9.022 | 4.199 | 76.35 | 4.306 | 49 |
| 110 | 56 | 4.48 | 57.09 | 105 | 14.619 | 3.452 | 59.07 | 7.595 | 4.134 | 75.18 | 3.86 | 55.7 |
| 100 | 61 | 4.33 | 55.23 | 95 | 13.044 | 3.376 | 57.78 | 7.297 | 4.096 | 74.47 | 4.009 | 61.3 |
| 90 | 68 | 4.20 | 53.57 | 85 | 15.985 | 3.303 | 56.53 | 6.649 | 4.056 | 73.74 | 2.821 | 68.1 |
| 80 | 77 | 4.04 | 51.53 | 75 | 18.781 | 3.236 | 55.39 | 4.818 | 4.027 | 73.23 | 2.45 | 76.6 |
| 70 | 88 | 3.85 | 49.13 | 65 | 18.93 | 3.188 | 54.56 | 4.811 | 4.003 | 72.79 | 3.192 | 87.5 |
| 60 | 102 | 3.66 | 46.72 | 55 | 30.441 | 3.14 | 53.74 | 0.806 | 3.971 | 72.21 | 0.445 | 102.1 |
| 50 | 123 | 3.36 | 42.84 | 47.5 | 40.749 | 3.132 | 53.6 | 11.021 | 3.967 | 72.12 | 13.512 | 122.5 |
| 45 | 136 | 3.16 | 40.24 | 42.5 | 48.963 | 3.077 | 52.66 | 15.027 | 3.899 | 70.9 | 21.678 | 136.1 |
| 40 | 153 | 2.91 | 37.12 | 37.5 | 65.448 | 3.002 | 51.37 | 17.22 | 3.791 | 68.93 | 34.744 | 153.1 |
| 35 | 175 | 2.58 | 32.95 | 32.5 | 83.255 | 2.916 | 49.9 | 25.44 | 3.617 | 65.77 | 53.155 | 175 |
| 30 | 204 | 2.17 | 27.64 | 27.5 | 109.136 | 2.788 | 47.72 | 36.333 | 3.351 | 60.93 | 89.829 | 204.2 |
| 25 | 245 | 1.62 | 20.68 | 22.5 | 94.639 | 2.607 | 44.61 | 69.934 | 2.902 | 52.77 | 119.079 | 245 |
| 20 | 306 | 1.15 | 14.65 | 18.75 | 82.496 | 2.257 | 38.63 | 104.972 | 2.307 | 41.94 | 104.529 | 306.3 |
| 17.5 | 350 | 0.94 | 12.02 | 16.25 | 71.992 | 1.995 | 34.14 | 119.225 | 2.045 | 37.19 | 93.838 | 350 |
| 15 | 408 | 0.76 | 9.73 | 13.75 | 55.568 | 1.697 | 29.04 | 125.643 | 1.811 | 32.92 | 92.65 | 408.3 |
| 12.5 | 490 | 0.62 | 7.95 | 11.25 | 58.716 | 1.382 | 23.66 | 120.581 | 1.579 | 28.71 | 100.371 | 490 |
| 10 | 613 | 0.48 | 6.08 | 9.5 | 58.184 | 1.081 | 18.5 | 102.703 | 1.328 | 24.15 | 84.632 | 612.5 |
| 9 | 681 | 0.42 | 5.34 | 8.5 | 71.164 | 0.978 | 16.74 | 119.483 | 1.244 | 22.61 | 104.677 | 680.6 |
| 8 | 766 | 0.35 | 4.43 | 7.5 | 65.897 | 0.859 | 14.7 | 92.374 | 1.139 | 20.71 | 94.284 | 765.6 |
| 7 | 875 | 0.28 | 3.59 | 6.5 | 78.364 | 0.766 | 13.12 | 116.297 | 1.045 | 18.99 | 103.935 | 875 |
| 6 | 1021 | 0.20 | 2.6 | 5.5 | 93.96 | 0.65 | 11.13 | 157.999 | 0.941 | 17.1 | 83.148 | 1020.8 |
| 5 | 1225 | 0.11 | 1.4 | 4.5 | 21.624 | 0.492 | 8.42 | 91.458 | 0.857 | 15.59 | 97.996 | 1225 |
| 4 | 1531 | 0.09 | 1.12 | 3.5 | 23.385 | 0.401 | 6.86 | 120.222 | 0.759 | 13.81 | 198.218 | 1531.3 |
| 3 | 2042 | 0.07 | 0.82 | 2.5 | 64.584 | 0.28 | 4.8 | 176.691 | 0.561 | 10.21 | 311.062 | 2041.7 |
| 2 | 3063 | 0.00 | 0 | 1.5 | 12.446 | 0.104 | 1.78 | 103.775 | 0.25 | 4.55 | 250.185 | 3062.5 |
| 1 | 6125 | 0.01 | 0.16 | | | 0 | 0 | | 0 | 0 | | 6125 |
| | | | AVG | | | | AVG | | | AVG | | |
| | | | 73.6 | | | | 35.3 | | | 23.7 | | |
| | | | | | Wicking ratio (Sample A/Sample B) | | 2.1 | | (Sample A/Sample C) | 3.1 | | |

Figure 20:
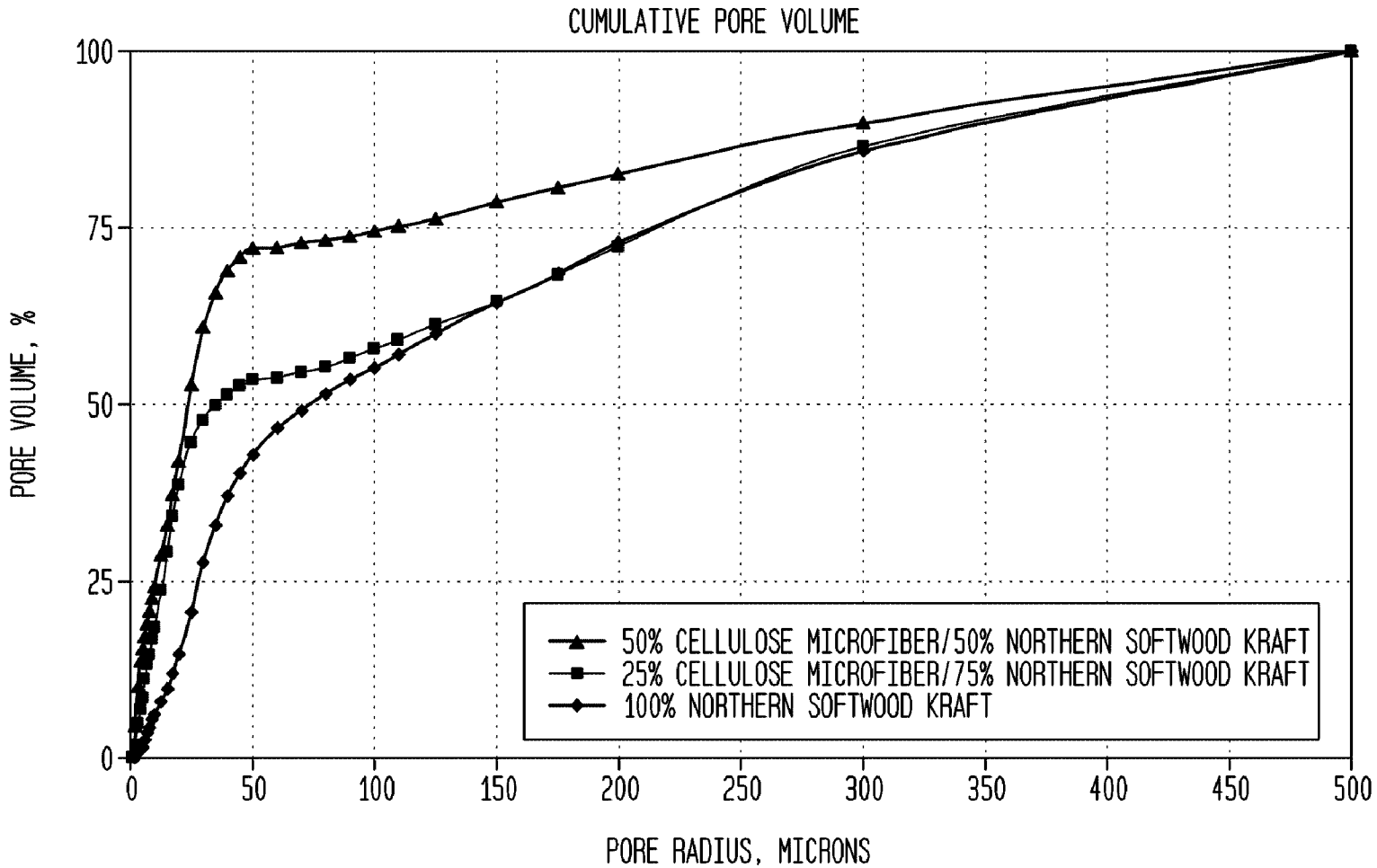
FIG. 20 illustrates a plot of pore volume in percent versus pore radius in microns for various sheets, according to one or more embodiments described.
Figure 21:
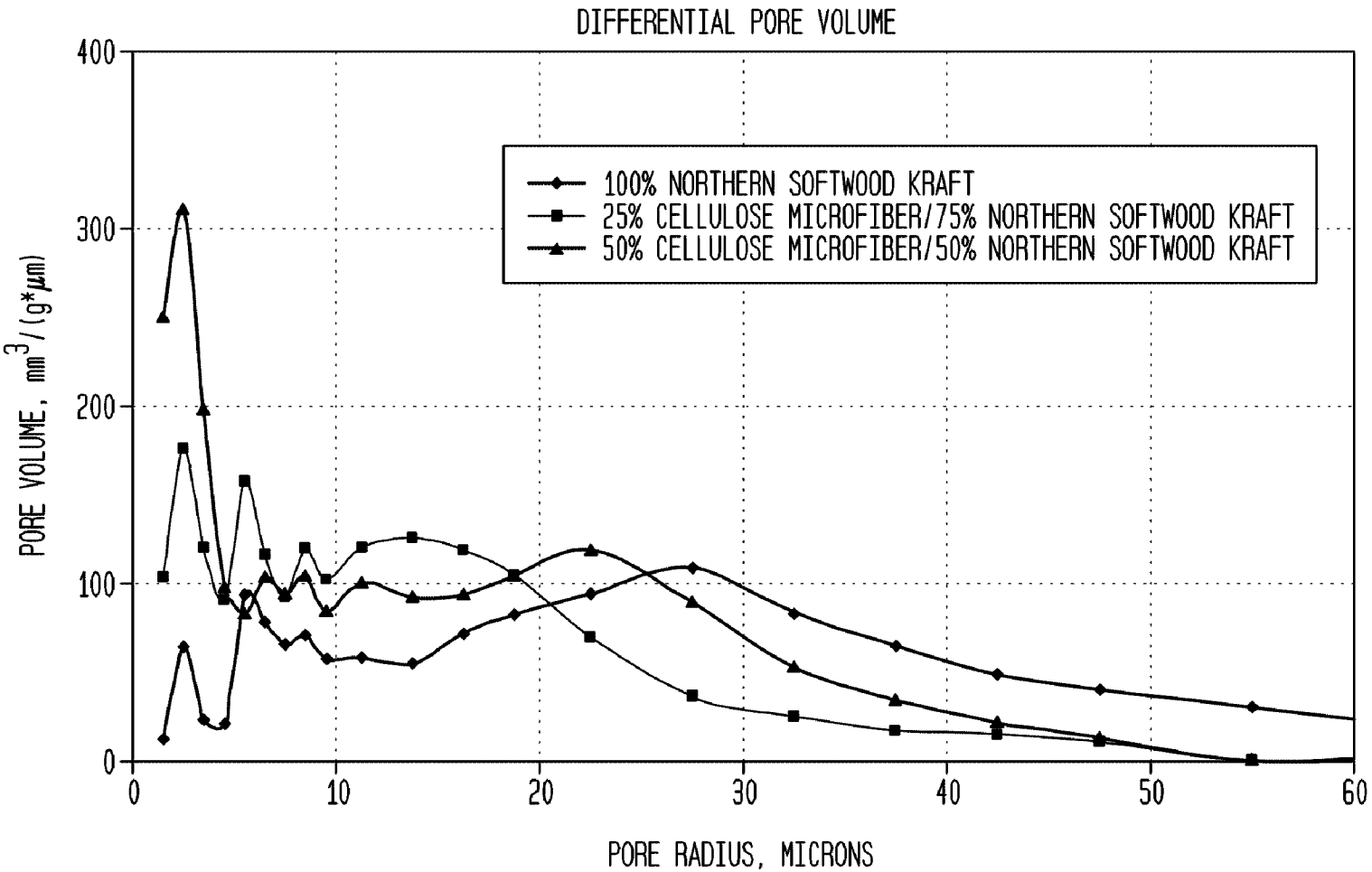
FIG. 21 illustrates a plot of pore volume, according to one or more embodiments described.
Figure 22:
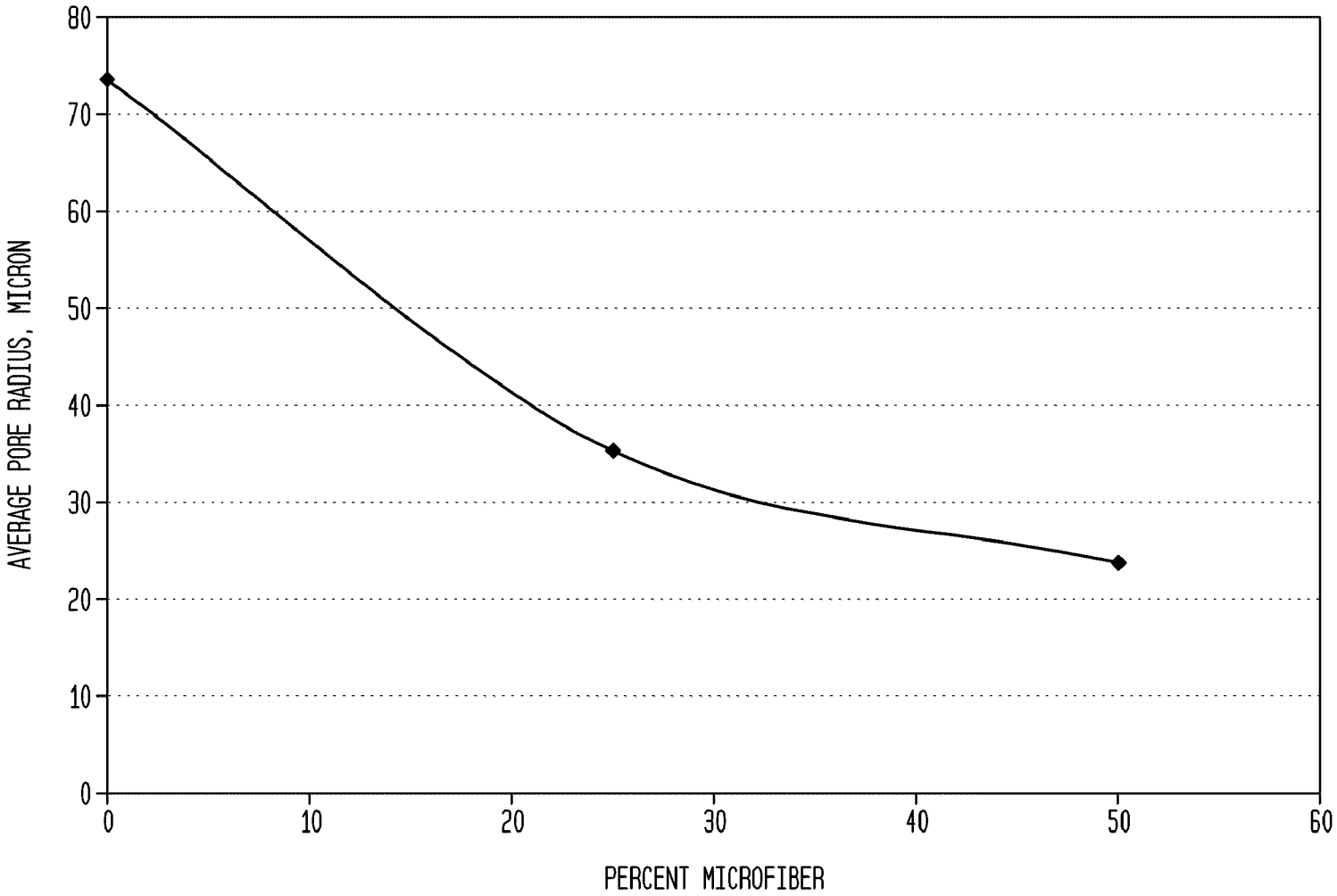
FIG. 22 illustrates a plot of average pore radius in microns versus microfiber content for softwood Kraft sheets, according to one or more embodiments described.

It is seen in Table 14, above, and FIGS. 20-22, that the three samples respectively had average or median pore sizes of 74, 35 and 24 microns. Using the Laplace equation discussed above, the relative driving forces (Delta P) for 25% and 50% microfiber were 2 to 3 times greater than the control: (74/35=2), (74/24=3). The Bendtsen smoothness data (discussed below) imply more intimate contact with the surface while the higher driving force from the smaller pores indicate greater ability to pick up small droplets remaining on the surface. An advantage that cellulose has over other polymeric surfaces such as nylon, polyester and polyolefins is the higher surface energy of cellulose which attracts and wicks liquid residue away from lower energy surfaces such as glass, metals and so forth.

For purposes of convenience, the relative wicking ratio of a microfiber containing sheet is generally defined to be the ratio of the average pore effective sizes of a like sheet without microfiber to a sheet containing microfiber. Thus, the Sample B and C sheets had relative wicking ratios of approximately 2 and 3 as compared with the control Sample A. While the wicking ratio readily differentiates single ply CWP sheet made with cmf from a single ply sheet made with NBSK alone, more universal indicators of differences achieved with cmf fiber are high differential pore volumes at small pore radius (less than about 10-15 microns) as well as high capillary pressures at low saturation as is seen with two-ply wipers and handsheets A series of two ply CWP sheets were prepared and tested for porosity, following the described procedures. Sample D was a control, prepared with NBSK fiber and without cmf, Sample E was a two ply sheet with 75% by weight NBSK fiber and 25% by weight cmf, and Sample F was a two ply sheet with 50% by weight NBSK fiber and 50% by weight cmf. Results appear in Table 10 and are presented graphically in FIG. 23.

TABLE 15

Two-Ply Sheet Porosity Data

| Pore Radius, micron | Capillary Pressure, $mmH_2O$ | Cumulative (Cumul.) Pore Volume Sample D, $mm^3/mg$ | Cumul. Pore Volume Sample D, % | Pore Radius, micron | Pore Volume Sample D, $mm^3/(um * g)$ | Cumul. Pore Volume Sample E, $mm^3/mg$ | Cumul. Pore Volume Sample E, % | Pore Volume Sample E, $mm^3/(um * g)$ | Cumul. Pore Volume Sample F, $mm^3/mg$ | Cumul. Pore Volume Sample F, % | Pore Volume Sample F, $mm^3/(um * g)$ |
|---|---|---|---|---|---|---|---|---|---|---|---|
| 500 | 12 | 11.700 | 100.0 | 400.0 | 12.424 | 11.238 | 100.0 | 14.284 | 13.103 | 100.0 | 12.982 |
| 300 | 20 | 9.216 | 78.8 | 250.0 | 8.925 | 8.381 | 74.6 | 9.509 | 10.507 | 80.2 | 14.169 |
| 200 | 31 | 8.323 | 71.1 | 187.5 | 11.348 | 7.430 | 66.1 | 12.618 | 9.090 | 69.4 | 23.661 |
| 175 | 35 | 8.039 | 68.7 | 162.5 | 14.277 | 7.115 | 63.3 | 12.712 | 8.498 | 64.9 | 27.530 |
| 150 | 41 | 7.683 | 65.7 | 137.5 | 15.882 | 6.797 | 60.5 | 14.177 | 7.810 | 59.6 | 23.595 |
| 125 | 49 | 7.285 | 62.3 | 117.5 | 20.162 | 6.443 | 57.3 | 18.255 | 7.220 | 55.1 | 47.483 |
| 110 | 56 | 6.983 | 59.7 | 105.0 | 22.837 | 6.169 | 54.9 | 18.097 | 6.508 | 49.7 | 34.959 |
| 100 | 61 | 6.755 | 57.7 | 95.0 | 26.375 | 5.988 | 53.3 | 24.786 | 6.158 | 47.0 | 35.689 |
| 90 | 68 | 6.491 | 55.5 | 85.0 | 36.970 | 5.740 | 51.1 | 29.910 | 5.801 | 44.3 | 41.290 |
| 80 | 77 | 6.121 | 52.3 | 75.0 | 57.163 | 5.441 | 48.4 | 33.283 | 5.389 | 41.1 | 50.305 |
| 70 | 88 | 5.550 | 47.4 | 65.0 | 88.817 | 5.108 | 45.5 | 45.327 | 4.885 | 37.3 | 70.417 |
| 60 | 102 | 4.661 | 39.8 | 55.0 | 87.965 | 4.655 | 41.4 | 55.496 | 4.181 | 31.9 | 64.844 |
| 50 | 123 | 3.782 | 32.3 | 47.5 | 93.089 | 4.100 | 36.5 | 69.973 | 3.533 | 27.0 | 57.847 |
| 45 | 136 | 3.316 | 28.3 | 42.5 | 90.684 | 3.750 | 33.4 | 73.408 | 3.244 | 24.8 | 70.549 |
| 40 | 153 | 2.863 | 24.5 | 37.5 | 71.681 | 3.383 | 30.1 | 60.294 | 2.891 | 22.1 | 61.640 |
| 35 | 175 | 2.504 | 21.4 | 32.5 | 69.949 | 3.081 | 27.4 | 64.984 | 2.583 | 19.7 | 60.308 |
| 30 | 204 | 2.155 | 18.4 | 27.5 | 76.827 | 2.756 | 24.5 | 90.473 | 2.281 | 17.4 | 62.847 |
| 25 | 245 | 1.771 | 15.1 | 22.5 | 85.277 | 2.304 | 20.5 | 119.637 | 1.967 | 15.0 | 57.132 |
| 20 | 306 | 1.344 | 11.5 | 18.8 | 83.511 | 1.706 | 15.2 | 110.051 | 1.681 | 12.8 | 56.795 |
| 17.5 | 350 | 1.135 | 9.7 | 16.3 | 83.947 | 1.431 | 12.7 | 89.091 | 1.539 | 11.8 | 62.253 |
| 15 | 408 | 0.926 | 7.9 | 13.8 | 73.671 | 1.208 | 10.8 | 63.423 | 1.384 | 10.6 | 62.246 |
| 12.5 | 490 | 0.741 | 6.3 | 11.3 | 72.491 | 1.049 | 9.3 | 59.424 | 1.228 | 9.4 | 65.881 |
| 10 | 613 | 0.560 | 4.8 | 9.5 | 74.455 | 0.901 | 8.0 | 63.786 | 1.063 | 8.1 | 61.996 |
| 9 | 681 | 0.486 | 4.2 | 8.5 | 68.267 | 0.837 | 7.5 | 66.147 | 1.001 | 7.6 | 69.368 |
| 8 | 766 | 0.417 | 3.6 | 7.5 | 66.399 | 0.771 | 6.9 | 73.443 | 0.932 | 7.1 | 70.425 |
| 7 | 875 | 0.351 | 3.0 | 6.5 | 64.570 | 0.698 | 6.2 | 82.791 | 0.861 | 6.6 | 79.545 |
| 6 | 1021 | 0.286 | 2.5 | 5.5 | 66.017 | 0.615 | 5.5 | 104.259 | 0.782 | 6.0 | 100.239 |
| 5 | 1225 | 0.220 | 1.9 | 4.5 | 70.058 | 0.510 | 4.5 | 119.491 | 0.682 | 5.2 | 122.674 |
| 4 | 1531 | 0.150 | 1.3 | 3.5 | 74.083 | 0.391 | 3.5 | 142.779 | 0.559 | 4.3 | 170.707 |
| 3 | 2042 | 0.076 | 0.7 | 2.5 | 63.471 | 0.248 | 2.2 | 150.017 | 0.388 | 3.0 | 220.828 |
| 2 | 3063 | 0.013 | 0.1 | 1.5 | 12.850 | 0.098 | 0.9 | 98.197 | 0.167 | 1.3 | 167.499 |
| 1 | 6125 | 0.000 | 0.0 | | | 0.000 | 0.0 | | 0.000 | 0.0 | |

Figure 23:
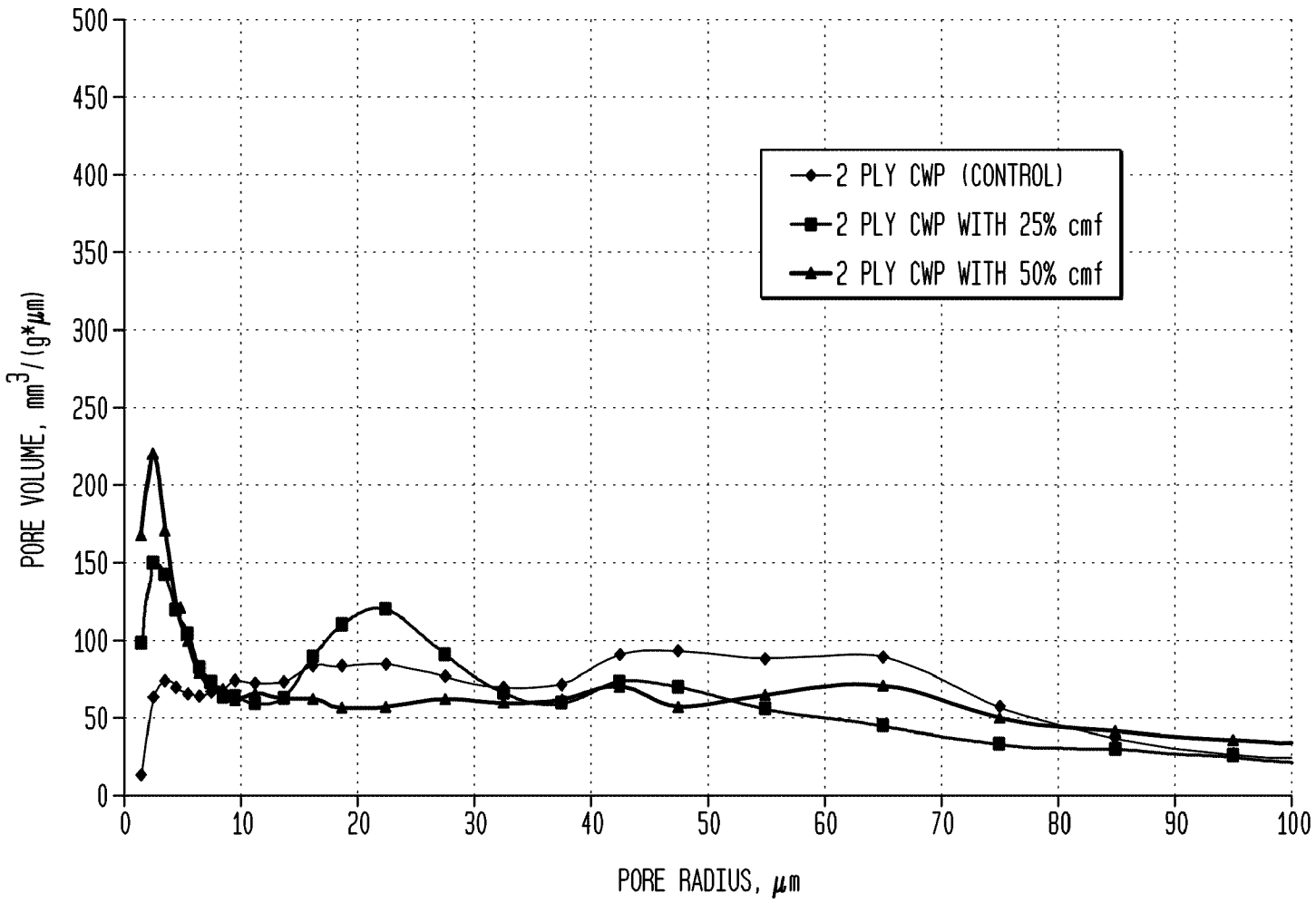
FIG. 23 illustrates a plot of pore volume versus pore radius for sheets with and without cellulose microfiber, according to one or more embodiments described.

It is seen in Table 15 and FIG. 23 that the two ply sheet structure somewhat masks the pore structure of individual sheets. Thus, for purposes of calculating wicking ratio, single plies should be used.

The porosity data for the cmf containing two ply sheet is nevertheless unique in that a relatively large fraction of the pore volume is at smaller radii pores, below about 15 microns. Similar behavior is seen in handsheets, discussed below.

Figure 24:
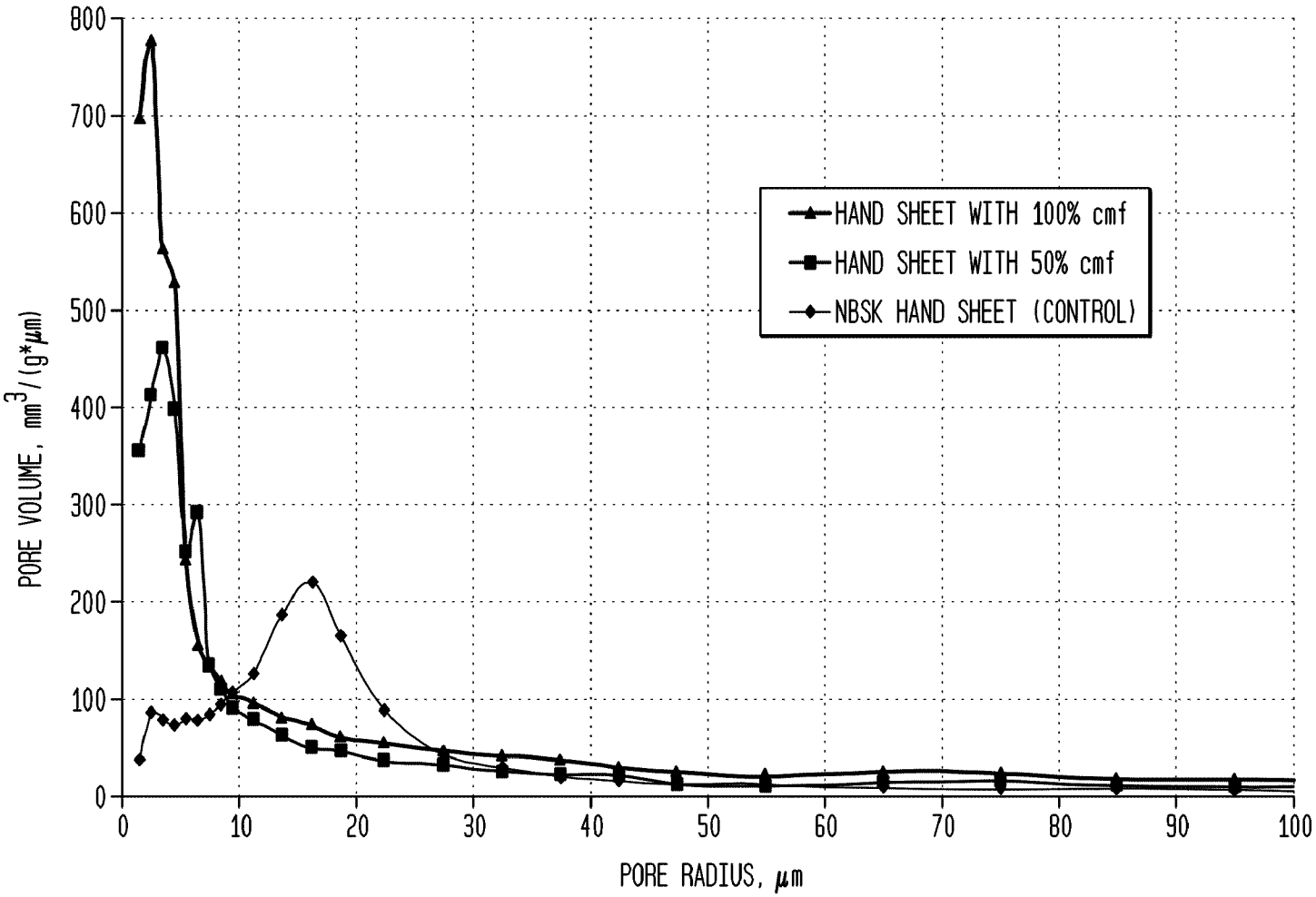
FIG. 24 illustrates another plot of pore volume versus pore radius for sheets with and without cellulose microfiber, according to one or more embodiments described.
Figure 25:
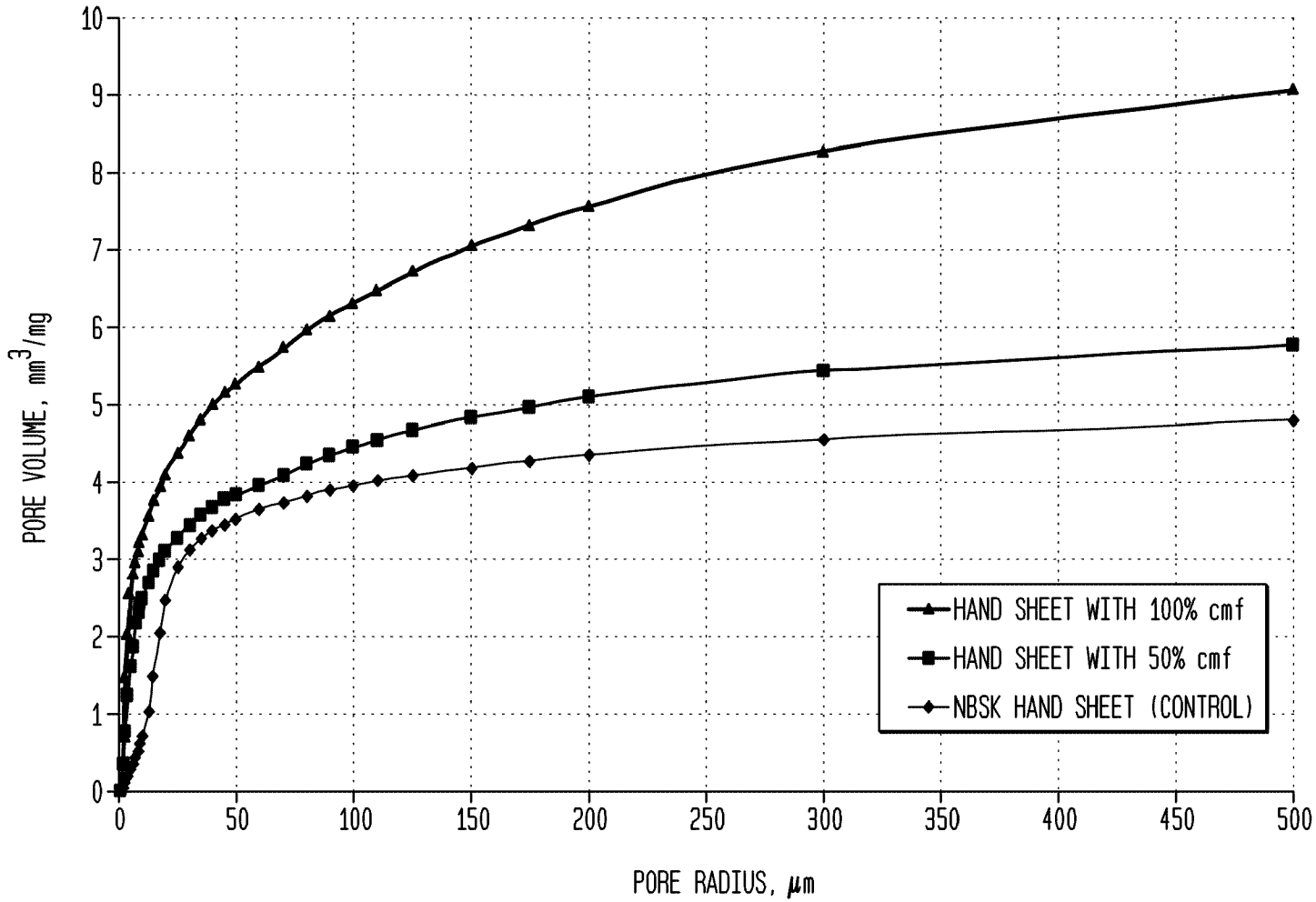
FIG. 25 illustrates a plot of cumulative pore volume versus pore radius for wipers with and without cellulose microfiber, according to one or more embodiments described.

Following the procedures noted above, handsheets were prepared and tested for porosity. Sample G was a NBSK handsheet without cmf, Sample J was 100% cmf fiber handsheet and sample K was a handsheet with 50% cmf fiber and 50% NBSK. Results appear in Table 16 and FIGS. 24 and 25.

TABLE 16

Handsheet Porosity

| Pore Radius, micron | Capillary Pressure, $mmH_2O$ | Cumulative (Cumul.) Pore Volume Sample G, $mm^3/mg$ | Cumul. Pore Volume Sample G, % | Pore Radius, micron | Pore Volume Sample G, $mm^3/(um * g)$ | Cumul. Pore Volume Sample J, $mm^3/mg$ | Cumul. Pore Volume Sample J, % | Pore Volume Sample J, $mm^3/(um * g)$ | Cumul. Pore Volume Sample K, $mm^3/mg$ | Cumul. Pore Volume Sample K, % | Pore Volume Sample K, $mm^3/(um * g)$ |
|---|---|---|---|---|---|---|---|---|---|---|---|
| 500 | 12.3 | 4.806 | 100.0 | 400.0 | 1.244 | 9.063 | 100.0 | 3.963 | 5.769 | 100.0 | 1.644 |
| 300 | 20.4 | 4.557 | 94.8 | 250.0 | 2.149 | 8.271 | 91.3 | 7.112 | 5.440 | 94.3 | 3.365 |
| 200 | 30.6 | 4.342 | 90.4 | 187.5 | 2.990 | 7.560 | 83.4 | 9.927 | 5.104 | 88.5 | 5.247 |
| 175 | 35 | 4.267 | 88.8 | 162.5 | 3.329 | 7.311 | 80.7 | 10.745 | 4.972 | 86.2 | 5.543 |
| 150 | 40.8 | 4.184 | 87.1 | 137.5 | 3.989 | 7.043 | 77.7 | 13.152 | 4.834 | 83.8 | 6.786 |
| 125 | 49 | 4.084 | 85.0 | 117.5 | 4.788 | 6.714 | 74.1 | 15.403 | 4.664 | 80.9 | 8.428 |
| 110 | 55.7 | 4.013 | 83.5 | 105.0 | 5.734 | 6.483 | 71.5 | 16.171 | 4.538 | 78.7 | 8.872 |
| 100 | 61.3 | 3.955 | 82.3 | 95.0 | 6.002 | 6.321 | 69.8 | 17.132 | 4.449 | 77.1 | 9.934 |
| 90 | 68.1 | 3.895 | 81.1 | 85.0 | 8.209 | 6.150 | 67.9 | 17.962 | 4.350 | 75.4 | 11.115 |
| 80 | 76.6 | 3.813 | 79.4 | 75.0 | 7.867 | 5.970 | 65.9 | 23.652 | 4.239 | 73.5 | 15.513 |
| 70 | 87.5 | 3.734 | 77.7 | 65.0 | 8.950 | 5.734 | 63.3 | 25.565 | 4.083 | 70.8 | 13.651 |
| 60 | 102.1 | 3.645 | 75.9 | 55.0 | 13.467 | 5.478 | 60.4 | 20.766 | 3.947 | 68.4 | 10.879 |
| 50 | 122.5 | 3.510 | 73.0 | 47.5 | 12.794 | 5.270 | 58.2 | 25.071 | 3.838 | 66.5 | 11.531 |
| 45 | 136.1 | 3.446 | 71.7 | 42.5 | 16.493 | 5.145 | 56.8 | 29.581 | 3.780 | 65.5 | 21.451 |

TABLE 16-continued

Handsheet Porosity

| Pore Radius, micron | Capillary Pressure, $mmH_2O$ | Cumulative (Cumul.) Pore Volume Sample G, $mm^3/mg$ | Cumul. Pore Volume Sample G, % | Pore Radius, micron | Pore Volume Sample G, $mm^3/(um * g)$ | Cumul. Pore Volume Sample J, $mm^3/mg$ | Cumul. Pore Volume Sample J, % | Pore Volume Sample J, $mm^3/(um * g)$ | Cumul. Pore Volume Sample K, $mm^3/mg$ | Cumul. Pore Volume Sample K, % | Pore Volume Sample K, $mm^3/(um * g)$ |
|---|---|---|---|---|---|---|---|---|---|---|---|
| 40 | 153.1 | 3.364 | 70.0 | 37.5 | 19.455 | 4.997 | 55.1 | 37.527 | 3.673 | 63.7 | 22.625 |
| 35 | 175 | 3.267 | 68.0 | 32.5 | 28.923 | 4.810 | 53.1 | 41.024 | 3.560 | 61.7 | 24.854 |
| 30 | 204.2 | 3.122 | 65.0 | 27.5 | 42.805 | 4.604 | 50.8 | 46.465 | 3.436 | 59.6 | 32.211 |
| 25 | 245 | 2.908 | 60.5 | 22.5 | 88.475 | 4.372 | 48.2 | 54.653 | 3.275 | 56.8 | 35.890 |
| 20 | 306.3 | 2.465 | 51.3 | 18.8 | 164.807 | 4.099 | 45.2 | 61.167 | 3.095 | 53.7 | 47.293 |
| 17.5 | 350 | 2.053 | 42.7 | 16.3 | 220.019 | 3.946 | 43.5 | 73.384 | 2.977 | 51.6 | 48.704 |
| 15 | 408.3 | 1.503 | 31.3 | 13.8 | 186.247 | 3.762 | 41.5 | 81.228 | 2.855 | 49.5 | 62.101 |
| 12.5 | 490 | 1.038 | 21.6 | 11.3 | 126.594 | 3.559 | 39.3 | 95.602 | 2.700 | 46.8 | 78.623 |
| 10 | 612.5 | 0.721 | 15.0 | 9.5 | 108.191 | 3.320 | 36.6 | 104.879 | 2.504 | 43.4 | 91.098 |
| 9 | 680.6 | 0.613 | 12.8 | 8.5 | 94.149 | 3.215 | 35.5 | 118.249 | 2.412 | 41.8 | 109.536 |
| 8 | 765.6 | 0.519 | 10.8 | 7.5 | 84.641 | 3.097 | 34.2 | 132.854 | 2.303 | 39.9 | 136.247 |
| 7 | 875 | 0.434 | 9.0 | 6.5 | 78.563 | 2.964 | 32.7 | 155.441 | 2.167 | 37.6 | 291.539 |
| 6 | 1020.8 | 0.356 | 7.4 | 5.5 | 79.416 | 2.809 | 31.0 | 242.823 | 1.875 | 32.5 | 250.346 |
| 5 | 1225 | 0.276 | 5.8 | 4.5 | 73.712 | 2.566 | 28.3 | 529.000 | 1.625 | 28.2 | 397.926 |
| 4 | 1531.3 | 0.203 | 4.2 | 3.5 | 78.563 | 2.037 | 22.5 | 562.411 | 1.227 | 21.3 | 459.953 |
| 3 | 2041.7 | 0.124 | 2.6 | 2.5 | 86.401 | 1.475 | 16.3 | 777.243 | 0.767 | 13.3 | 411.856 |
| 2 | 3062.5 | 0.038 | 0.8 | 1.5 | 37.683 | 0.697 | 7.7 | 697.454 | 0.355 | 6.2 | 355.034 |
| 1 | 6125 | 0.000 | 0.0 | | | 0.000 | 0.0 | | 0.000 | 0.0 | |

Here again, it is seen that the sheets containing cmf had significantly more relative pore volume at small pore radii. The cmf containing two ply sheet had twice as much relative pore volume below 10-15 microns than the NBSK sheet; while the cmf and cmf containing handsheets had 3-4 times the relative pore volume below about 10-15 microns than the handsheet without cmf.

Figure 26:
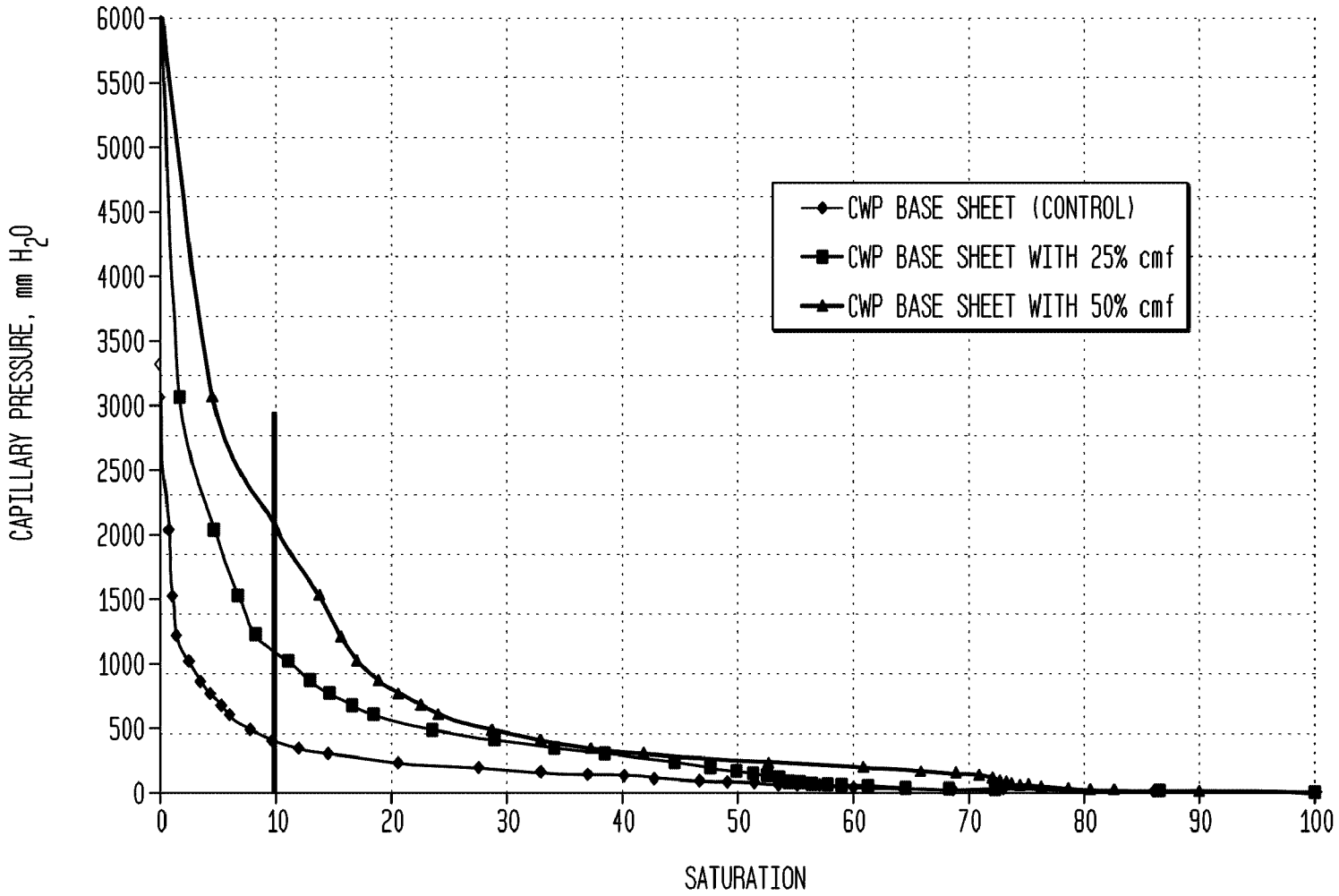
FIG. 26 illustrates a plot of capillary pressure versus saturation for sheets with and without cellulose microfiber, according to one or more embodiments described.

FIG. 26 is a plot of capillary pressure versus saturation (cumulative pore volume) for CWP sheets with and without cmf. Here it is seen that sheets with cellulose microfiber exhibit up to 5 times the capillary pressure at low saturation due to the large fraction of small pores.

A Bendtsen smoothness and porosity tester (9 code SE 114), equipped with air compressor, 1 kg test head, 4 kg weight and clean glass plate was obtained from L&W USA, Inc., 10 Madison Road, Fairfield, N.J. 07004 and used in the tests which are described below. Tests were conducted in accordance with ISO Test Method 8791-2 (1990).

A series of handsheets were prepared with varying amounts of cmf and the conventional papermaking fibers listed in Table 16. The handsheets were prepared wherein one surface was plated and the other surface was exposed during the air drying process. Both sides were tested for Bendtsen Roughness at 1 kg pressure and 5 kg pressure. Table 17 presents the average values of Bendtsen Roughness at 1 kg pressure and at 5 kg pressure, as well as the relative average Bendtsen Smoothness as compared with cellulosic sheets made without regenerated cellulose microfiber.

TABLE 17

Bendtsen Roughness and Relative Bendtsen Smoothness

| Description | % cmf | Bendtsen Roughness Ave-1 kg mL/min | Bendtsen Roughness Ave-5 kg mL/min | Relative Bendtsen Smoothness (Avg) 1 kg | Relative Bendtsen Smoothness (Avg) 5 kg |
|---|---|---|---|---|---|
| 0% cmf/100% NSK | 0 | 762 | 372 | 1.00 | 1.00 |
| 20% cmf/80% NSK | 20 | 382 | 174 | 2.00 | 2.14 |
| 50% cmf/50% NSK | 50 | 363 | 141 | 2.10 | 2.63 |
| 100% cmf/0% NSK | 100 | 277 | 104 | — | — |
| 0% cmf/100% SWK | 0 | 1,348 | 692 | 1.00 | 1.00 |
| 20% cmf/80% SWK | 20 | 590 | 263 | 2.29 | 2.63 |
| 50% cmf/50% SWK | 50 | 471 | 191 | 2.86 | 3.62 |
| 100% cmf/0% SWK | 100 | 277 | 104 | — | — |
| 0% cmf/100% Euc | 0 | 667 | 316 | 1.00 | 1.00 |
| 20% cmf/80% Euc | 20 | 378 | 171 | 1.76 | 1.85 |
| 50% cmf/50% Euc | 50 | 314 | 128 | 2.13 | 2.46 |
| 100% cmf/0% Euc | 100 | 277 | 104 | — | — |
| 0% cmf/100% SW BCTMP | 0 | 2,630 | 1,507 | 1.00 | 1.00 |
| 20% cmf/80% SW BCTMP | 20 | 947 | 424 | 2.78 | 3.55 |
| 50% cmf/50% SW BCTMP | 50 | 704 | 262 | 3.74 | 5.76 |
| 100% cmf/0% SW BCTMP | 100 | 277 | 104 | — | — |

Figure 27:
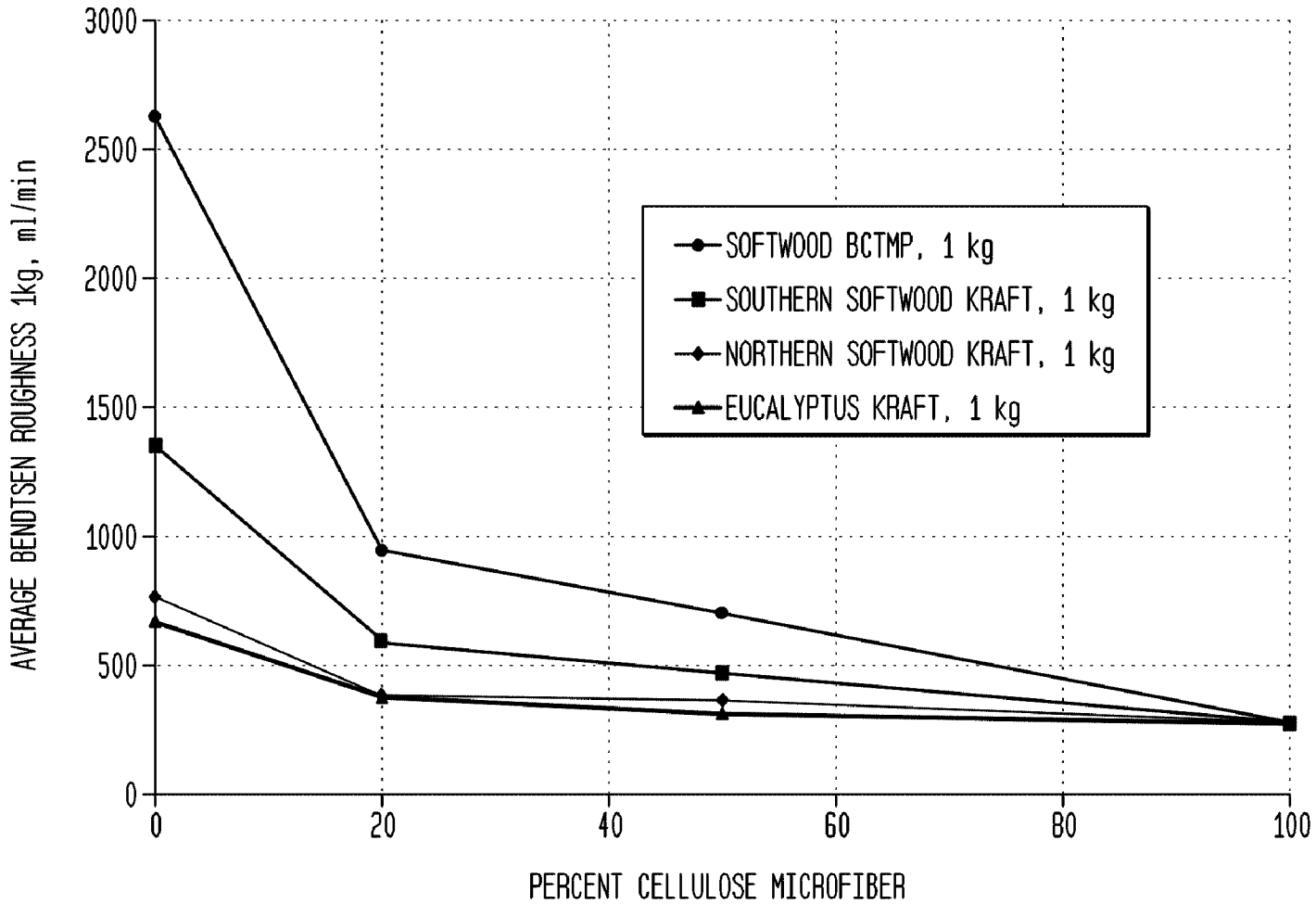
FIG. 27 illustrates a plot of average Bendtsen Roughness at 1 kg, mL/min versus percent by weight cellulose microfiber in the sheet, according to one or more embodiments described.

FIG. 27 graphically represents the measured Bendtsen Roughness at 1 kg pressure. It can be appreciated from Table 17 and FIG. 27 that Bendtsen Roughness decreases in a synergistic fashion (i.e. exponentially), especially at additions of fiber up to 50% or so. The relative smoothness of the sheets relative to a sheet without papermaking fiber ranged from about 1.7 at 1 kg up to about 6 in these tests.

Other embodiments can include:

1. A base sheet for food wrap products comprising:

a pulp-derived papermaking fiber and a fibrillated regenerated cellulose microfiber having a CSF value of less than about 175 mL.

2. The base sheet according to paragraph 1, wherein the base sheet has a 1-sheet caliper of from about 1 mil to about 3 mils, a basis weight of from about 5 lbs to about 25 lbs per 3,000 $ft^2$, and an MD tensile of greater than about 5 lbs/inch.

3. The base sheet according to paragraphs 1 or 2, wherein the fibrillated regenerated cellulose microfiber has a CSF value of less than about 100 mL.

4. The base sheet according to any paragraph 1 to 3, wherein the fibrillated regenerated cellulose microfiber has a CSF value of less than about 25 mL.

5. The base sheet according to any paragraph 1 to 4, wherein the fibrillated regenerated cellulose microfiber has a number average diameter of from about 0.1 microns to about 2 microns.

6. The base sheet according to any paragraph 1 to 5, wherein the fibrillated regenerated cellulose microfiber has a coarseness value of from about 0.001 mg/100 m to about 0.6 mg/100 m.

7. The base sheet according to any paragraph 1 to 6, wherein the fibrillated regenerated cellulose microfiber has a weight average diameter of less than about 2 microns, a weight average length of less than about 500 microns, and a fiber count of greater than about 400 million fibers/gram.

8. The base sheet according to any paragraph 1 to 7, wherein the fibrillated regenerated cellulose microfiber has a fiber count greater than about 200 billion fibers/gram.

9. The base sheet according to any paragraph 1 to 8, wherein at least about 50 wt % of the fibrillated regenerated cellulose microfiber is finer than 14 mesh.

10. The base sheet according to any paragraph 1 to 9, wherein at least about 75% by weight of the fibrillated regenerated cellulose microfiber is finer than 14 mesh.

11. A method for making a food wrap paper product comprising:

forming a base sheet comprising pulp-derived papermaking fiber and regenerated cellulose microfiber; and treating the base sheet with a water or grease resistant agent.

12. The method according to paragraph 11, wherein the water or grease resistant agent comprises a polyacrylate or polymethacrylate.

13. The method according to paragraphs 11 or 12, wherein the water or grease resistant agent comprises a polyamide or a styrene/butadiene polymer.

14. The method according to any paragraph 11 to 13, wherein the water or grease resistant agent comprises a polyolefin polymer or a polyester polymer.

15. The method according to any paragraph 11 to 14, wherein the water or grease resistant agent comprises a polylactide polymer or a polylalkanoate polymer.

16. The method according to any paragraph 11 to 15, wherein the water or grease resistant agent comprises a wax.

17. The method according to any paragraph 11 to 16, wherein the water or grease resistant agent comprises a fluorochemical sizing agent or a chrome complex sizing agent.

18. The method according to any paragraph 11 to 17, wherein the water resistant agent, the grease resistant agent, or both are applied to the base sheet in water-borne form.

19. The method according to any paragraph 11 to 18, wherein the water resistant agent, the grease resistant agent, or both are applied to the base sheet as a latex.

20. The method according to any paragraph 11 to 19, wherein the water resistant agent, the grease resistant agent, or both are applied to the base sheet in melt form.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure(s) is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A base sheet for food wrap products, comprising:

a pulp-derived papermaking fiber; and a fibrillated regenerated cellulose microfiber having a CSF value of less than about 175 mL, wherein the base sheet has a SAT value of less than 2 g/g, a 1-sheet caliper from about 1 mil to about 3 mils, a basis weight from about 5 lbs to about 25 lbs per 3,000 $ft^2$, and an MD tensile of greater than about 5 lbs/inch.

2. The base sheet of claim 1, wherein the fibrillated regenerated cellulose microfiber has a CSF value of less than about 100 mL.

3. The base sheet of claim 1, wherein the fibrillated regenerated cellulose microfiber has a CSF value of less than about 25 mL.

4. The base sheet of claim 1, wherein the fibrillated regenerated cellulose microfiber has a number average diameter of from about 0.1 microns to about 2 microns.

5. The base sheet of claim 1, wherein the fibrillated regenerated cellulose microfiber has a coarseness value of from about 0.001 mg/100 m to about 0.6 mg/100 m.

6. The base sheet of claim 1, wherein the fibrillated regenerated cellulose microfiber has a weight average diameter of less than about 2 microns, a weight average length of less than about 500 microns, and a fiber count of greater than about 400 million fibers/gram.

7. The base sheet of claim 1, wherein the fibrillated regenerated cellulose microfiber has a fiber count greater than about 200 billion fibers/gram.

8. The base sheet of claim 1, wherein at least about 50 wt % of the fibrillated regenerated cellulose microfiber is finer than 14 mesh.

9. The base sheet of claim 1, wherein at least about 75% by weight of the fibrillated regenerated cellulose microfiber is finer than 14 mesh.

10. The base sheet of claim 1, wherein the base sheet comprises from about 15 wt % to about 95 wt % of the fibrillated regenerated cellulose microfiber.

11. The base sheet of claim 1, wherein the base sheet has a pore size of less than about 15 microns.

12. The base sheet of claim 1, wherein the base sheet has about 50% of its cumulative pore volume in pore sizes of about 15 microns or less.

13. A base sheet for food wrap products, comprising:

a pulp-derived papermaking fiber;

a fibrillated regenerated cellulose microfiber having a CSF value of less than about 175 mL, a weight average length of less than about 400 microns, and a weight average diameter of less than about 2 microns; and a water or grease resistant agent, or both applied to the base sheet in water borne form, melt form, or as a latex, wherein the base sheet has a SAT value of less than 2 g/g, a MD tensile strength of greater than about 10 lbs/inch, and a pore size of less than about 15 microns.

14. The base sheet of claim 13, wherein the fibrillated regenerated cellulose microfiber has a CSF value of less than about 25 mL.

15. The base sheet of claim 13, wherein the base sheet has a 1-sheet caliper of about 1 mil to about 3 mils and a basis weight of about 5 lbs to about 25 lbs per 3,000 $ft^2$.

* * * * *